US006232027B1

(12) United States Patent
Matsunaga et al.

(10) Patent No.: US 6,232,027 B1
(45) Date of Patent: May 15, 2001

(54) TONER HAVING NEGATIVE TRIBOELECTRIC CHARGEABILITY AND IMAGE FORMING METHOD

(75) Inventors: Satoshi Matsunaga, Mishima; Toshiaki Nakahara, Shizuoka-ken; Yuichi Mizoh, Shizuoka-ken; Hirohide Tanikawa, Shizuoka-ken; Minekazu Endo, Kawasaki; Tadashi Doujo, Numazu; Nene Shibayama, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/318,776

(22) Filed: May 26, 1999

(30) Foreign Application Priority Data

| | | |
|---|---|---|
| May 26, 1998 | (JP) | 10-143681 |
| Jun. 30, 1998 | (JP) | 10-183458 |
| Jul. 31, 1998 | (JP) | 10-216607 |
| Jul. 31, 1998 | (JP) | 10-216608 |
| Dec. 4, 1998 | (JP) | 10-346087 |
| Dec. 4, 1998 | (JP) | 10-346192 |

(51) Int. Cl.[7] ..... G03G 9/087; G03G 9/097

(52) U.S. Cl. ..... 430/109; 430/110; 430/126

(58) Field of Search ..... 430/110, 109, 430/126

(56) References Cited

U.S. PATENT DOCUMENTS

| | | | | |
|---|---|---|---|---|
| 2,297,691 | | 10/1942 | Carlson | 95/5 |
| 3,666,363 | | 5/1972 | Tanaka et al. | 355/17 |
| 4,071,361 | | 1/1978 | Marushima | 96/1.4 |
| 4,966,829 | | 10/1990 | Yasuda et al. | 430/106.6 |
| 5,200,288 | * | 4/1993 | Ando et al. | 430/110 |
| 5,447,813 | | 9/1995 | Hagiwara et al. | 430/106.6 |
| 5,716,746 | | 2/1998 | Mikuriya et al. | 430/106.6 |
| 5,773,183 | | 6/1998 | Doujo et al. | 430/106 |
| 5,863,695 | | 1/1999 | Tanikawa et al. | 430/126 |
| 5,902,709 | * | 5/1999 | Nakayama et al. | 430/109 |

FOREIGN PATENT DOCUMENTS

| | | | |
|---|---|---|---|
| 0490370 | | 6/1992 | (EP) . |
| 6931 | | 1/1974 | (JP) . |
| 127726 | | 11/1978 | (JP) . |
| 114245 | | 9/1979 | (JP) . |
| 116043 | | 11/1981 | (JP) . |
| 104940 | | 6/1982 | (JP) . |
| 111541 | | 7/1982 | (JP) . |
| 124357 | | 8/1982 | (JP) . |
| 102246 | | 6/1983 | (JP) . |
| 159546 | | 9/1983 | (JP) . |
| 069073 | | 4/1986 | (JP) . |
| 073963 | | 4/1986 | (JP) . |
| 267058 | | 11/1986 | (JP) . |
| 105156 | | 5/1987 | (JP) . |
| 145255 | | 6/1987 | (JP) . |
| 163061 | | 7/1987 | (JP) . |
| 208865 | | 8/1988 | (JP) . |
| 156759 | | 6/1989 | (JP) . |
| 000881 | | 1/1990 | (JP) . |
| 276166 | | 12/1991 | (JP) . |
| 084141 | | 3/1992 | (JP) . |
| 214421 | | 8/1994 | (JP) . |
| 022145 | | 1/1996 | (JP) . |
| 054753 | | 2/1996 | (JP) . |
| 160668 | | 6/1996 | (JP) . |
| 196199 | | 8/1996 | (JP) . |
| 146292 | | 6/1997 | (JP) . |
| 146300 | | 6/1997 | (JP) . |
| 204071 | | 8/1997 | (JP) . |
| 219142 | | 8/1997 | (JP) . |
| 244294 | | 9/1997 | (JP) . |
| 9-319142 | * | 12/1997 | (JP) . |
| 010785 | | 1/1998 | (JP) . |
| 090939 | | 4/1998 | (JP) . |
| 10-115951A | * | 5/1998 | (JP) . |

OTHER PUBLICATIONS

Borsenberger, Paul M. et al. Organic Photoreceptors for Imaging Systems. New York: Marcel–Dekker, Inc. pp. 6–17, 1993.*

Patent Abstracts of Japan, vol. 15, No. 449 (P–1275) Nov. 1991 for JP 03 188468.

Database WP1, Sec. Ch, Wk 198336, Derwent Publ., AN 1983–755975.

Database WP1, Wk. 197742, Derwent Publ., AN1977–75153y.

Database WP1, Sec. Ch, Wk. 199311, Derwent Publ., Class E05, AN 1993–089545.

* cited by examiner

*Primary Examiner*—Christopher D. Rodee
(74) *Attorney, Agent, or Firm*—Fitzpatrick, Cella, Harper & Scinto

(57) ABSTRACT

A toner having a negative triboelectric chargeability is constituted by at least a binder resin, a colorant and an organic metal compound. The toner is characterized by: (a) the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids, (b) the binder resin is a resin selected from the group consisting of (i) a polyester resin and (ii) a hybrid resin component comprising a polyester unit and a vinyl polymer unit, (c) the binder resin has an acid value of 2–50 mgKOH/g, and (d) the toner contains a TFT (tetrahydrofuran)-soluble content providing a GPC (gel permeation chromatography) chromatogram exhibiting a main peak in a molecular weight range of 3,000–20,000 and including 3–25% of a component having molecular weights of at least $5\times10^5$.

129 Claims, 11 Drawing Sheets

$^{13}$C-NMR FOR LOW-CROSSLINKED POLYESTER RESIN

TONER HAVING NEGATIVE TRIBOELECTRIC CHARGEABILITY AND IMAGE FORMING METHOD

FIELD OF THE INVENTION AND RELATED ART

The present invention relates to a toner having a negative triboelectric chargeability used in a recording method utilizing electrophotography, electrostatic recording, electrostatic printing or toner jet recording, and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., via or without via an intermediate transfer member, as desired, fixed by heating, pressing, or heating and pressing, or with solvent vapor to obtain a copy or print carrying a fixed toner image.

In the developing step, it is necessary for such a toner to be provided with a positive or negative charge depending on the polarity of an electrostatic image to be developed and the developing mode (normal development mode or reversal development mode).

A toner can be charged by utilizing a triboelectric chargeability of a resin as a toner component, but the toner chargeability in this case is unstable so that the resultant image density is lowered at the start of image formation and the resultant images are liable to be foggy. For this reason, it has been frequently practiced to add a charge control agent to the toner to provide the toner with a desired triboelectric chargeability.

The charge control agents known in the art nowadays include: negatively chargeable charge control agents inclusive of metal complex salts of monoazo dyes; metal complexes or metal complex salts of hydroxycarboxylic acids, dicarboxylic acids and aromatic diols; and polymeric compounds or resins containing an acidic component. On the other hand, known positively chargeable charge control agents include: nigrosine dyes, azine dyes, triphenylmethane dyes and pigments, quaternary ammonium salts, and polymers having a quaternary ammonium salt as a side chain.

However, most of such known charge control agents are colored ones, thus being not usable in color toners in many cases. Further, those of colorless, white or pale-colored applicable to color toners have still left functionally unsatisfactory points, such as difficulty in formation of uniform highlight images and a large fluctuation in image density during continuous image formation.

Other points to be further improved may include: a difficulty in obtaining a good balance between image density and fog prevention, a difficulty in obtaining a sufficient image density in a high humidity environment, a poor dispersibility in a resin, and adverse effects on storage stability, fixability and anti-offset property of the resultant toner.

As known charge control agents, metal complexes or metal complex salts of aromatic carboxylic acids have been proposed in Japanese Laid-Open Patent Application (JP-A) 53-127726, JP-A 57-111541, JP-A 57-124357, JP-A 57-104940, JP-A 61-69073, JP-A 61-73963, JP-A 61-267058, JP-A 62-105156, JP-A 62-145255, JP-A 62-163061, JP-A 63-208865, JP-A 3-276166, JP-A 4-84141, and JP-A 8-160668. Charge control agents proposed in these references are generally excellent in performance of imparting triboelectric chargeability, but few of them are satisfactory in providing a stable developing performance regardless of environmental condition change, continued use and condition of use even when used in a simple developing device structure. Few of them provide a stable developing performance in a long term of continuous image formation when used in a high-speed image forming machine. Further, some of them are affected by other toner materials (binder resin, colorant, etc.), thus posing a constraint on the selection of such other toner materials.

As for the step of fixing the toner image onto a sheet (transfer) material such as paper which is the final step in the above-mentioned electrophotographic process, various methods and apparatus have been developed, of which the most popular one is a heating and pressing fixation system using hot rollers, or a fixed heat generating heater for fixation via a heat-resistant film.

In the heating and pressing system using hot rollers, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation.

In the fixing step, however, a hot roller surface and a toner image contact each other in a softened or melted state and under a pressure, so that a part of the toner is transferred and attached to the fixing roller surface and then re-transferred to a subsequent fixation sheet to soil the fixation sheet. This is called an offset phenomenon and is remarkably affected by the fixing speed and temperature. Generally, the fixing roller surface temperature is set to be relatively low in case of a slow fixing speed and set to be relatively high in case of a fast fixing speed. This is because a constant heat quantity is supplied to the toner image for fixation thereof regardless of a difference in fixing speed.

The toner image on a fixation sheet is deposited in several layers, so that there is liable to occur a large temperature difference between a toner layer contacting the heating roller and a lowermost toner layer particularly in a hot-fixation system using a high heating roller temperature. As a result, a topmost toner layer is liable to cause a so-called high-temperature offset phenomenon in case of a high heating roller temperature, while a so-called low-temperature offset is liable to occur because of insufficient melting of the lowermost toner layer in case of a low heating roller temperature.

In order to solve the above problem, it has been generally practiced to increase the fixing pressure in case of a fast fixing speed in order to promote the anchoring of the toner onto the fixation sheet. According to this method, the heating roller temperature can be somewhat lowered and it is possible to obviate a high-temperature offset phenomenon of an uppermost toner layer. However, as a very high shearing force is applied to the toner layer, there are liable to be caused several difficulties, such as a winding offset that the fixation sheet winds about the fixing roller, the occurrence of a trace in the fixed image of a separating member for separating the fixation sheet from the fixing roller, and inferior fixed images, such as resolution failure of line images and toner scattering, due to a high pressure.

In recent years, there has been frequently used recycled paper (paper prepared by reusing used paper) as paper for copying machines or printers in order to meet social demands for reductions in weight and amount of paper wastes as a result of office automation. Such recycled paper is generally produced by adding a filler principally comprising talc or calcium carbonate in a proportion of 10–20% as ash content, which is larger than that (ca. 5%) of the case of non-recycled paper. When such recycled paper is used in a copying machine or printer for a long period, a filler used for the recycled paper is liable to be detached or liberated therefrom to attach to and accumulate at a fixing member (e.g., fixing roller or pressure roller), thus lowering a releasability. As a result, the toner is liable to attach to the fixed image surface or the back surface of the transfer material (paper) to result in image defects in some cases, so that a further improvement is required.

Hitherto, as toner binder resins, polyester resins, and vinyl copolymers, such as styrene copolymers, have been principally used.

A polyester resin provides an excellent low-temperature fixability but is accompanied with a difficulty that it is liable to cause the high-temperature offset. For alleviating the difficulty, it has been tried to improve the viscoelasticity of a polyester resin by increasing the molecular weight. In this case, however, the low-temperature fixability is liable to be impaired, and the pulverizability during toner production can also be impaired, thus providing a binder resin not suitable for production of smaller particle size toners. Further, a polyester resin has a relatively high affinity with the filler attached to the fixing member, thus being liable to cause soiling of the fixed image. In this regard, a further improvement is required.

A vinyl copolymer, such as a styrene copolymer, has excellent pulverizability suitable for toner production, and provides excellent anti-high-temperature offset performance because the molecular weight thereof can be increased easily. However, if the molecular weight or glass transition temperature thereof is lowered in order to provide an improved low-temperature fixability, the anti-blocking property and developing performance are liable to be impaired.

In order to effectively utilize the advantages and compensate for the difficulties of the above two types of resins, several proposals have been made regarding the use of mixtures of these resins.

For example, JP-A 54-114245 and JP-A 49-6931 discloses a toner containing a mixture of a polyester resin and a vinyl copolymer. However, since a polyester resin and a vinyl copolymer have remarkably different chemical structures, they have poor mutual solubility and it is difficult to provide a toner satisfying low-temperature fixability, anti-high-temperature offset performance and anti-blocking property in combination.

Further, it is difficult to uniformly disperse various additives, particularly a wax, added for toner production, thus being liable to result in problems not only in fixing performance but also in developing performance of the resultant toner. This difficulty is liable to be noticeable especially in production of smaller-particle size toners which are preferred in recent years.

JP-A 56-116043 and JP-A 58-159546 disclose a toner containing a polymer obtained by polymerizing a vinyl monomer in the presence of a polyester resin.

JP-A 58-102246 and JP-A 1-156759 disclose a toner containing a polymer obtained by polymerizing vinyl monomers in the presence of an unsaturated polyester.

JP-A 2-881 discloses a toner containing a polymer obtained by esterification of a polyester resin with a styrene copolymer, prepared by polymerizing vinyl monomers, having an acid group via the acid group of the styrene copolymer.

Japanese Patent Publication (JP-B) 8-16796 (corr. to JP-A 2-000881) discloses a toner containing a block copolymer obtained by esterifying a polyester resin having a specific acid value and a styrene resin having a specific acid value and molecular weight.

JP-A 8-54753 discloses a toner containing a binder resin comprising a polycondensation resin and a vinyl resin and having a specific chloroform-insoluble content and a peak in a specific molecular weight range.

In the above-mentioned binder resins, the polycondensation resin and the vinyl resin can retain a stable phase separation state. However, the toner containing the binder resin is provided with somewhat improved anti-high-temperature offset performance but the low-temperature fixability thereof is still insufficient. Especially, in case where the toner contains a wax, it is difficult to control the wax dispersion state. The resultant toner still has room for improvement with respect to not only low-temperature fixability but also developing performance.

Further, in recent years, a smaller-particle size toner has been frequently used in order to provide a copied image with a higher resolution, so that the above-mentioned problems have become more noticeable.

In order to solve the problems, JP-A 8-22145 discloses the use of a binder resin for a toner obtained by producing a "polyester resin", a "vinyl resin" and a "chemical reaction product of a polyester resin and a vinyl resin" individually and then blending the three resins. In this case, however, the binder resin production step is complicated and the resultant toner still has room for improvement with respect to a quick charging performance at the start of image formation and a developing stability. Further, a crosslinked structure of the binder resin is broken under the influence of a shearing force applied during a melt-kneading step for toner production, thus resulting in a remarkable lowering in anti-high-temperature offset performance. In addition, the toner melted in a fixing step is liable to be transferred onto a fixing roller or a heat-resistant film and then re-transferred onto another fixation sheet to soil a resultant image.

JP-A 6-214421 discloses an image forming method using a toner containing an aluminum complex as a charge-promoting agent.

JP-A 10-115951 discloses a toner having a peak in a specific molecular weight range and a specific tetrahydrofuran (THF)-insoluble content.

JP-A 9-146300 discloses a toner containing a polyester resin having a specific THF-insoluble content as a binder resin and containing a graft-modified polyethylene wax.

JP-A 9-204071 discloses a toner containing a binder resin comprising a polyester resin having a specific acid value and molecular weight distribution.

JP-A 9-319142 discloses a toner containing a binder resin comprising a polyester resin having a specific THF-insoluble content and containing a polyethylene wax having a specific penetration and melt-viscosity.

JP-A 9-146292 discloses a toner containing polyalkylene fine particles having a specific coefficient of kinetic friction, wherein a contact angle at a surface of a solid image fixed on a sheet for an overhead projector (OHP sheet) is in a specific range.

JP-A 9-244294 discloses a toner containing polyalkylene fine particles having a specific coefficient of kinetic friction, wherein a contact angle and dielectric loss tangent of the toner satisfy a specific relationship.

JP-A 10-10785 discloses a toner containing a binder resin having a specific molecular weight and containing a charge control agent comprising a metal complex of a monoazo compound and a metal complex of aromatic hydroxycarboxylic acid.

JP-A 10-90939 discloses a toner containing substantially no THF-insoluble content and having a peak in a specific molecular weight range and a specific acid value.

In the above-mentioned toners, the fixability is somewhat improved but the offset-prevention effect on the hot roller or the heat-resistant film is insufficient.

SUMMARY OF THE INVENTION

A generic object of the present invention is to provide a toner having a negative triboelectric chargeability and having solved the above-mentioned problems, and an image forming method using the toner.

A more specific object of the present invention is to provide a toner having a negative triboelectric chargeability capable of stably providing high image qualities even when used in a high humidity environment and not causing image defects with lapse of time.

Another object of the present invention is provide a toner having a negative triboelectric chargeability which is not accumulated on a fixing member and causes no soiling of a fixed image during the fixation even in a long term of continuous image formation using recycled paper as a transfer material.

Another object of the present invention is to provide a toner having a negative triboelectric chargeability capable of exhibiting a good low-temperature fixability and causing no heating member soiling due to offset phenomenon in a low to high temperature range even when used in a high to medium-speed apparatus using a hot roller fixing device or a medium to low-speed apparatus using a fixed heater via a heat-resistant film.

Another object of the present invention is to provide a toner having a negative triboelectric chargeability capable of exhibiting good developing performance and providing a halftone image exhibiting good fixability even when formulated as a smaller particle size toner containing a large amount of a colorant, particularly a magnetic material.

A further object of the present invention is to provide an image forming method using a toner as described above.

According to the present invention, there is provided a toner having a negative triboelectric chargeability, comprising at least a binder resin, a colorant and an organic metal compound; wherein (a) the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids, (b) the binder resin is a resin selected from the group consisting of (i) a polyester resin and (ii) a hybrid resin component comprising a polyester unit and a vinyl polymer unit, (c) the binder resin has an acid value of 2–50 mgKOH/g, and (d) the toner contains a TFT (tetrahydrofuran)-soluble content providing a GPC (gel permeation chromatography) chromatogram exhibiting a main peak in a molecular weight range of 3,000–20,000 and including 3–25% of a component having molecular weights of at least $5\times10^5$.

According to the present invention, there is provided an image forming method, comprising:

a developing step of developing an electrostatic latent image held on an image-bearing member with a toner having a negative triboelectric chargeability to form a toner image on the image-bearing member, a transfer step of transferring the toner image on the image-bearing member onto a recording material via or without via an intermediate transfer member, and a fixing step of fixing the toner image onto the recording material by a heat-fixing means, wherein the toner comprises at least a binder resin, a colorant and an organic metal compound, and (a) the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids, (b) the binder resin is a resin selected from the group consisting of (i) a polyester resin and (ii) a hybrid resin component comprising a polyester unit and a vinyl polymer unit, (c) the binder resin has an acid value of 2–50 mgKOH/g, and (d) the toner contains a TFT (tetrahydrofuran)-soluble content providing a GPC (gel permeation chromatography) chromatogram exhibiting a main peak in a molecular weight range of 3,000–20,000 and including 3–25% of a component having molecular weights of at least $5\times10^5$.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
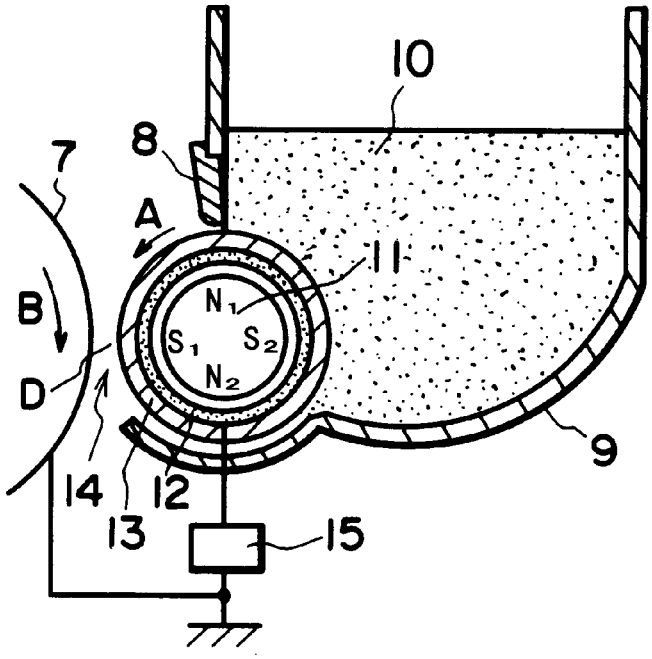
FIGS. 1 and 2 are respectively a sectional illustration of a developer replenishment-type developing device equipped with a developer-carrying member and a magnetic blade (FIG. 1) or an elastic blade (FIG. 2), respectively, as a regulating member and applicable to an embodiment of the image forming method according to the invention.

We have found it possible to provide a toner having a quick chargeability, having a high chargeability even in a high temperature—high humidity environment, free from excessive charging even in a low temperature—low humidity environment and also causing no fixed image soiling even in the case of using recycled paper prepared by using used paper by using a combination of a negative charge control agent comprising an organic zirconium compound (e.g., organic zirconium complex, organic zirconium complex salt or organic zirconium salt) obtained by reaction of a zirconium compound with an aromatic diol, an aromatic monocarboxylic acid, an aromatic polycarboxylic acid or/and an aromatic hydroxycarboxylic acid, with a binder resin comprising a polyester resin (hereinbelow, referred to as "polyester binder resin") having a specific acid value and molecular weight distribution described hereinafter.

Further, according to our study, it has been found that improvements alone in low-temperature fixability and anti-high-temperature offset performance of the toner are insufficient to prevent soiling of a fixing member (device) due to offset phenomenon irrespective of a heating mode of the fixing member and it is important therefor to improve a releasability of the toner to the fixing member.

The improvement in offset performance of the toner has been conventionally identified with that in toner fixability. However, the improvement in offset performance resulting from the fixability improvement based on an improvement in properties of a binder resin and a wax contained in the toner has a limit and accordingly is insufficient to prevent the fixing member soiling.

Further, even if releasabilities of the fixing member and a cleaning member are enhanced and expected to have a sufficient offset-prevention effect in an initial stage of the use of these members, the respective members are deteriorated with the lapse of time (years) when a toner exhibiting an insufficient releasability is used for a long period of time, thus finally causing offset phenomenon in some cases.

There has been conventionally proposed the use of a toner including a binder resin containing an insoluble content in an organic solvent (such as chloroform or THF) in view of an improvement in anti-hot (high-temperature) offset performance of a toner. Even such a toner, however, fails to achieve a sufficient offset-prevention effect for the fixing member and the cleaning member deteriorated with time (years) in some cases. Further, the toner can contain a wax for the purpose of imparting a releasability thereto but such a wax is required to be contained in a large amount in order to maintain a sufficient offset-prevention effect for the above-deteriorated fixing and cleaning members. In this case, the resultant toner is liable to be accompanied with inferior developing performances, such as a lowering in image density in continuous image formation and an increase in fog density. In addition, it is difficult to control a dispersion state of a wax contained in toner particles, so that the resultant toner includes a large amount of liberated wax (free wax component). As a result, the toner is liable to remain on a photosensitive member due to insufficient cleaning, thus leading to image defects.

We have found it possible to provide a toner having a quick chargeability, having a high chargeability even in a high temperature—high humidity environment, free from excessive charging even in a low temperature—low humidity environment, and also providing a good releasability and a good developing performance in combination while retaining a sufficient offset-prevention effect even with respect to a fixing member and cleaning member deteriorated with time (years) in continuous image formation. The toner is characterized by a combination of a negative charge control agent comprising the above-mentioned organic zirconium compound with a binder resin including a hybrid resin component comprising a polyester unit and a vinyl polymer unit (hereinbelow, referred to as "hybrid binder resin") having a specific acid value and molecular weight distribution.

As described above, the toners according to the present invention (characterized by a combination of the organic zirconium compound and the polyester binder resin and a combination of the organic zirconium compound and the hybrid binder resin) contain, as a charge control agent, an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids.

Herein, the "organic zirconium compound" refers to a compound obtained by reaction of a zirconium compound with an aromatic diol, an aromatic monocarboxylic acid, an aromatic polycarboxylic acid or/and an aromatic hydroxycarboxylic acid. Examples of the organic zirconium compound may include an organic zirconium complex compound (complex or complex salt) and an organic zirconium salt.

The organic zirconium compound used in the present invention is excellent in transparency and is desirably used in a color toner for providing clear color images. The organic zirconium compound can contain below 20 wt. % of hafnium element based on the zirconium element.

The organic zirconium compounds usable in the present invention may be classified into the following three categories:

(i) zirconium complexes each comprising metal element of zirconium and a ligand of an aromatic diol, an aromatic hydroxycarboxylic acid or an aromatic polycarboxylic acid, (ii) zirconium complex salts each comprising a metal element of zirconium and a ligand of an aromatic diol, an aromatic hydroxycarboxylic acid or an aromatic polycarboxylic acid, and (iii) salts of zirconium with aromatic carboxylic acids inclusive of aromatic carboxylic acids, aromatic hydroxycarboxylic acids and aromatic polycarboxylic acids.

It is preferred to use a zirconium complex or zirconium complex salt including 1–4 units of aromatic diol, aromatic hydroxycarboxylic acid or aromatic polycarboxylic acid so as to form a chelate. It is also possible to use a zirconium complex or complex salt including 1–6 units of coordinating carboxy anions of, aromatic hydroxycarboxylic acid, aromatic carboxylic acid or aromatic polycarboxylic acid. In the case of an organic zirconium salt, it is preferred to use a salt having 1–4 units, more preferably 1–3 units, of aromatic carboxyl acid, aromatic hydroxycarboxylic acid or aromatic polycarboxylic acid. It is also possible to use a mixture of complexes or complex salts having different number of chelates or/and different species of ligands. The zirconium salt can also be a mixture of two or more species of organic zirconium salts including those of different numbers of acids per molecule. The organic zirconium compound can also be a mixture of an organic zirconium complex compound and an organic zirconium salt.

It has been found that the organic zirconium compound provides an excellent developing performance to a monocomponent developer, inclusive of a magnetic toner containing magnetic powder, which is required to exhibit a quick chargeability and a high chargeability through relatively few triboelectrification opportunities, because of excellent performances as a negative charge control agent of the organic zirconium compound. It is also optimum to provide a non-magnetic toner used in a non-magnetic monocomponent developing method.

It is preferred that the organic zirconium compound is used in combination with a resin having an acid value in order to further improve the triboelectric chargeability while utilizing the polarity of water molecules retained in the toner particles. The dispersibility of the organic zirconium compound in the toner can be improved by using two or more species of waxes having different melting points or molecular weights, thereby providing a toner showing improved uniform chargeability and continuous image formation performances.

The toner according to the present invention containing the organic zirconium compound not only exhibits a sufficient chargeability in a low or high humidity environment but also suppresses a lowering in image density during a long term of continuous image formation. The organic zirconium compound is particularly effective for use in a magnetic toner containing a magnetic iron oxide comprising various different species of elements. Iron oxide containing different elements or oxides or hydroxides of such different elements, or iron oxide forming a mixed crystal with such different elements, may be effective for adsorbing water molecules, thus effectively improving and stabilizing the charging based on utilization of the polarity of water molecules. This effect is enhanced when a binder resin having an acid value is used in combination therewith.

The organic zirconium compound used in the present invention includes a zirconium ion capable of easily assuming an octa-coordinated configuration to be coordinated or bonded with oxygen of carboxyl and/or hydroxyl group. Accordingly, if a binder resin having an acid value, such as a polyester binder resin having a functional carboxyl group or a hybrid binder resin comprising a polyester unit having a functional carboxyl group and a vinyl polymer unit, is used together therewith, the organic zirconium compound can exhibit a good affinity with and a good dispersibility in the binder resin, so that the liberation thereof from the toner particles can be well suppressed to provide a uniform and continuously stable chargeability. The organic zirconium compound exhibits little adverse effect to the toner transparency, thus being preferable for constituting a color toner.

Further, as the binder resin can be provided with an increased crosslinking via the carboxyl or hydroxyl group of the binder resin coordinated with the zirconium, the binder resin can be provided with an increased rubber elasticity, which favors an effective prevention of toner soiling of the fixing member caused by attachment of a filler to the fixing member when recycled paper containing a large amount of the filler is used as a transfer material. Thus, it is preferred that the binder resin is crosslinked to such a degree that it contains a THF-insoluble content. As a result, it becomes possible to exert a shearing force during melt-kneading in toner production, thus improving the dispersion of a magnetic material, a pigment, or a dye to provide a toner exhibiting a high coloring power and/or a clear hue.

As mentioned above, the organic zirconium compound used in the present invention is excellent in triboelectric chargeability-imparting performance, so that it functions as a charge control agent suitable for a magnetic toner requiring a high chargeability. Further, the organic zirconium compound not only shows a good dispersibility thereof in a binder resin but also functions to promote the dispersion of a magnetic material in the binder resin if a resin having an acid value is used as the binder resin, thus providing a magnetic toner with improved uniform chargeability and continuous image formation performances.

Further, it has been found that the organic zirconium compound used in the present invention exerts some influence on the surface tension of the toner binder resin and provides a toner with an excellent releasability when used in combination with a plurality of waxes. As a result, it becomes possible to provide a toner exhibiting excellent anti-offset characteristic and suppressed soiling of the fixing member. This effect is promoted when used in combination with a binder resin having an acid value.

Another characteristic of the organic zirconium compound used in the present invention is that it provides a toner less liable to cause a lowering in developing performance after standing. For example, when the toner is used in a high-humidity environment, then left standing for some pause period and then re-used for image formation, the resultant images cause little lowering in image density.

Further, the toner according to the present invention containing the organic zirconium compound is less liable to cause insufficiently charged toner particles leading to scattering toner particles. For example, a magnetic toner is liable to cause a noticeable scattering in a low-humidity environment wherein the agglomerating force is lowered, thus causing various difficulties. More specifically, in case of an image forming system using the corona charging scheme, the scattered toner is attached to the charging wire to cause discharge abnormality which results in an abnormally charged electrostatic image leading to a streak-like image defect in the case of primary charging and also a streak-like transfer failure in the case of transfer charging. However, the toner according to the present invention can reduce such difficulties. In case of an image forming system using a contact charging scheme, the scattered toner is liable to soil the contact transfer unit and the soiling toner is liable to be transferred to a transfer paper, thus causing so-called back soiling in addition to the image defect as in the case of the corona charging scheme. The toner according to the present invention is also less liable to cause such difficulty.

In the case of a non-magnetic toner, the toner particle scattering phenomenon is more noticeably caused in a high-humidity environment since the toner is constrained only by an electrostatic force, this scattering phenomenon is also reduced by the toner according to the present invention. Further, in a low-humidity environment, a non-magnetic toner is liable to cause a density irregularity in a halftone image due to insufficiently charged particles. This difficulty can also be reduced by the toner according to the present invention.

Now, the organic zirconium compounds inclusive of zirconium complex, complex salts and salt with aromatic diol, aromatic hydroxycarboxylic acid and aromatic polycarboxylic acid will be described more specifically.

Preferred examples of the zirconium complex or complex salts may include those represented by formulae (1) and (2) below:

(1)

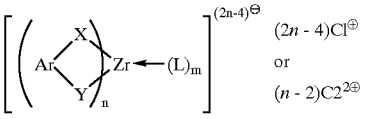

$(2n-4)Cl^{\oplus}$ or $(n-2)C2^{2\oplus}$ wherein Ar denotes an aromatic residual group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; C1 denotes a monovalent cation, such as hydrogen ion, monovalent metal ion, ammonium ion or alkylammonium ion; C2 denotes a divalent cation, such as a metal ion; n is 2, 3 or 4; m is 0, 2 or 4; a plurality (n) of ligands (such as aromatic carboxylic acids and diols) can be identical to or different from each other, and a number (m>0) of neutral ligands can be identical to or different from each other in each complex or complex salt of a formula. Further, each complex or complex salt of a formula can also be a mixture of complex compounds having mutually different n or/and m, or a mixture of complex salts having mutually different counter ions C1 or/and C2. In order to improve the dispersibility in binder resin and charge control ability of a complex or complex salt, it is preferred that the aromatic residue group (Ar) comprises benzene ring, naphthalene ring, anthracene ring or phenanthrene ring; the optional substituent is alkyl, carboxyl or hydroxyl; L is water; and C1 is hydrogen, sodium, potassium, ammonium or alkyl ammonium.

(2)

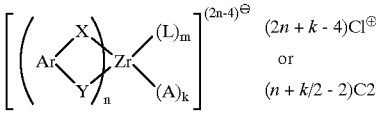

$(2n+k-4)Cl^{\oplus}$ or $(n+k/2-2)C2^{2\oplus}$ wherein Ar denotes an aromatic residue group capable of having a substituent of alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; A denotes an anion of halogen, hydroxyl, carboxylate, carbonate, nitrate, sulfate, cyano or thiocyano, a plurality of A can be identical or different when k≧2; C1 denotes a monovalent cation, such as hydrogen ion, monovalent metal ion, ammonium ion or alkylammonium ion; C2 denotes a divalent cation, such as a metal ion; n is 1, 2, 3 or 4; m is 0, 1, 2, 3 or 4; and k is 1, 2, 3, 4, 5 or 6; a plurality (when n≧2) of ligands (such as aromatic carboxylic acids and diols) can be identical to or different from each other, and a plurality (when m≧2) of neutral ligands can be identical to or different from each other in each complex or complex salt of a formula. Further, each complex or complex salt of a formula can also be a mixture of complex compounds having mutually different n or/and m, or a mixture of complex salts having mutually different counter ions C1 or/and C2. In order to improve the dispersibility in binder resin and charge control ability of a complex or complex salt, it is preferred that the aromatic residue group (Ar) comprises benzene ring, naphthalene ring, anthracene ring or phenanthrene ring; the optional substituent is alkyl, carboxyl or hydroxyl; L is water; C1 is hydrogen, sodium, potassium, ammonium or alkylammonium; and A is hydroxyl or carboxylate ion.

Further, preferred sub-classes of zirconium complexes or complex salts may be represented by the following formulae (3)–(8).

(3)

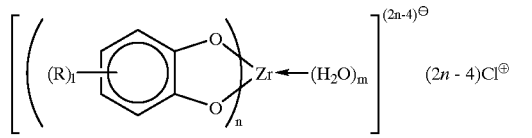

$(2n-4)Cl^{\oplus}$ (4)

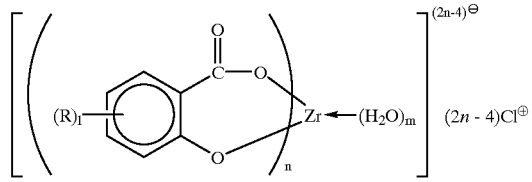

$(2n-4)Cl^{\oplus}$ (5)

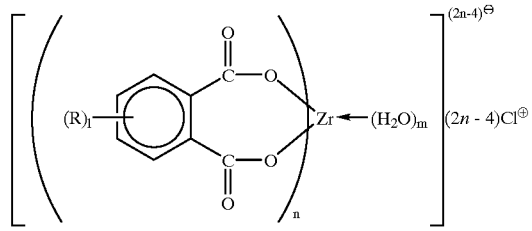

$(2n-4)Cl^{\oplus}$

In the above formulae (3), (4) and (5), R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring capable of having 1–8 similar R substituent(s); a plurality of R can be identical or different; C1 denotes a monovalent cation such as hydrogen, alkaline metal, ammonium or alkylammonium; l is an integer of 1–8; n is 2, 3 or 4; m is 0, 2 or 4; a plurality (n) of ligands can be identical or different in each complex or complex salt of a formula. Further, each complex or complex salt of a formula can be a mixture of complex compounds having mutually different n or/and m, or a mixture of complex salts having mutually different counter ions C1. In order to improve the dispersibility in binder resin and charge control ability of the complex or complex salt, it is preferred that the substituent R is alkyl, alkenyl, carboxyl or hydroxyl; C1 is hydrogen, sodium, potassium, ammonium or alkylammonium. It is particularly preferred to use a complex compound of the formula (4) or a neutral complex of the formula (3), (4) or (5) (wherein n=2) with no counter ion, so as to exhibit excellent environmental stability, dispersibility in the binder resin, and continuous image forming performances.

(6)

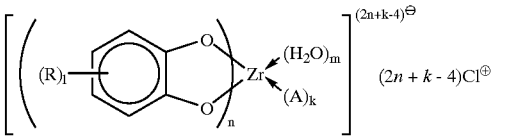

(7)

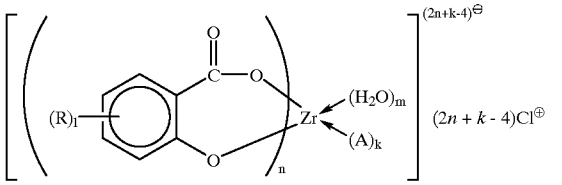

(8)

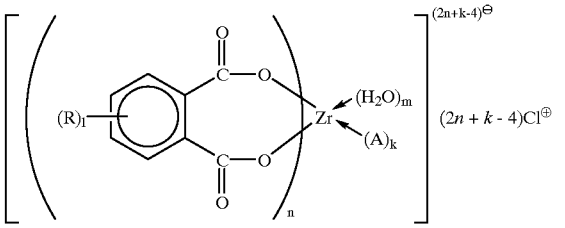

In the above formulae (6), (7) and (8), R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring capable of having 1–8 similar R substituent(s); a plurality of R can be identical or different; A denotes an anion of halogen, hydroxyl, carboxylate, carbonate, nitrate, sulfate, cyano or thiocyano, a plurality of A can be identical or different; C1 denotes a monovalent cation such as hydrogen, alkaline metal, ammonium or alkylammonium; l is an integer of 1–8; n is 1, 2, 3 or 4; m is 0, 1, 2, 3 or 4; k is 1, 2, 3, 4, 5 or 6; a plurality (when n≧2) of ligands can be identical or different in each complex or complex salt of a formula. Further, each complex or complex salt of a formula can be a mixture of complex compounds having mutually different n or/and m, or a mixture of complex salts having mutually different counter ions C1 or/and anions A. When A is a divalent anion, k for the counter cation is doubled (replaced by 2k). In order to improve the dispersibility in binder resin and charge control ability of the complex or complex salt, it is preferred that the substituent R is alkyl, alkenyl, carboxyl or hydroxyl; C1 is hydrogen, sodium, potassium, ammonium or alkylammonium and A is hydroxyl or carboxylate ion. It is particularly preferred to use a complex compound of the formula (7) or a neutral complex of the formula (6), (7) or (8) (wherein n=2) with no counter ion, so as to exhibit excellent environmental stability, dispersibility in the binder resin, and continuous image forming performances.

The zirconium complex or complex salt used in the present invention includes hexa-coordinated and octa-coordinated complex compound, and some octa-coordinated compound may assume a form of plural-nuclei complex compound wherein ligands form a crosslinkage to provide a rational formula giving a coordination number of 6. Further, it is also possible to form a plural-nuclei compound formed by successive linkage with ligands, such as hydroxyl groups.

Some typical example structures of such complex compounds are indicated by the following formulas (9)–(33), wherein some complex compounds having no ligand L are included. Further, in the formulas (30)–(33), counter cations are omitted.

(9)

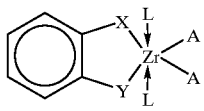

(10)

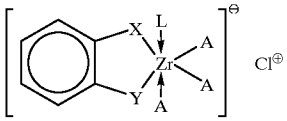

(11)

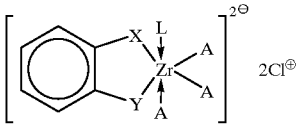

(12)

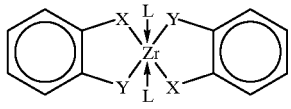

(13)

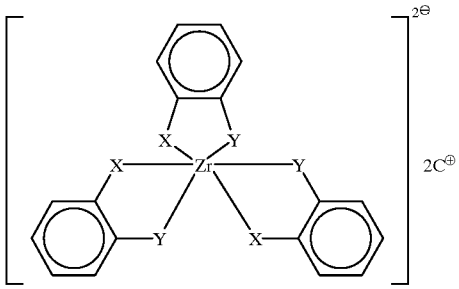

(14)

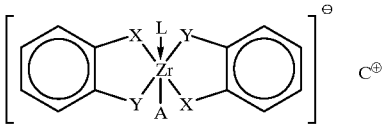

(15)

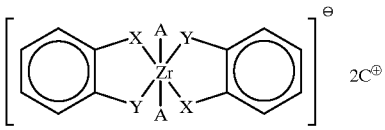

(16)

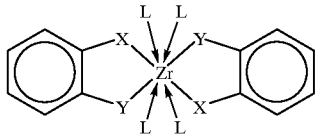

-continued
(17)
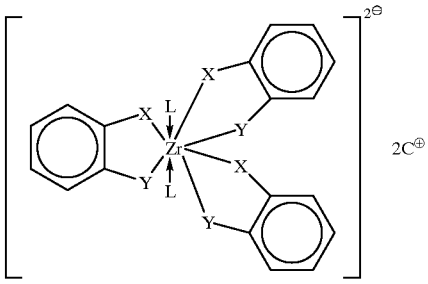
(18)
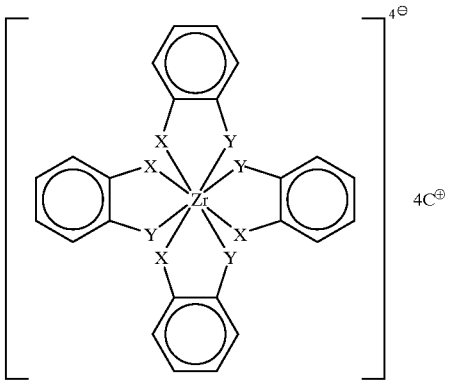
(19)
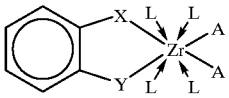
(20)
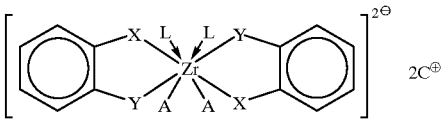
(21)
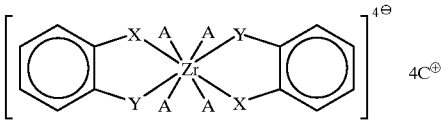
(22)
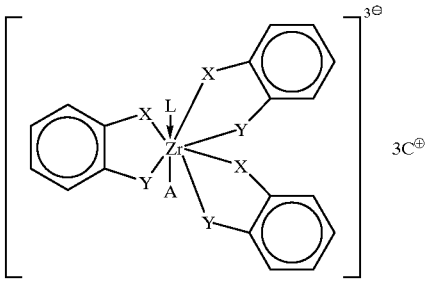
-continued
(23)
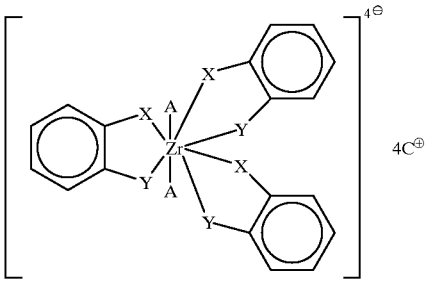
(24)
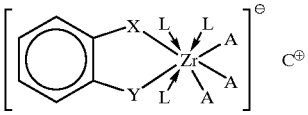
(25)
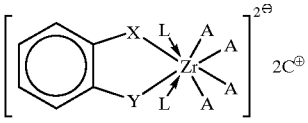
(26)
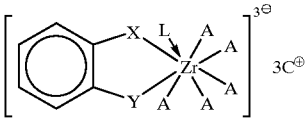
(27)
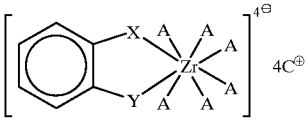
(28)
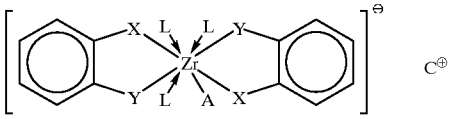
(29)
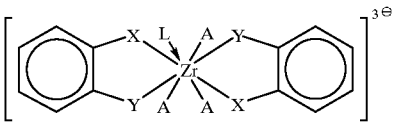
(30)
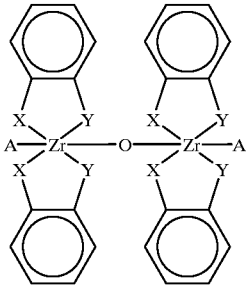

-continued (31)

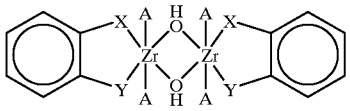

(32)

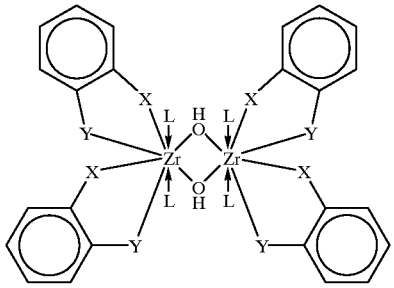

(33)

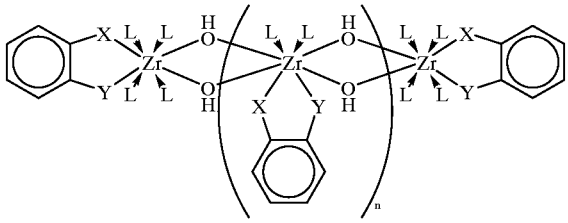

The organic zirconium compound used in the present invention can also assume a form of complex compound wherein a plurality of substituents, e.g., X and Y of hydroxyl and/or carboxyl, attached to an aromatic ring are bonded to different zirconium atoms as represented by a partial structural formula (34) below:

(34)

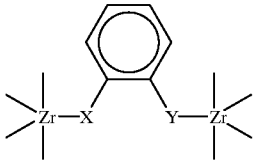

Such complex compounds may more generally be represented by the following formula (35):

(35)

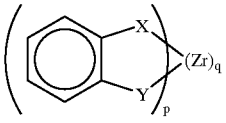

wherein p is an integer of at least 1 and q is an integer of at least 2. From the formula (35), anionic ligands, neutral ligands and counter-cations are omitted from showing.

Preferred classes of aromatic carboxylic acid zirconium salts as a category of the organic zirconium compound used in the present invention may include those represented by the following formulas (36) and (37):

$$(Ar—COO^-)_n Zr^{4\oplus}(4-n)A_1^{\ominus} \text{ or } (2-n/2)A_2^{2\ominus} \quad (36)$$

$$(Ar—COO^-)_n Zr^{4\oplus}(O)(2-n)A_1^{\ominus} \quad (37)$$

In the above formulas (36) and (37), Ar denotes an aromatic residue group capable of having a substituent of alkyl, aryl, aralkyl, cycloalkyl, alkenyl, alkoxy; aryloxy, hydroxyl, acyloxy, alkoxycarbonyl, aryloxycarbonyl, acyl, carboxyl, halogen, nitro, cyano, amino, amido or carbamoyl; $A_1$ denotes a monovalent anion such as halogen, hydroxyl, nitrate or carboxylate; $A_2$ denotes a divalent anion, such as sulfate, hydrogenphosphate or carbonate; and n is 1, 2, 3 or 4. In case of $n \geqq 2$ for each metal salt, $A_1$, $A_2$ and a plurality (n) of acid ions, i.e., aromatic carboxylates and aromatic hydroxycarboxylates may be identical to or different from each other. Further, each metal salt of a formula can be a mixture of different salts having different numbers of n. In order to improve the dispersibility in binder resin and chargeability of the zirconium salt, it is preferred that the aromatic residue group (Ar) comprises benzene ring, naphthalene ring, anthracene ring, or phenanthrene ring; the optional substituent is alkyl, carboxyl, hydroxyl or acyloxy.

Further, preferred sub-classes of the zirconium salt may be represented by the following formulas (38) and (39):

(38)

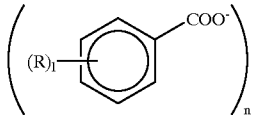

$Zr^{4\oplus}(4-n)A_1^{\ominus}$ or $(2-n/2)A_2^{2\ominus}$ (39)

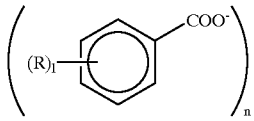

$Zr^{4\oplus}(0)(2-n)A_1^{\ominus}$,

In the above formulae (38) and (39), R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when $l \geqq 2$) of R can be mutually linked to form an alicyclic, aromatic or heterocyclic ring capable of having 1–8 similar R substituent(s); a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–8; and n is 1, 2, 3 or 4. In case of $n \geqq 2$ for each metal salt, the anions $A_1$ and $A_2$ and a plurality of acid ions, i.e., aromatic carboxylates and aromatic hydroxycarboxylates may be identical to or different from each other. Further, each metal salt of a formula can be a mixture of different salts having different numbers of n. In view of improvements in dispersibility in binder resin and chargeability of the zirconium salt, it is preferred that the optional substituent is alkyl, alkenyl, carboxyl, hydroxyl or acyloxy, thus providing the resultant toner with excellent environmental stability and continuous image formation performance.

Further, preferred sub-classes of the zirconium salt may be represented by the following formula (40) or (41):

(40)

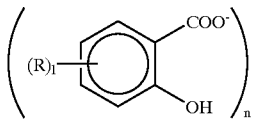

$Zr^{4\oplus}(4-n)A_1^{\ominus}$ or $(2-n/2)A_2^{2\ominus}$

-continued (41)

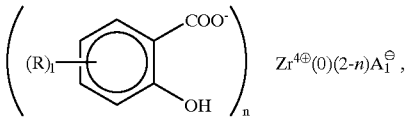

In the above formulas (40) and (41), R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when l≧2) of R can be mutually linked to form an alicyclic, aromatic or heterocyclic ring capable of having 1–8 similar R substituent(s); a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–7; and n is 1, 2, 3 or 4. In case of n≧2 for each metal salt, the anions $A_1$ and $A_2$ and a plurality of acid ions, i.e., aromatic hydroxycarboxylates as acid ions, may be identical to or different from each other, and that each metal salt of a formula can be a mixture of different salts having different numbers of n. In view of improvement in dispersibility in binder resin and chargeability of the zirconium salt, it is preferred that the optional substituent is alkyl, alkenyl, carboxyl, hydroxyl or acyloxy, thus providing the resultant toner with excellent environmental stability and continuous image-forming performance.

The organic zirconium compound used in the present invention may be synthesized by dissolving a zirconium compound, such as zirconium chloride oxide, zirconium sulfate or an organic acid salt of zirconium in a solvent, such as water, alcohol or aqueous alcohol solution, and adding thereto (1) an aromatic carboxylic acid, an aromatic diol or an alkaline metal salt of these or (2) an aromatic carboxylic acid or an aromatic diol and an alkaline agent. The product organic zirconium compound may be purified by recrystallization from, e.g., an aqueous alcohol solution and washing with alcohol. Further, in the case of producing a complex salt, the above-prepared product may be treated with a mineral acid, an alkaline agent, an amine agent, etc., to prepare complex salts having various counter-ions. Thus, it is also possible to obtain an organic zirconium compound usable in the present invention which is a mixture of complex salts having a plurality of counter-ions selected from, e.g., hydrogen ion, alkaline metal ions and ammonium ion.

Hereinbelow, specific examples of the organic zirconium compound used in the present invention are enumerated with their rational formulas. Such organic zirconium compounds can include 2–4 water molecules as ligands but such water molecules are omitted from showing from the following examples. Further, such organic zirconium compound may include plural species of counter-ions but only a major counter-ion (largest in amount) is indicated in the following examples. In the following formulas, tBu— denotes a tertiary butyl group ($CH_3$—$C(CH_3)_2$—), Bu— denotes a normal-butyl group (n—$C_4H_9$—), MeO— denotes a methoxy group ($CH_3O$—), Me— denotes a methyl group ($CH_3$—), and iPr— denotes an iso-propyl group ($(CH_3)_2CH$—).

(42)

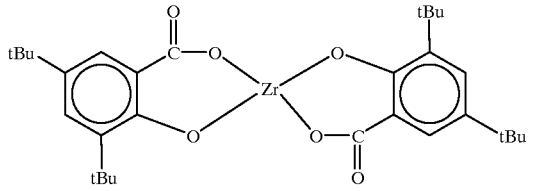

(43)

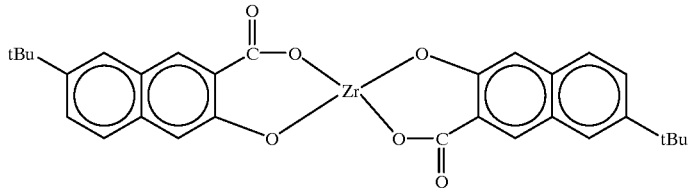

(44)

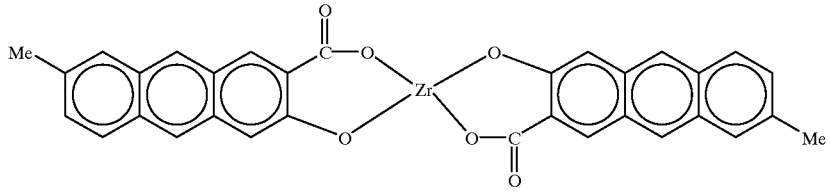

-continued
(45)
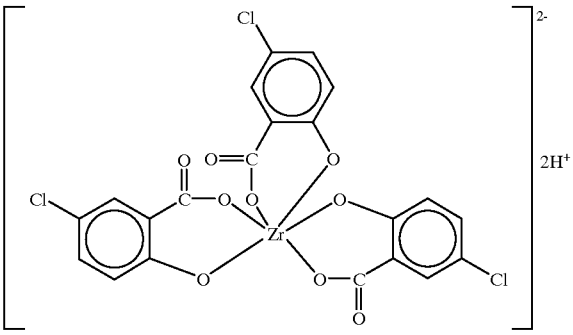
(46)
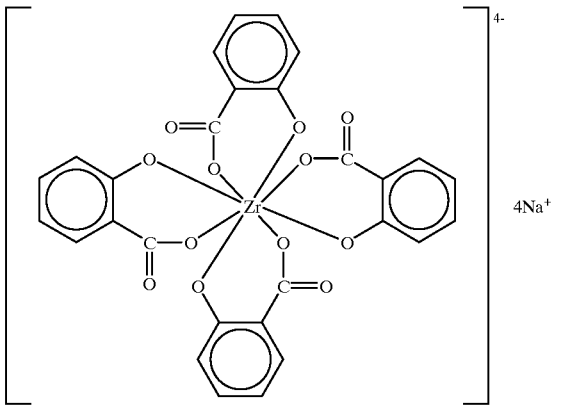
(47)
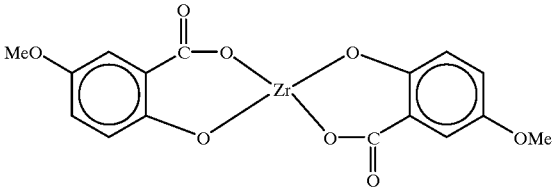
(48)
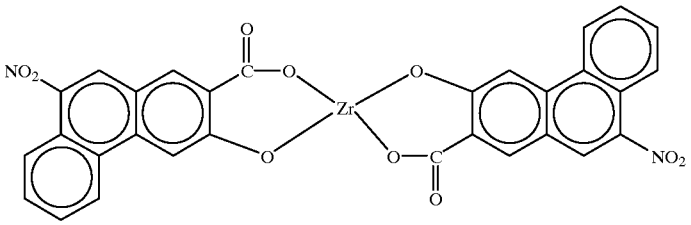
(49)
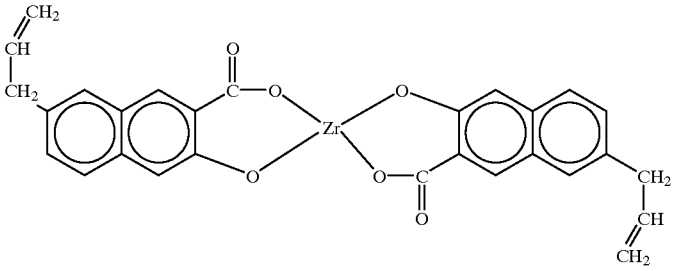
(50)
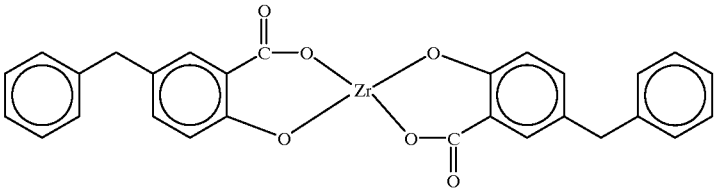
(51)
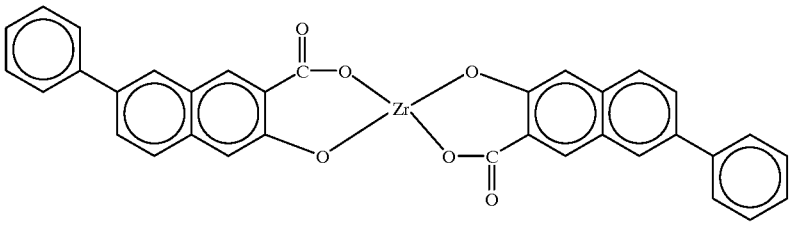

-continued
(52)
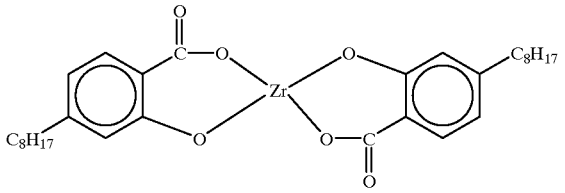
(53)
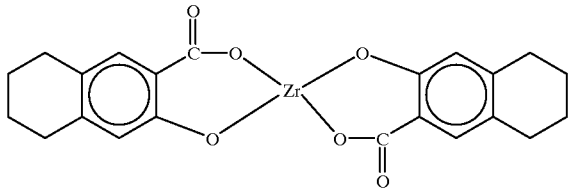
(54)
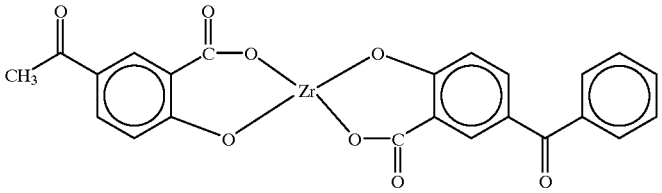
(55)
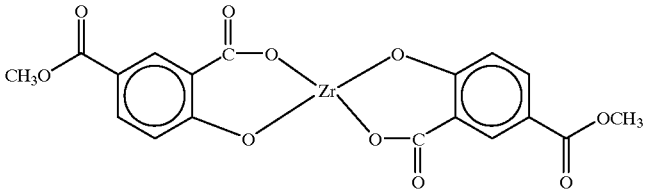
(56)
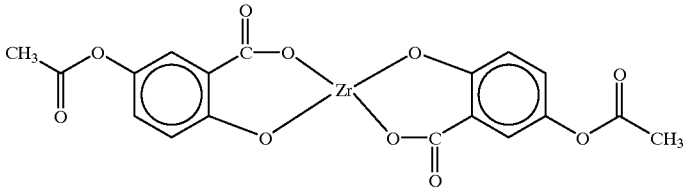
(57)
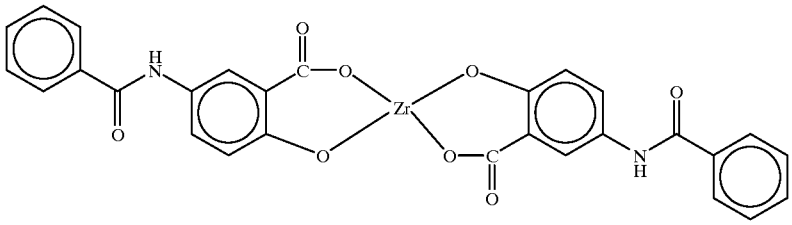
(58)
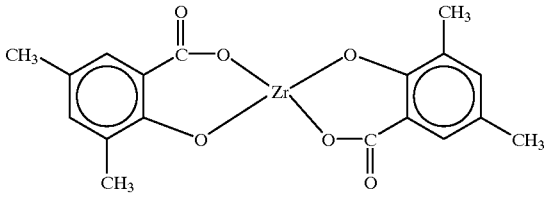
(59)
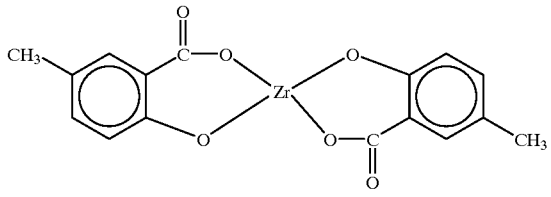
(60)
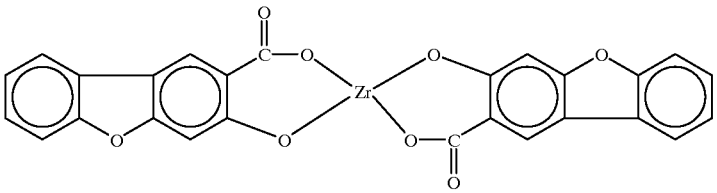

-continued
(61)
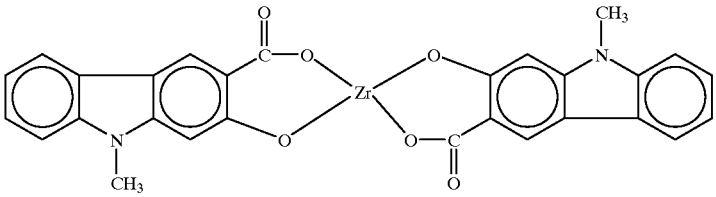
(62)
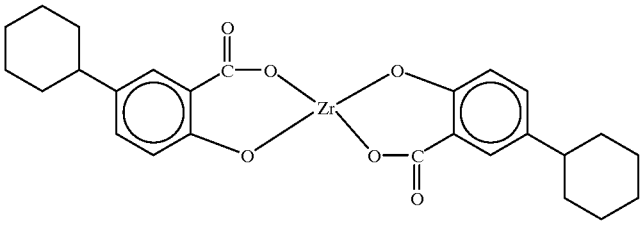
(63)
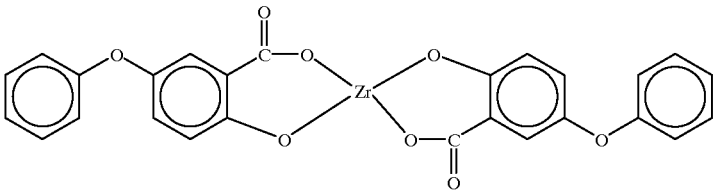
(64)
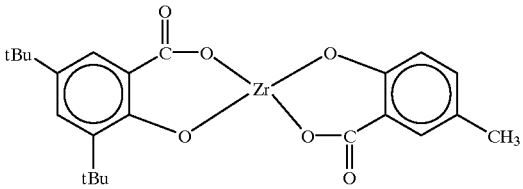
(65)
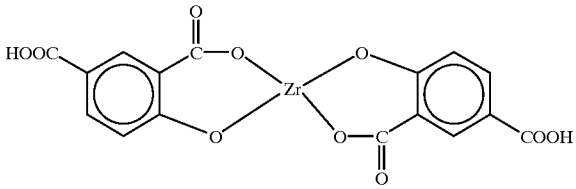
(66)
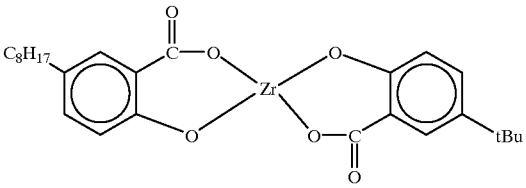
(67)
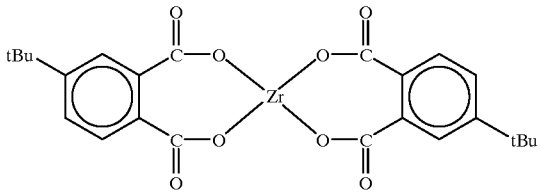
(68)
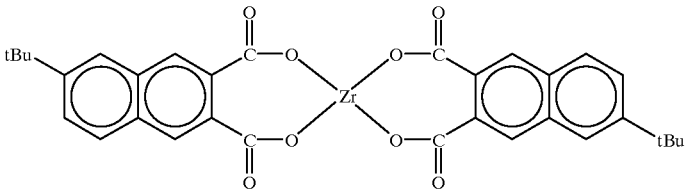
(69)
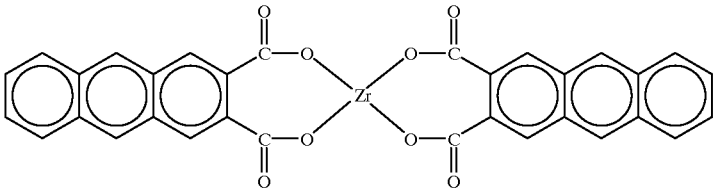

-continued
(70)
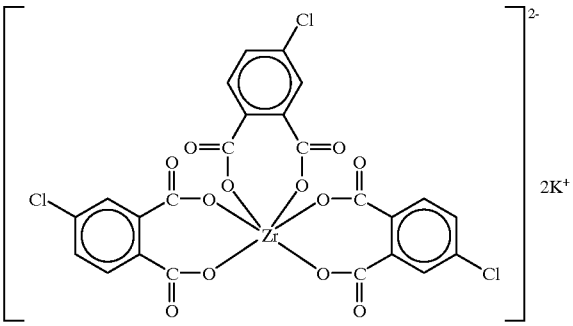
(71)
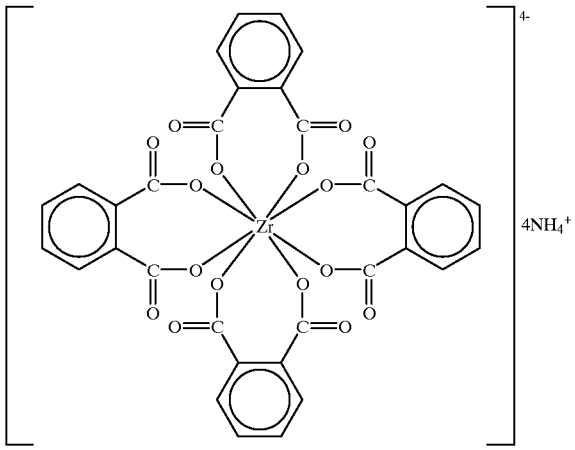
(72)
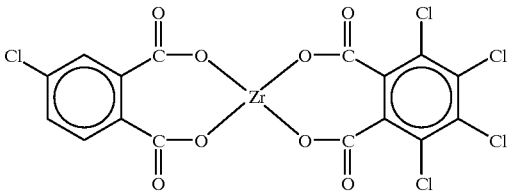
(73)
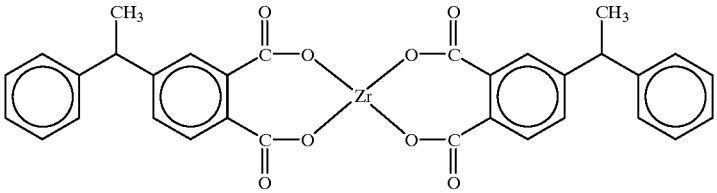
(74)
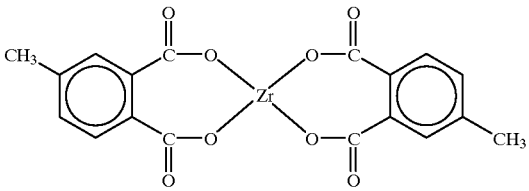
(75)
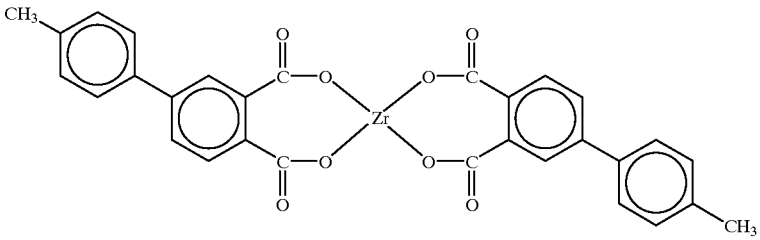

-continued
(76)
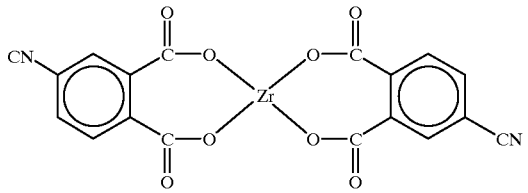
(77)
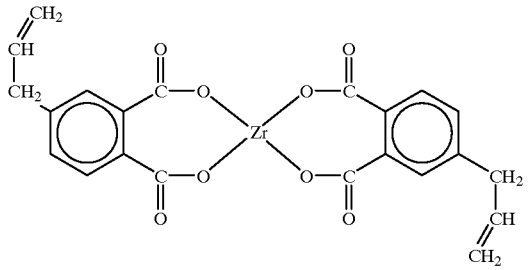
(78)
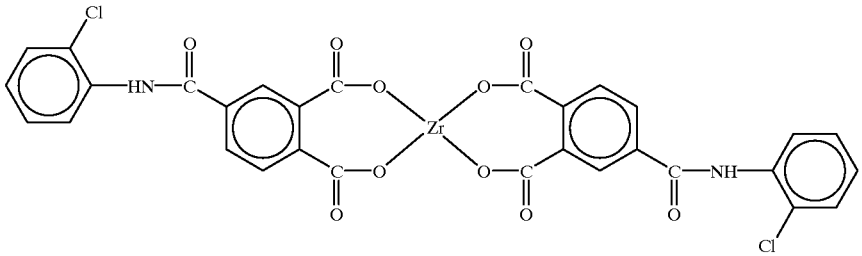
(79)
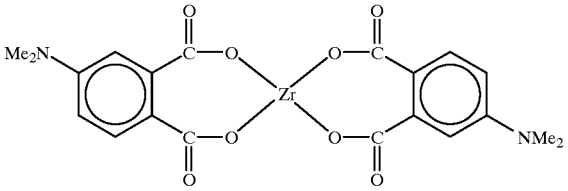
(80)
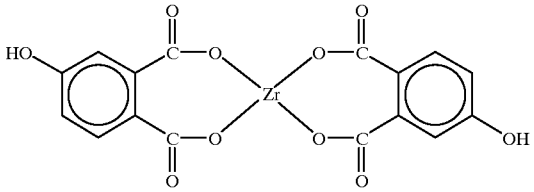
(81)
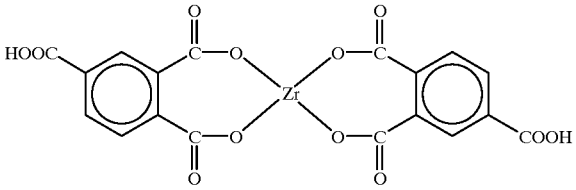
(82)
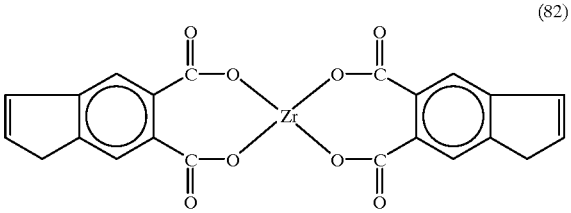
(83)
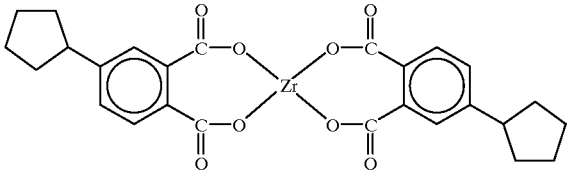
(84)
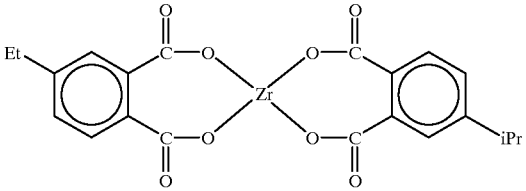
(85)
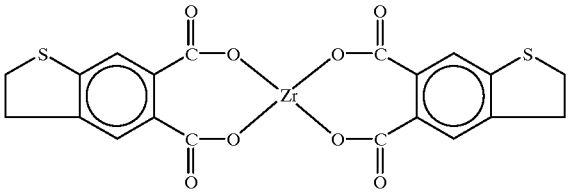
(86)
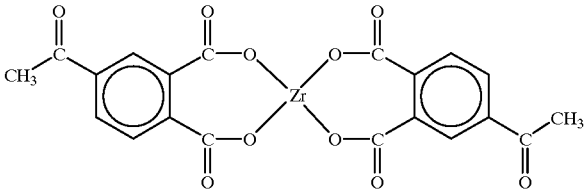
(87)
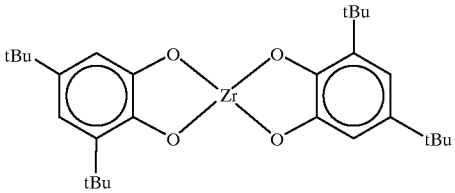
(88)
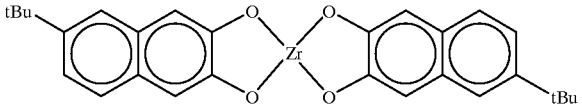

-continued
(89)
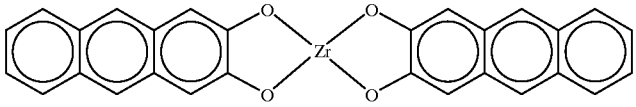
(90)
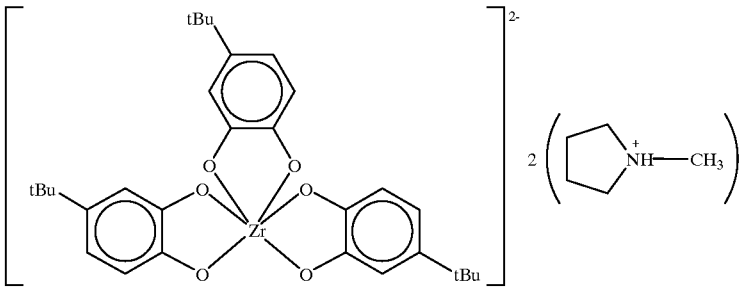
(91)
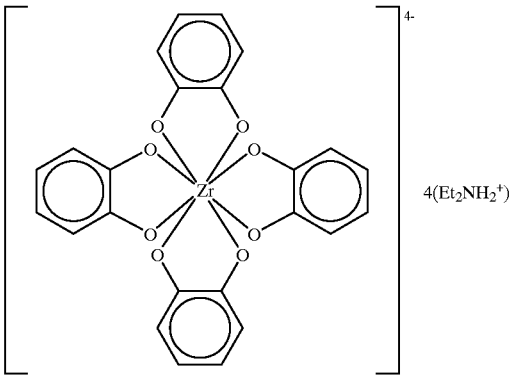
(92)
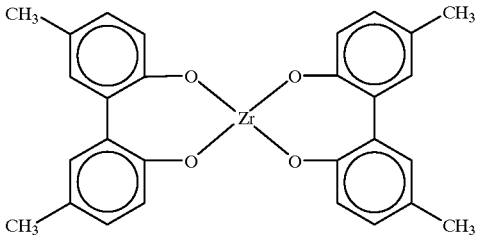
(93)
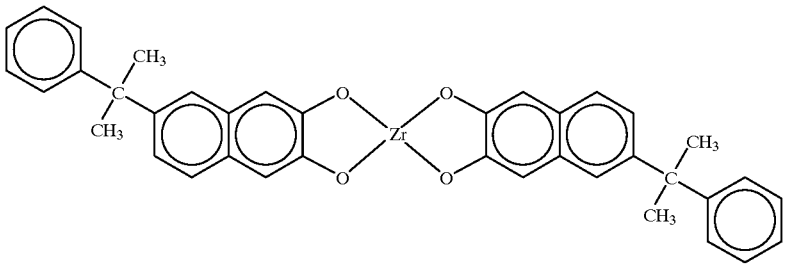
(94)
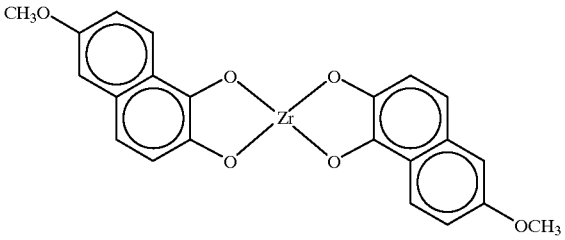
(95)
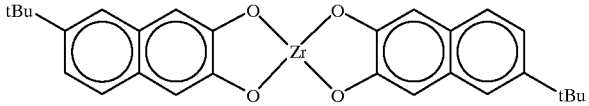
(96)
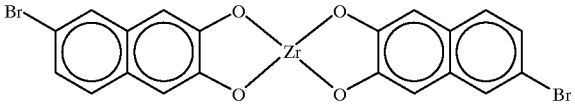
(97)
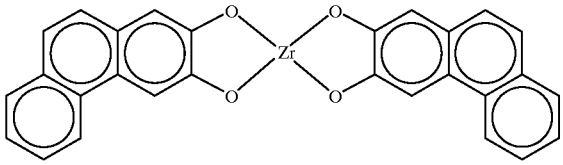

-continued
(98)
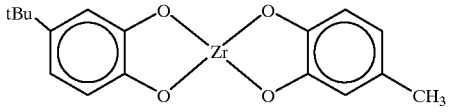
(99)
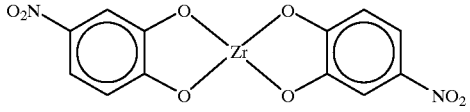
(100)
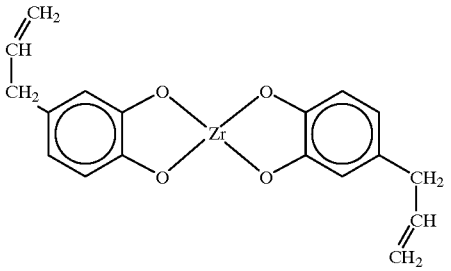
(101)
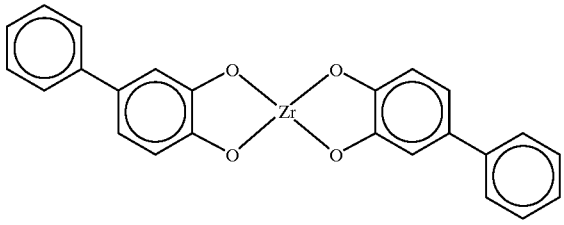
(102)
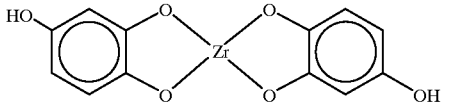
(103)
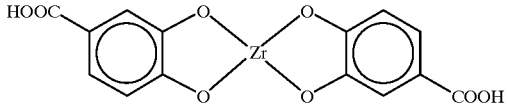
(104)
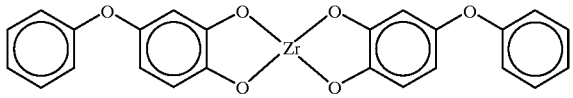
(105)
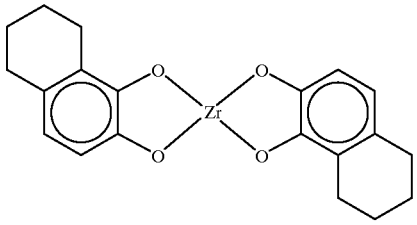
(106)
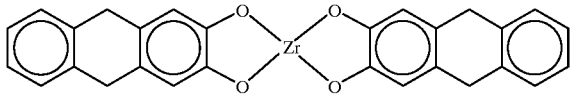
(107)
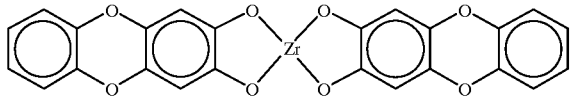
(108)
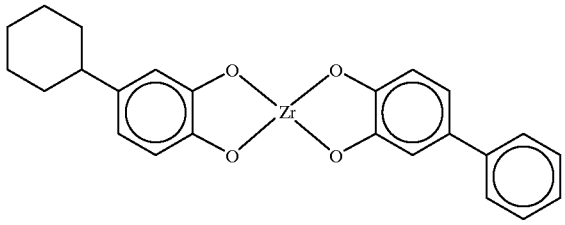
(109)
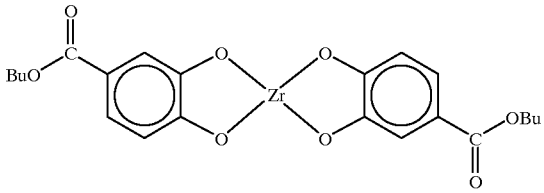
(110)
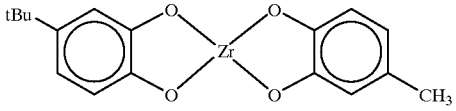
(111)
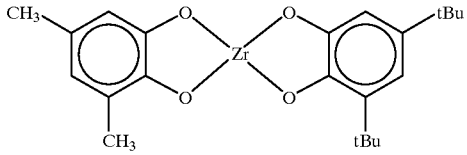
(112)
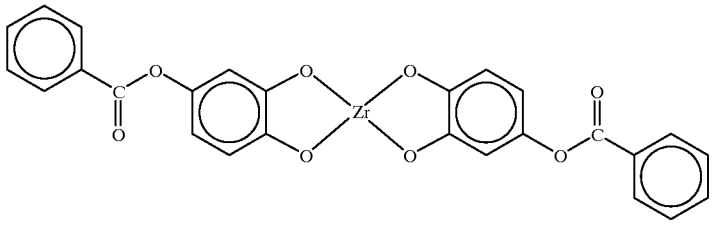

-continued
(113)
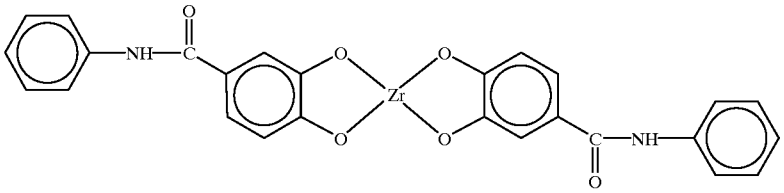
(114)
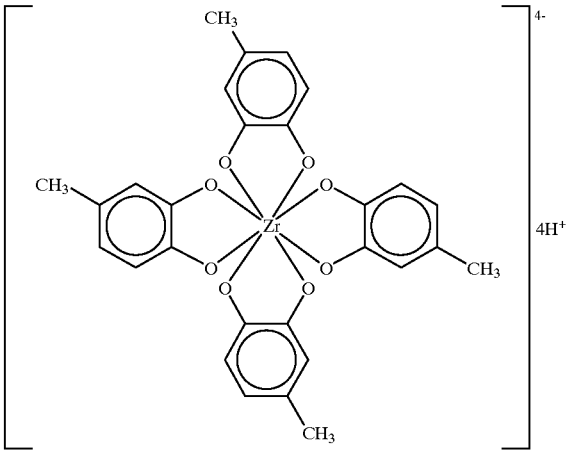
(115)
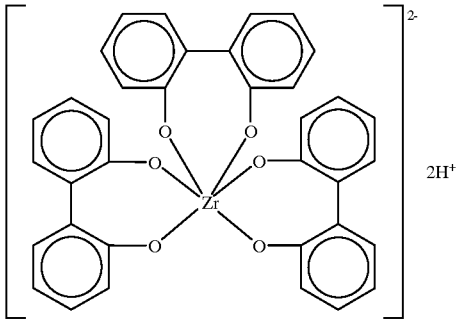
(116)
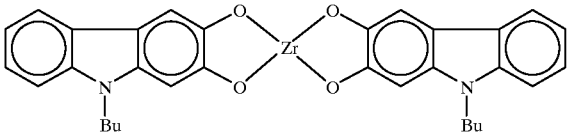
(117)
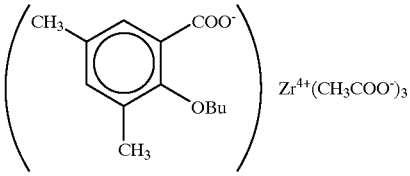
(118)
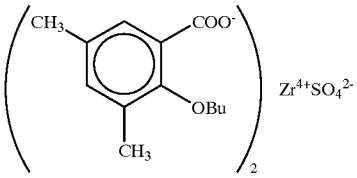
(119)
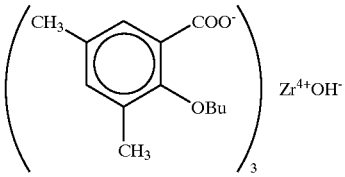
(120)
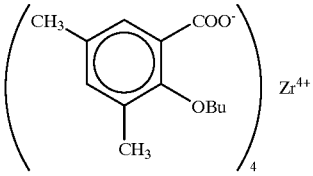
(121)
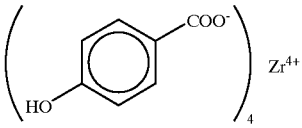
(122)
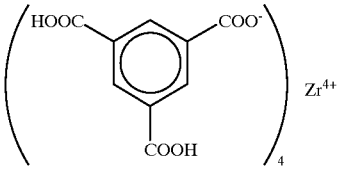
(123)
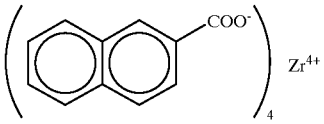

-continued
(124)
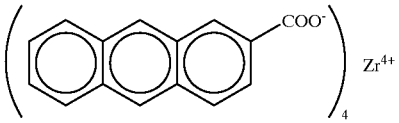
(125)
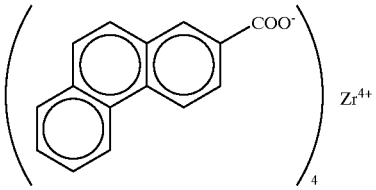
(126)
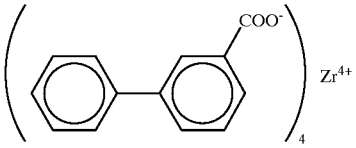
(127)
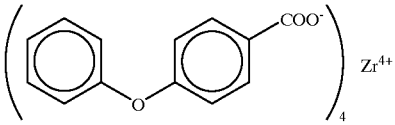
(128)
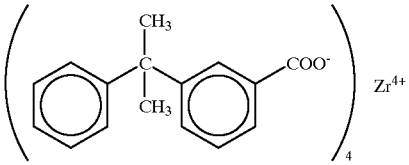
(129)
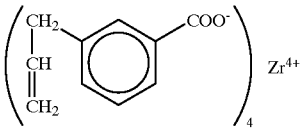
(130)
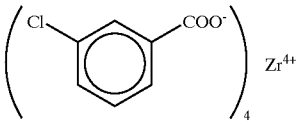
(131)
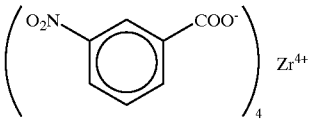
(132)
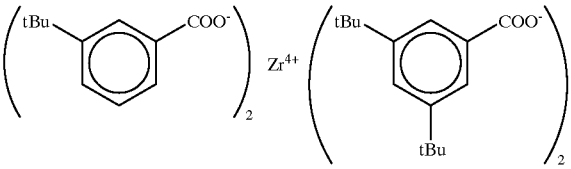
(133)
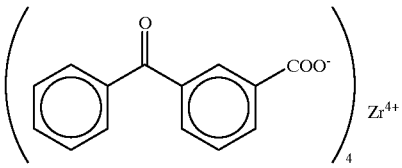
(134)
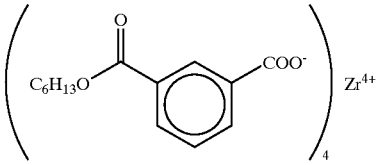
(135)
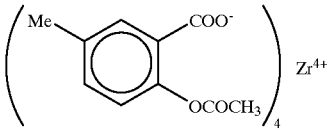
(136)
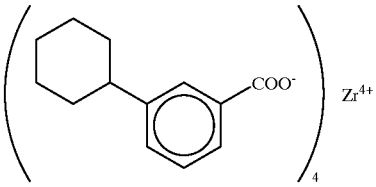
(137)
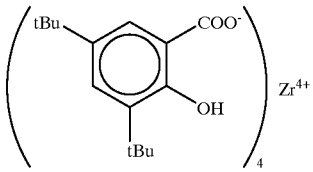
(138)
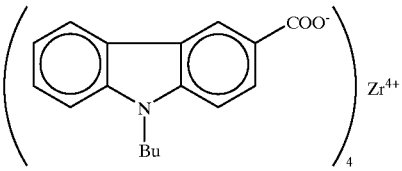
(139)
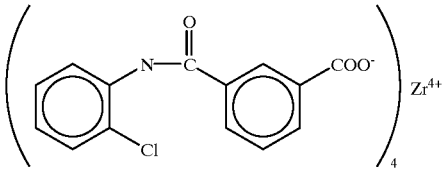

-continued
(140)
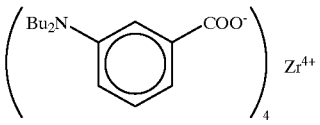
(141)
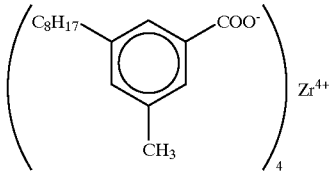
(142)
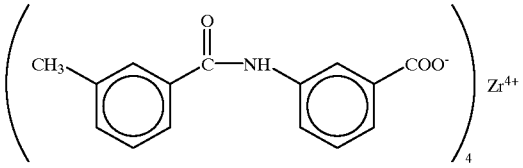
(143)
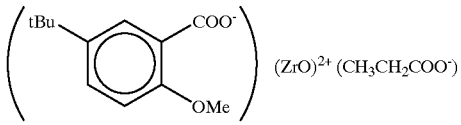
(144)
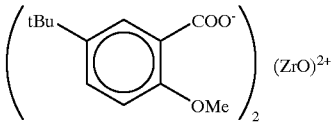
(145)
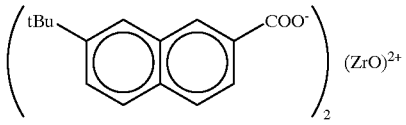
(146)
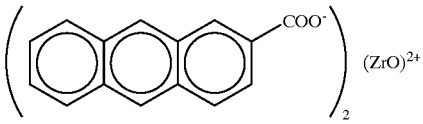
(147)
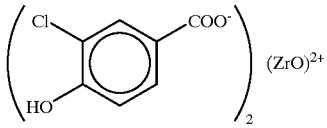
(148)
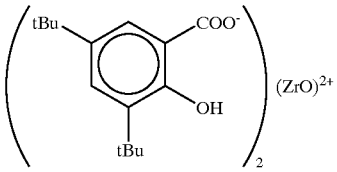
(149)
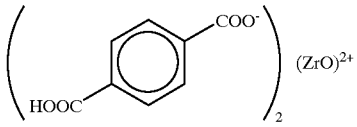
(150)
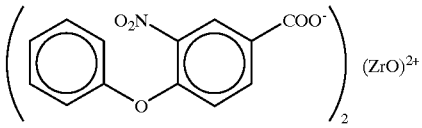
(151)
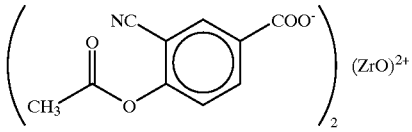
(152)
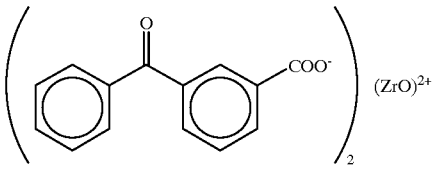
(153)
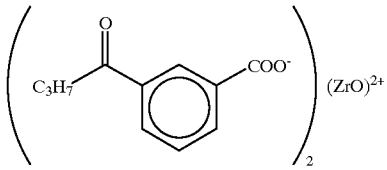
(154)
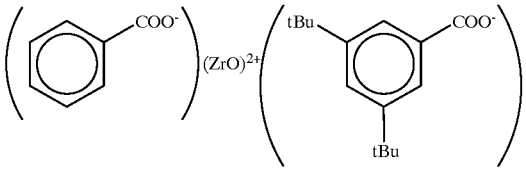
(155)
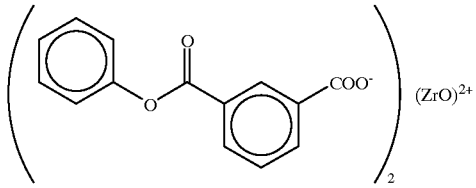
(156)
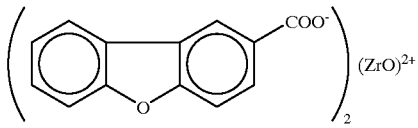
(157)
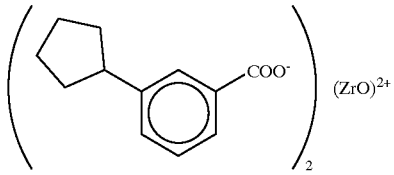

-continued
(158)
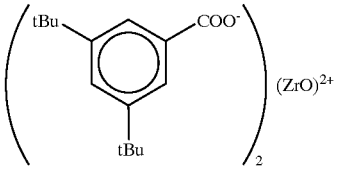
(159)
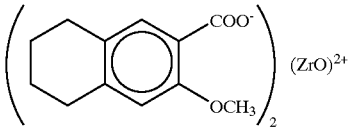
(160)
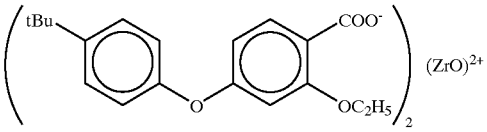
(161)
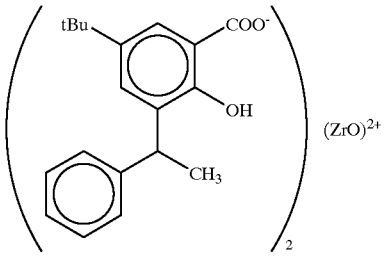
(162)
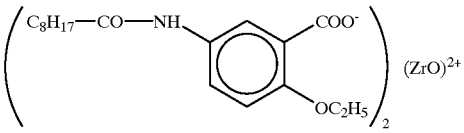
(163)
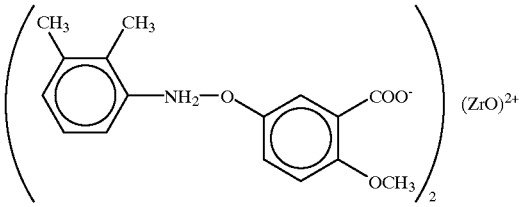
(164)
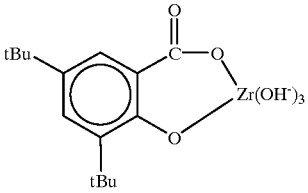
(165)
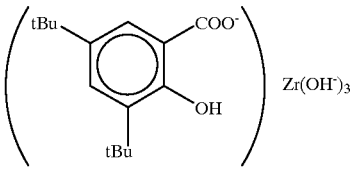
(166)
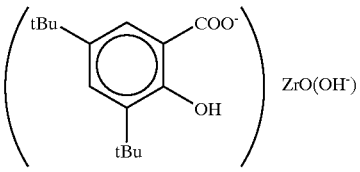
(167)
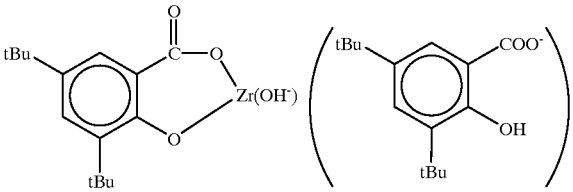
(168)
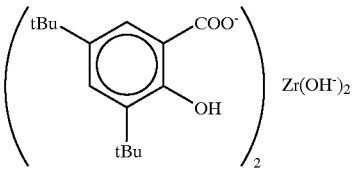
(169)
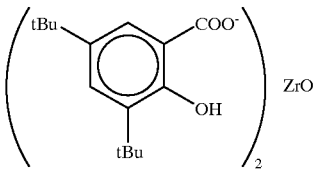
(170)
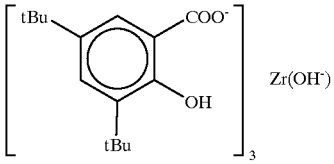
(171)
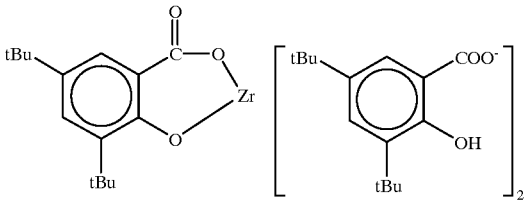

-continued (172)

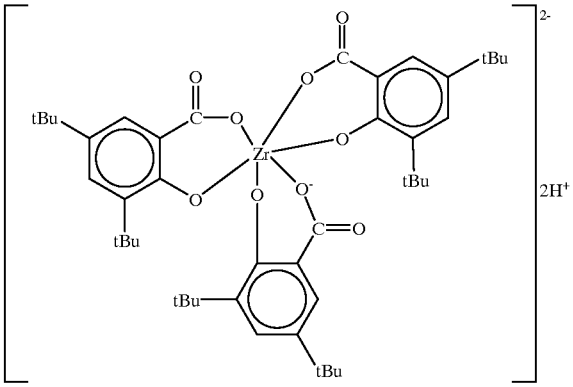

(173)

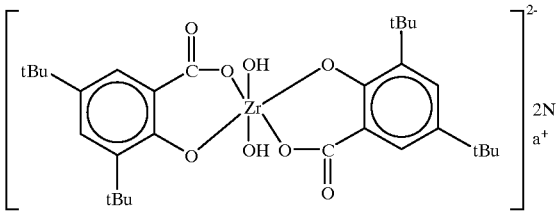

(174)

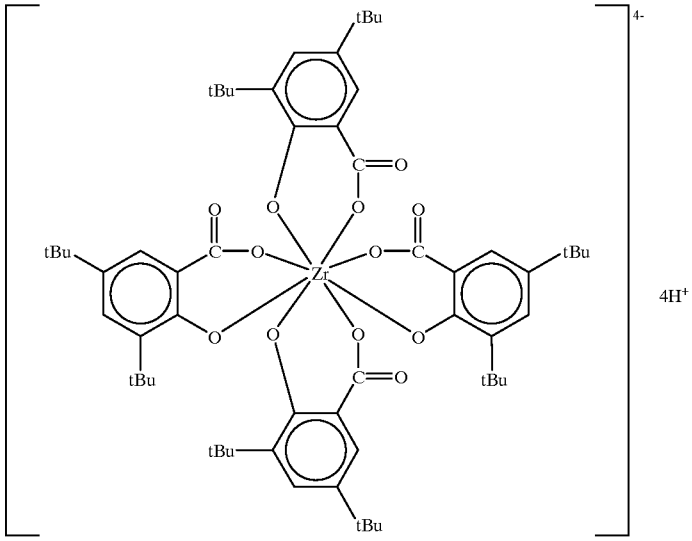

(175)

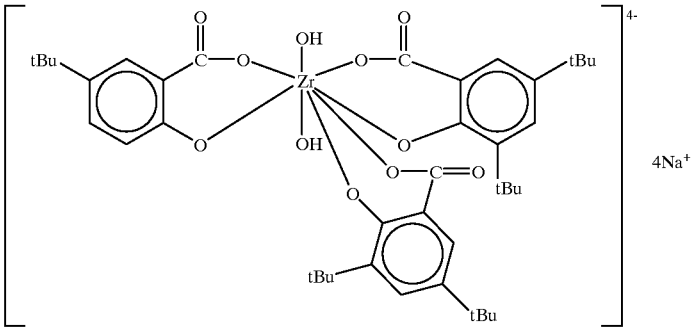

The organic zirconium compound used in the present invention may be incorporated in the toner by adding the organic zirconium compound internally into toner particles (i.e., as a component of toner particles) or externally to toner particles (i.e., as a powder blend with the toner particles). Addition amount of the organic zirconium compound in the case of internal addition is described hereinafter individually for the toners using the polyester binder resin and the hybrid binder resin, respectively. In the case of external addition, the organic zirconium compound may preferably be added in 0.01–5 wt. parts per 100 wt. parts of the binder resin and it is particularly preferred that the organic zirconium compound is mechanochemically attached to the surface of toner particles.

The organic zirconium compound can also be used in combination with a conventional charge control agent as described in the part of the related art herein, such as another organic metal complex, metal salt or chelate compound. Specific examples of such a known charge control agent may include: mono-azo metal complexes, acetylacetone metal complexes, hydroxy-carboxy acid metal complexes, polycarboxylic acid metal complexes, and polyol metal complexes. Other examples may include: carboxylic acid derivatives, such as carboxylic acid metal salts, carboxylic acid anhydrides and carboxylic acid esters; condensation products of aromatic compounds; and phenol derivatives, such as bisphenols and calixarene.

Hereinbelow, the toner according to the present invention including the polyester binder resin used in combination with the organic zirconium compound will be described specifically.

Such a toner containing the above-mentioned organic zirconium compound is less liable to cause a change in charging characteristic even in a high or low humidity environment and can stably retain a developing performance. In addition, in the toner, the organic zirconium compound is well dispersed in the polyester binder resin (having an appropriate acid value) and is not readily liberated from the toner particles, so that the resultant toner is excellent in stability in continuous image formation.

In the toner, crosslinking of polymer chains via a coordination with zirconium of a carboxyl group or/and hydroxyl group of the polyester resin can provide the resultant polyester binder resin with a rubber elasticity. As described hereinafter, the toner containing the organic zirconium compound contains a THF (tetrahydrofuran)-soluble content providing a molecular eight distribution, based on a GPC (gel permeation chromatography) chromatogram, including a component having a high molecular weight of at least $5\times10^5$ at a content of 3–25%, whereby the following advantages (i)–(v) are attained.

(i) The toner not only is excellent in anti-offset performance but also can prevent fixed toner image soiling due to a filler portion attached to the surface of a fixing member even when recycled paper (as a recording or transfer material) containing a large amount of filler since the toner is not gradually deposited thereon.

(ii) The resultant toner particles are made tough, thus providing a stable developing performance in continuous image formation and being less liable to be broken at a cleaning region to stabilize a cleaning performance.

(iii) The toner is improved in flowability to decrease a change in flowability, thus improving and stabilizing developing and cleaning performances.

(iv) The resultant fixed toner image is suppressed in (surface) gloss and image density fluctuation.

(v) The fixed toner image is also made tough, whereby a fixing stability is improved to less soil respective structural members in the cases of double-side copying, multi-copying and the use of a document feeder, thus reducing an occurrence of soiling on the fixed toner image.

In the above-mentioned toner, when a degree of the crosslinking described above is such that the resultant toner contains a THF-insoluble content, the above-described advantages are effectively obtained.

The toner (containing the polyester binder resin and the organic zirconium compound) may preferably contain the THF-insoluble content in an amount of 5–70 wt. %, preferably 10–60 wt. %, based on the polyester binder resin, whereby the above effects are sufficiently achieved.

If the THF-insoluble content exceeds 70 wt. %, a lowering in fixability of the toner is liable to be caused.

The above-mentioned crosslinking structure between zirconium and carboxyl group or/and hydroxyl group is stronger than those between another metal element (e.g., aluminum, chromium, iron or zinc) and carboxyl group or/and hydroxyl group and also is rich in softness since the former crosslinking structure contains the larger zirconium atom and is liable to be connected with oxygen atom.

Accordingly, the resultant toner is not only excellent in releasability and toughness but also less liable to lower the fixability. Further, even when the toner contains the crosslinking components and THF-insoluble content each in an amount identical to those for the case of the combination of another metal element with carboxyl group or/and hydroxyl group, in the toner according to the present invention, the (addition) effects of the crosslinking components and THF-insoluble content become larger, thus being well balanced.

The crosslinking structure containing zirconium can provide a larger effect even in a small amount and less impairs the resultant toner properties even in the case of a larger amount.

It has been found that the above-mentioned toner (containing the polyester binder resin and the organic zirconium compound) exhibits an excellent chargeability-imparting performance in a triboelectric charging step with a developer-carrying member. Specifically, the toner containing the binder resin having an acid value and the organic zirconium compound has been found to provide a larger chargeability even in ia less contact state with the developer-carrying member surface.

The polyester binder resin contained in the toner together with the organic zirconium compound described above may have an acid value of 2–50 mgKOH/g, preferably 5–40 mgKOH/g.

Below 2 mgKOH/g, a fixed image soiling-prevention effect due to the interaction between the polyester binder resin and the organic zirconium compound is not readily achieved. Above 50 mgKOH/g, an image density in a high-humidity environment is liable to be lowered.

The toner of the present invention using the polyester binder resin contains a THF-soluble content providing a GPC chromatogram exhibiting a main peak in a molecular weight range of 3,000–20,000, preferably 4,000–15,000, more preferably 5,000–12,000, and including a component having molecular weights of at least $5\times10^5$ at a content of 3–25%, preferably 5–22%, more preferably 7–20%.

In the molecular-weight distribution of the THF-soluble content based on the GPC, if a main peak is present in a molecular weight range below 3,000 (i.e., there is no main peak in the molecular weight range of 3,000–20,000), the developing performance of the toner is liable to be lowered in a high-humidity environment. Particularly, the image density after standing in the high-humidity environment is liable to be decreased. If the main peak is present in a molecular weight range above 20,000, the low-temperature fixability of the toner is lowered.

In the molecular-weight distribution of the THF-soluble content, if the content of the component having molecular weights of at least $5\times10^5$ is below 3%, the toner deposition on the fixing member surface is liable to occur with an increased amount of a filler in the transfer paper attached to the fixing member surface in continuous image formation, thus being liable to cause toner image soiling. Above 25%, the low-temperature fixability of the toner is lowered.

In order to provide the toner with the above-mentioned content (3–25%) of the component of molecular weights of at least $5\times10^5$ in the THF-soluble content, it is preferred that a polyester resin containing a THF-insoluble content is used as a starting resin for the polyester binder resin and molecular chains of the THF-insoluble content are severed by heating and a shearing force in the kneading step for toner production to provide the high-molecular weight component contained in the THF-soluble content at a content of 3–25%.

In another preferred embodiment, the polyester binder resin comprise a mixture of a first polyester resin containing a large amount of a low-molecular weight component free from the THF-insoluble content and a second polyester resin containing a large amount of a high-molecular weight component containing the THF-insoluble content, thus facilitating adjustment of the resultant molecular-weight distribution.

The first polyester resin may preferably contain no THF-insoluble content, and exhibit a weight-average molecular weight (Mw) of 7,000–$10^5$, a number-average molecular weight (Mn) of 2,000–10,000, and a main peak in a molecular weight range (Mp) of 3,000–13,000, each with respect to the THF-soluble content.

The second polyester resin may preferably contain 10–50 wt. % of the THF-insoluble content, and exhibit an Mw of $3\times10^4$–$5\times10^5$, an Mn of 2,500–15,000 and an Mp of 5,000–15,000, each with respect to the THF-soluble content.

These first and second polyester resins may preferably be used as a starting resin for preparing the polyester binder resin in a mixing ratio (first polyester resin:second polyester resin) of 1:9 to 9:1, more preferably 2:8 to 8:2, by weight.

We have also found that the above-mentioned toner deposition-prevention effect on the filler (liable to be attached to the fixing member when recycled paper is used as transfer (recording) paper in, e.g., the copying machine or printer in continuous image formation) is further improved by providing the toner (containing the polyester binder resin and the organic zirconium compound) with an appropriate contact angle with respect to water.

For this purpose, it is necessary to use a specific wax and control a particle size thereof when dispersed in the toner.

There have been conventionally proposed various toners containing waxes in order to improve a releasability between the toner and a fixing member (e.g., fixing roller) to prevent the offset phenomenon.

However, such toners improved only in the offset performance with the fixing member by the incorporation of waxes are insufficient to enhance the releasability to the filler attached to the fixing member surface.

The toner containing the polyester binder resin and the organic zirconium compound further contains at least one species of a wax.

The wax may preferably have a molecular-weight distribution based on a GPC including an Mp of 300–5,000, more preferably 500–4,500, and an Mw/Mn ratio of 1.1–15.0, more preferably 1.2–10.0. Further, the toner may preferably exhibit a contact angle to water of 95–130 degrees, more preferably 100–127 degrees.

If the contact angle to water of the toner is below 95 deg., the fixed image soiling-prevention effect (due to the filler in a long-term use of recycled paper) becomes insufficient. Above 130 deg., a residual toner left on a photosensitive member (electrostatic image-bearing member) after the transfer of the toner (image) impairs a cleaning property, thus being liable to cause filming and melt-sticking of the toner onto the photosensitive member surface with a long-term use.

If the wax has an Mp below 300 or has an Mw/Mn ratio below 1.1, a particle size thereof dispersed in the toner becomes too small, thus being liable to provide a contact angle of below 95 deg. If the Mp exceeds 5,000 or the Mw/Mn ratio exceeds 15, the dispersed wax particle size becomes too large, thus being liable to provide a contact angle of above 130 deg.

The wax described above may achieve further excellent addition effects when used in a combination of at least two waxes different in Mp and each having an Mw/Mn ratio of at most 10. This combination of plural waxes may preferably be a combination of a wax component exhibiting a plasticizing function to the toner and a wax component exhibiting a releasing function to the toner, and these functions are further enhanced when these wax components are used in combination compared with the cases of using the respective wax components alone.

Specifically, when the polyester binder resin of the toner is plasticized by one of the wax components, the organic zirconium compound is well components, the organic zirconium compound is well dispersed and the releasing effect of the other wax component to the filler attached to the fixing member surface is effectively achieved.

When two waxes (wax components) having different values of Mp but having similar (chemical) structures are selected, a wax (component) having a smaller Mp exhibits the plasticizing function and a wax (component) having a larger Mp exhibits the releasing function. In this case, when the difference in Mp therebetween is in the range of 200–4,500, the above-mentioned function-separation effect is effectively achieved. Below 200, it is difficult to realize the function-separation of the waxes. Above 4,500, function enhancement due to the interaction between the waxes is not readily achieved.

In such a case, at least one of the waxes used may preferably have an Mp of 300–2,000, more preferably 300–1,500, so as to readily exhibit the function-separation effect as mentioned above.

Examples of the wax used in the toner (employing the polyester binder resin) of the present invention may include: aliphatic hydrocarbon waxes, such as low-molecular weight polyethylene, low-molecular weight polypropylene, polyolefin copolymers, polyolefin waxes, microcrystalline wax, paraffin wax, and sasol wax; oxidation products of aliphatic hydrocarbon waxes, such as oxidized polyethylene wax; block copolymers of the above; vegetable waxes, such as candelilla wax, carnauba wax, Japan wax, and "jojoba" wax; animal waxes, such as beeswax, lanolin, and whale wax; mineral waxes, such as ozocerite, ceresine, and petrolatum; waxes consisting principally of aliphatic acid esters, such as montanate ester wax and castor wax; and partially or totally deacidified aliphatic esters, such as deacidified carnauba wax. Further examples of the release agent may include: saturated linear aliphatic acids, such as palmitic acid, stearic acid, montanic acid, and long-chain alkylcarboxylic acid having a further long alkyl chain; unsaturated aliphatic acids, such as brassidic acid, eleostearic acid and parinaric acid; saturated alcohols, such as stearyl alcohol, eicosyl alcohol, behenyl alcohol, carnaubyl alcohol, ceryl alcohol, melissyl alcohol, and long-chain alkyl alcohols having a further long alkyl chain; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, ethylene-bislaurylamide, and hexamethylene-bisstearylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

A further preferred class of waxes may include: polyolefins obtained through radical polymerization of olefins under high pressure; polyolefins obtained by purifying low-molecular weight by-products from high-molecular weight polyolefin polymerization; polyolefins obtained by low-pressure polymerization in the presence of a catalyst, such as Ziegler catalyst or metallocene catalyst; polyolefins polymerized under irradiation with radiation rays, electromagnetic wave or light; low-molecular weight polyolefin formed by thermal decomposition of high-molecular weight polyolefin; paraffin wax, microcrystalline wax, Fischer-Tropsche wax; synthetic hydrocarbon waxes obtained according to, e.g., the Synthol process, the Hydrocol process, and the Arge process; synthetic waxes obtained from mono-carbon compounds; hydrocarbon waxes having a functional group, such as hydroxyl group or carboxyl group; mixtures of a hydrocarbon wax and a hydrocarbon wax having a functional group; and graft-modified waxes obtained by grafting the above waxes with a vinyl monomer, such as styrene, maleic acid ester, acrylate, methacrylate, or maleic anhydride.

It is also preferred to use a wax product having a narrower molecular weight distribution obtained by fractionating the above waxes according to press sweating, solvent method, re-crystallization, vacuum distillation, supercritical gas extraction or melt-crystallization; or a purified product obtained by removing low-molecular weight solid aliphatic acid, low-molecular weight solid alcohol, low-molecular weight solid compound and other impurities.

The wax used in the toner containing the polyester binder resin may also preferably include a compound represented by the following formula (I):

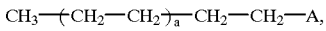

(I)

wherein A represents hydroxyl group or carboxyl group, preferably hydroxyl group, and a is an integer of 20–60, preferably 30–50.

When the wax used in the above-mentioned toner (containing the polyester binder resin) is an acid-modified polyethylene or polypropylene, the acid-modified polyethylene or polypropylene may preferably have an acid value of 1–20 mgKOH/g, preferably 2–15 mgKOH/g, and may preferably be prepared by modifying polyethylene or polypropylene with at least one species of an acid (monomer) selected from the group consisting of maleic acid, maleic acid half-ester and maleic anhydride.

In the case where two species of waxes are used in combination, at least one of which may preferably be the above-mentioned wax.

In the toner using the polyester binder resin, the above-mentioned wax may be added and dispersed in the kneading step and may preferably be added in the polyester (binder) resin production step. Particularly, when the polyester binder resin is a mixture of a polyester resin containing substantially no THF-insoluble content and a polyester resin containing 10–50 wt. % of THF-insoluble content, the wax may desirably be added in the production step of the latter polyester resin (containing 10–50 wt. % of THF-insoluble content), thus further facilitating uniform dispersion of the wax used.

In the case where two or more species of different waxes are contained in the polyester binder resin used in the toner of the present invention, preferred examples of the waxes added in the polyester resin production step may include: a hydrocarbon wax, polyethylene, polypropylene, an acid-modified polypropylene having an acid value of 1–20 mgKOH/g, and an acid-modified polyethylene having an acid value of 1–20 mgKOH/g.

The above waxes may preferably be used in the toner in an amount of 0.2–20 wt. parts, more preferably 0.5–10 wt. parts, per 100 wt. parts of the polyester binder resin.

In the toner using the polyester binder resin according to the present invention, the organic zirconium compound described above may preferably be contained in an amount of 0.1–10 wt. parts, more preferably 0.5–5 wt. parts. Below 0.1 wt. part, crosslinking reaction between zirconium and carboxyl group or/and hydroxyl group becomes insufficient. Above 10 wt. parts, an excessive crosslinking reaction therebetween is liable to occur.

The polyester resin used as a principal component of the polyester binder resin used in the toner of the present invention may be prepared by polycondensation between an alcohol (as an alcohol component) and carboxylic acid, carboxylate or carboxylic anhydride (as an acid component).

Examples of the alcohol component may include: bisphenol derivatives represented by the following formula (a):

(a)

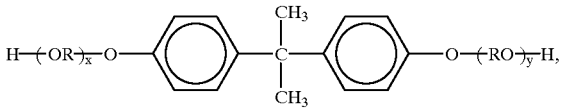

wherein R denotes an ethylene or propylene group, x and y are independently an integer of at least 1 with the proviso that the average of x+y is in the range of 2–7; and diols represented by the following formula (b):

(b)

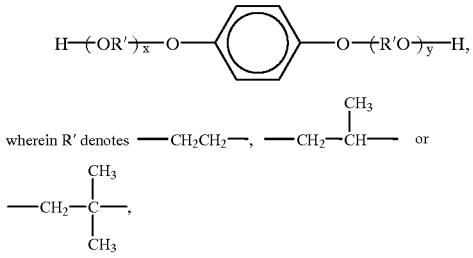

x' and y' are independently 0 or a positive integer with the proviso that the average of x'+y' is in the range of 0–10.

Examples of the bisphenol derivatives of the formula (a) may include: polyoxypropylene (2.2)-2,2-bis(4-hydroxyphenyl)propane; polyoxypropylene (3.3)-2,2-bis(4-hydroxyphenyl)propane; polyoxyethylene (2.0)-2,2-bis(4-hydroxyphenyl)propane; polyoxypropylene (2.0)-polyoxyethylene (2.0)-2,2-bis(4-hydroxyphenyl)-propane; and polyoxypropylene (6)-2,2-bis(4-hydroxyphenyl) propane.

It is also possible to use the bisphenol derivatives of the formula (a) in combination with the above-mentioned diols of the formula (b) or other diols, such as ethylene glycol, diethylene glycol, triethylene glycol, 1,2-propylene glycol, 1,3-propylene glycol, 1,4-butanediol, neopentyl glycol, 1,4-butenediol, 1,5-pentane diol, 1,6-hexanediol, bisphenol A and hydrogenated bisphenol A.

Examples of the acid component may include dicarboxylic acids, such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and alkyl or alkenyl-succinic acids. Examples of the alkyl or alkenyl-succinic acids may include: n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid. As the acid component, it is also possible to use other dicarboxylic acids, and anhydrides and lower alkyl ($C_1$–$C_8$ alkyl) esters of the above dicarboxylic acids.

It is also possible to use a polyhydric alcohol or/and a polybasic acid each having three or more functional groups also functioning as a crosslinking component in combination with the above mentioned alcohol and acid components.

Examples of such polyhydric alcohols may include: sorbitol, 1,2,3,6-hexanetetrol, 1,4-sorbitane, pentaerythritol, dipentaerythritol, tripentaerithritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of polybasic carboxylic acids may include: 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, empole trimer acid, and their anhydrides and lower ($C_1$–$C_8$) alkyl esters; and also tetracarboxylic acids represented by the formula (c):

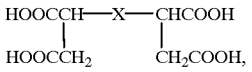

(c)

wherein X is an alkylene or alkenylene group having 1–30 carbon atoms and capable of having one or more side chains of one or more carbon atoms) and anhydride and lower ($C_1$–$C_8$) alkyl esters thereof.

Further, as a component for constituting the polyester resin, it is possible to use monocarboxylic acids represented by the following formula (d) or monohydric alcohols represented by the following formula (e).

(d), wherein R represents a linear, branched or cyclic alkyl or alkenyl group having at least 12 carbon atoms.

(e), wherein R represents a linear, branched, cyclic alkyl or alkenyl group having at least 12 carbon atoms.

The polyester resin may desirably comprise 40–60 mol. %, preferably 45–55 mol. % of alcohol component and 60–40 mol. %, preferably 55–45 mol. % of acid component. The polyfunctional component (having three or more functional groups) may be used in a proportion of 1–60 mol. % of the total components.

Such a polyester resin may be produced through a known polycondensation process.

The polyester resin before contained in the toner of the present invention may preferably have an acid value of 2–50 mgKOH/g and may preferably contain a THF-soluble content which has a molecular-weight distribution according to a GPC exhibiting at least one peak in a molecular weight range of 3,000–20,000, more preferably 5,000–15,000, and including a component having high-molecular weights of at least $5\times10^5$ at a content of 3–25%, more preferably 5–15%.

When a toner is prepared by using such a polyester resin as a binder resin, it is possible to readily control a molecular weight distribution of the resultant toner so as to satisfy the above-mentioned conditions. As a result, the thus-prepared toner is excellent in low-temperature fixability and releasability to a filler attached to a fixing member even in the case of using recycled paper.

Hereinbelow, the toner according to the present invention including the hybrid binder resin used in combination with the organic zirconium compound will be described specifically.

The toner of the present invention using the hybrid binder resin contains a THF-soluble content providing a GPC chromatogram exhibiting a main peak in a molecular weight range of 3,000–20,000, preferably 4,000–15,000, more preferably 5,000–12,000, and including a component having molecular weights of a least $5\times10^5$ at a content of 3–25%, preferably 5–22%, more preferably 7–20%.

In the molecular-weight distribution of the THF-soluble content based on the GPC, if a main peak is present in a molecular weight range below 3,000 (i.e., there is no main peak in the molecular weight range of 3,000–20,000), the developing performance of the toner is liable to be lowered in a high-humidity environment. Particularly, the image density after standing in the high-humidity environment is liable to be decreased. If the main peak is present in a molecular weight range above 20,000, the low-temperature fixability of the toner is lowered.

In the molecular-weight distribution of the THF-soluble content, if the content of the component having molecular weights of at least $5\times10^5$ is below 3%, the toner deposition on the fixing member surface is liable to occur with an increased amount of a filler in the transfer paper attached to the fixing member surface in continuous image formation, thus being liable to cause toner image soiling. Above 25%, the low-temperature fixability of the toner is lowered.

The hybrid binder resin used in the toner may preferably contain 5–70 wt. %, more preferably 10–60 wt. %, further preferably 15–50 wt. %, of a THF-insoluble content.

Below 5 wt. % or above 70 wt. %, it is difficult to keep a wax contained in the toner together with the organic zirconium compound in a suitable dispersion state, thus being liable to cause toner attachment to the fixing member in continuous image formation.

In order to retain a sufficient offset-prevention effect even to the fixing member and/or cleaning member deteriorated with time (year) in continuous image formation as to the toner using the hybrid binder resin (comprising the polyester unit and the vinyl polymer unit), it is necessary to improve a releasability of the toner in terms of a contact angle (of the toner) with respect to water.

According to out study, a toner exhibiting a high contact angle can be prepared by using a (hybrid) binder resin having an acid value, a specific organic metal compound as a crosslinking agent, and a wax having specific peak molecular weight (Mp) and structure in combination.

The toner containing the hybrid binder resin and the organic zirconium compound may preferably exhibit a contact angle to water of 95–130 degrees, more preferably 100–127 degrees, further preferably 105–125 degrees.

Below 95 deg., it is difficult to retain a sufficient offset-prevention effect with respect to the fixing and cleaning members deteriorated in continuous image formation. Above 130 deg., the toner is liable to be accompanied with an inferior developing performance and a poor cleaning performance for residual toner particles on the photosensitive member.

The hybrid resin component contained in the toner of the present invention as the hybrid binder resin is a resin wherein a polyester unit and a vinyl polymer unit are chemically bonded to each other. More specifically, during or after production of the polyester unit from its monomers and the vinyl polymer unit from its monomers, including a carboxyl group-containing monomers, such as (meth) acrylate esters, a portion of the polyester unit and a portion of the vinyl polymer unit are chemically bonded to each other through transesterification. The polyester unit and the vinyl polymer unit may be bonded to each other via a —CO·O— bond or a —CO·O·CO— bond. The hybrid resin component may preferably take a form of a graft polymer comprising the vinyl polymer unit as a trunk polymer and the polyester unit as branch polymer(s) or a block copolymer comprising a block of the polyester unit and a block of the vinyl polymer unit, preferably a graft polymer form.

The polyester unit of the hybrid resin component contains an alcohol component and/or carboxylic acid, so as to control a dispersion of a wax contained in the resultant toner.

The hybrid resin component may be prepared by transesterification between the alcohol component as a monomer for the polyester unit and a (meth)acrylate as a monomer for the vinyl polymer unit.

In the transesterification for producing the hybrid resin component, 10–60 mol. %, preferably 15–50 mol. %, more preferably 20–45 mol. %, of the (meth)acrylate constituting the vinyl polymer component may desirably cause esterification reaction with (a portion of) the polyester unit. When the (meth)acrylate causes esterification reaction with the polyester unit in an amount of below 10 mol. %, the dispersion state of the wax is not readily controlled in some cases. On the other hand, above 60 mol. %, the toner can have a poor low-temperature fixability since the amount of a component having a relatively high molecular weight is increased.

The hybrid resin component may preferably comprise the polyester unit and the vinyl polymer unit in a weight ratio (polyester unit:vinyl polymer unit) of 30:70 to 90:10, more preferably 40:60 to 80:20, further preferably 50:50 to 70:30. If the polyester unit content is below 30 wt. % or above 90 wt. %, it is difficult to provide a suitable interaction between the hybrid resin component and the organic zirconium compound and also to control the wax dispersion state in some cases.

In the toner of the present invention containing the organic zirconium compound and the hybrid binder resin, holding and dispersion of the wax may effectively be improved. This may be attributable to a crosslinking product-forming reaction based on some ionomer or complex formation between the organic zirconium compound and the hybrid resin component.

The hybrid resin component before contained in the toner as the hybrid binder resin may preferably have an acid value of 5–60 mgKOH/g, more preferably 10–50 mgKOH/g, further preferably 15–40 mgKOH/g. Below 5 mgKOH/g, the complex (ionomer)-forming reaction becomes insufficient and above 60 mgKOH/g, the complex-forming reaction proceeds excessively, thus failing to provide the wax with a good dispersion state in either case.

The hybrid binder resin (after contained in the toner) may preferably have an acid value (Av.B) of 2–50 mgKOH/g, more preferably 5–45 mgKOH/g, further preferably 10–40 mgKOH/g. Below 5 mgKOH/g or above 50 mgKOH/g, the resultant toner (containing the organic zirconium compound) is liable to be accompanied with a lowering in image density in continuous image formation.

The hybrid binder resin may preferably contain a chloroform-insoluble content in an amount of 2–60 wt. %, more preferably 5–55 wt. %, further preferably 10–45 wt. %. When the chloroform-insoluble content is below 2 wt. % or above 60 wt. %, the complex-forming reaction is not performed at an appropriate level in some cases.

The hybrid binder resin may preferably contain a chloroform-soluble content having an acid value (Av.S) and a chloroform-insoluble content having an acid value (Av.G) providing a difference therebetween (Av.G–Av.S) of 10–150 mgKOH/g, more preferably 20–130 mgKOH/g, further preferably 30–100 mgKOH/g. Below 10 mgKOH/g, the hybrid binder resin is liable to cause an insufficient complex-forming reaction with the organic zirconium compound and above 150 mgKOH/g, an excessive complex-forming reaction is liable to proceed, thus not readily keeping a dispersion state of the charge control agent at an optimum level. As a result, the charge stability of the toner is liable to be lowered, thus leading to a lowering in image density in continuous image formation.

The toner using the hybrid binder resin and the organic zirconium compound in combination may preferably contain a chloroform-soluble content having an acid value of 10–50 mgKOH/g, more preferably 15–45 mgKOH/g, further preferably 20–40 mgKOH/g. Below 10 mgKOH/g, an insufficient complex-forming reaction (with the organic zirconium compound) is liable to occur. Above 50 mgKOH/g, an excessive complex-forming reaction is liable to occur.

The toner using the hybrid binder resin and the organic zirconium compound in combination may preferably contain the organic zirconium compound in an amount of 0.1–10 wt. parts, more preferably 0.5–10 wt. parts, further preferably 0.5–5 wt. parts, still further preferably 1–8 wt. parts, particularly preferably 1.5–5 wt. parts, per 100 wt. parts of the binder resin. Below 0.1 wt. part, an insufficient complex-forming reaction between the organic zirconium compound and the binder resin is liable to occur. Above 10 wt. parts, an excessive complex-forming reaction is liable to occur. Thus, in either case, it is liable to be difficult to control the wax dispersion state.

A THF-insoluble content contained in the hybrid resin component (before contained in the toner) is an important component for not only imparting an anti-hot (high-temperature) offset performance to the toner but also controlling the wax dispersion state in the kneading step for toner production due to an appropriate melt viscosity of the hybrid resin component given by the THF-insoluble content.

The THF-insoluble content may preferably be contained in the hybrid resin component (before toner production) in an amount of 5–60 wt. %, more preferably 7–55 wt. %, further preferably 10–50 wt. %. Below 5 wt. %, the anti-hot offset performance of the resultant toner is liable to be lowered and the melt viscosity in the kneading step is liable to become too low, thus causing reagglomeration of the wax particles. As a result, it is difficult to control the wax dispersion state in some cases. Above 60 wt. %, the low-temperature offset phenomenon is liable to occur and in the kneading step, components having high and low melt viscosities are liable to be co-present in mixture, thus resulting in a broader wax particle size distribution. As a result, it is also difficult to control the wax dispersion state in some cases.

The wax (component) contained in the toner together with the above-mentioned hybrid binder resin and the organic zirconium compound may preferably have a molecular-weight distribution based on a GPC exhibiting an Mp of 500–5,000 and an Mw/Mn ratio of 1.1–15, more preferably an Mp of 700–4,500 and an Mw/Mn ratio of 1.2–10, further preferably an Mp of 800–4,000 and an Mw/Mn ratio of 1.5–8. If the Mp is below 500 or the Mw/Mn ratio is below 1.1, the particle size of the wax dispersed in toner particles becomes too small. If the Mp is above 5,000 or the Mw/Mn ratio is above 15, the dispersed wax particle size becomes too high. As a result, in either case, an appropriate control of the dispersed wax particle size is not readily performed.

The wax may be used in combination of two or more species.

In this case, the waxes contained in the toner (together with the above-mentioned hybrid binder resin and the organic zirconium compound) may preferably have a molecular-weight distribution based on a GPC exhibiting an Mp of 500–5,000 and an Mw/Mn ratio of 1.2–15, more preferably an Mp of 700–4,500 and an Mw/Mn ratio of 1.5–12, further preferably an Mp of 800–4,000 and an Mw/Mn ratio of 2–10. If the Mp is below 500 or the Mw/Mn ratio is below 1.2, and if the Mp is above 5,000 or the Mw/Mn ratio is above 15, an appropriate control of the dispersed wax particle size is not readily performed.

Preferred examples of the wax contained in the toner using the hybrid binder resin may include hydrocarbon waxes, polyethylene waxes and polypropylene waxes. Specifically, it is preferred to use a hydrocarbon wax obtained by subjecting a mixture gas containing carbon monoxide and hydrogen to the Arge process to form a hydrocarbon mixture and distilling the hydrocarbon mixture to recover a residue or a hydrocarbon wax obtained by hydrogenation of the above-obtained hydrocarbon wax. Fractionation of wax may preferably be performed by the press sweating method, the solvent method, vacuum distillation or fractionating crystallization. Such a fractionated hydrocarbon wax may more preferably be used.

The wax used in the toner using the hybrid binder resin may also preferably include a compound represented by the following formula (I):

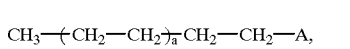

(I)

wherein A represents hydroxyl group or carboxyl group, preferably hydroxyl group, and a is an integer of 20–60, preferably 30–50.

When the wax used in the above-mentioned toner (containing the hybrid binder resin) is an acid-modified polyethylene or polypropylene, the acid-modified polyethylene or polpropylene may preferably have an acid value of 1–20 mgKOH/g, preferably 2–15 mgKOH/g, and may preferably be prepared by modifying polyethylene or polypropylene with at least one species of an acid (monomer) selected from the group consisting of maleic acid, maleic acid half-ester and maleic anhydride.

In the case where two species of waxes are used in combination, at least one of which may preferably be the above-mentioned wax.

In the toner using the hybrid binder resin, a wax having a low Mp (peak molecular weight) and a wax having a high Mp may preferably be used in combination as the wax.

Examples of such a combination of two waxes are shown in Table 1 below.

TABLE 1

| Wax | Low-Mp wax | High-Mp wax |
|---|---|---|
| (1) | Hydrocarbon wax (Mp = 1000, Mw/Mn = 1.5, Tmp*1 = ca. 105° C.) | Polypropylene wax (Mp = 3000, Mw/Mn = 9, Tmp = ca. 130° C.) |
| (2) | Wax of formula (I) (A = OH) (Mp = 800, Mw/Mn = 2.0, Tmp = ca. 110° C.) | Polypropylene wax (Mp = 3000, Mw/Mn = 9, Tmp = ca. 130° C.) |
| (3) | Hydrocarbon wax (Mp = 1000, Mw/Mn = 1.5, Tmp = ca. 105° C.) | Modified PP wax *2 (Mp = 4000, Mw/Mn = 9.5, Tmp = ca. 120° C.) |
| (4) | Wax of formula (I) (A = OH) (Mp = 800, Mw/Mn = 2.0, Tmp = ca. 110° C.) | Modified PP wax *2 (Mp = 4000, Mw/Mn = 9.5, Tmp = ca. 120° C.) |
| (5) | Hydrocarbon wax (Mp = 1000, Mw/Mn = 1.5, Tmp = ca. 105° C.) | Modified PE wax *3 (Mp = 3000, Mw/Mn = 5.5, Tmp = ca. 110° C.) |
| (6) | Wax of formula (I) (A = OH) (Mp = 800, Mw/Mn = 2.0, Tmp = ca. 100° C.) | Modified PE wax *3 (Mp = 3000, Mw/Mn = 5.5, Tmp = ca. 110° C.) |
| (7) | Hydrocarbon wax (Mp = 500, Mw/Mn = 1.3, Tmp = ca. 80° C.) | Polypropylene wax (Mp = 3000, Mw/Mn = 9, Tmp = ca. 130° C.) |

*1: Tmp represents a melting point of the wax.
*2: Modified PP wax: maleic acid-modified polypropylene wax having an acid value of 2 mgKOH/g.
*3: Modified PE wax: maleic acid-modified polyethylene wax having the acid value of 2 mgKOH/g.

The toner according to the present invention containing the wax (in combination with the hybrid binder resin) may preferably provide a DSC heat absorption curve obtained by use of a differential scanning calorimeter (DSC) exhibiting a heat absorption main peak in a temperature region of 70–140° C., more preferably 75–135° C., further preferably 80–130° C.

It is also preferred that the wax-containing toner according to the present invention has, on its DSC heat-absorption curve, a heat-absorption main peak and a heat-absorption sub-peak or shoulder in the above specific temperature region. If the heat absorption main peak is in a temperature region other than the above temperature region, it is difficult to satisfy the low-temperature fixability, anti-offset property and anti-blocking performance in combination in some cases.

In the above-mentioned DSC heat-absorption curve, the heat absorption main peak in the specific temperature range (e.g., 70–140° C.) may desirably be derived from the wax contained in the hybrid binder resin-containing toner.

Hereinbelow, the polyester unit and the vinyl polymer unit constituting the hybrid binder resin (hybrid resin component) will be specifically described.

In the toner according to the present invention using the hybrid binder resin, the polyester unit in the hybrid resin component may preferably comprise at least one species of divalent carboxylic acids of Formulae (f), (g), (h) and (i) below, monovalent carboxylic acids of Formula (j) and monovalent alcohols of Formula (k) below:

Formulae

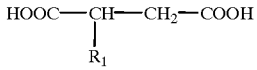

(f)

-continued (g)

$$HOOC-(CH_2)_n-COOH$$

(h)

$$HOOC-\underset{R_3}{\underset{|}{C}}=\underset{R_4}{\underset{|}{C}}-COOH$$

(i)

$$HOOC-\overset{R_5}{\overset{|}{C}}=\underset{R_6}{\underset{|}{C}}-COOH$$

(j)

$$R_7-COOH$$

(k)

$$R_8-OH$$

In the above formulae, $R_1$ denotes a linear, branched or cyclic alkyl or alkenyl group of at least 14 carbon atoms; $R_3$, $R_4$, $R_5$ and $R_6$ independently denote a hydrogen atom or a linear, branched or cyclic alkyl or alkenyl group of at least 3 carbon atoms with the proviso that both cannot be hydrogen atoms at the same time; $R_7$ and $R_8$ denote a linear, branched or cyclic alkyl or alkenyl group of at least 12 carbon atoms; and n is an integer of 12–40.

Specific examples of dicarboxylic acids represented by the above formula (f) may include Compounds (f-1) to (f-6) below:

(f-1)

$$HOOC-\underset{C_{14}H_2(n)}{\underset{|}{CH}}-CH_2-COOH$$

(f-2)

$$HOOC-\underset{C_{18}H_{35}(n)}{\underset{|}{CH}}-CH_2-COOH$$

(f-3)

$$HOOC-\underset{C_{20}H_{39}(n)}{\underset{|}{CH}}-CH_2-COOH$$

(f-4)

$$HOOC-\underset{C_{20}H_{41}(n)}{\underset{|}{CH}}-CH_2-COOH$$

(f-5)

$$HOOC-\underset{C_{24}H_{47}(n)}{\underset{|}{CH}}-CH_2-COOH$$

(f-6)

$$HOOC-\underset{C_{30}H_{59}(n)}{\underset{|}{CH}}-CH_2-COOH$$

Specific examples of dicarboxylic acids represented by the formula (g) may include Compounds (g-1) to (g-4) below:

(g-1)

$$HOOC-(CH_2)_{14}-COOH$$

(g-2)

$$HOOC-(CH_2)_{18}-COOH$$

(g-3)

$$HOOC-(CH_2)_{24}-COOH$$

-continued (g-4)

$$HOOC-(CH_2)_{34}-COOH$$

Specific examples of dicarboxylic acids represented by the formula (h) may include Compounds (h-1) to (h-3) below:

(h-1)

$$HOOC-\underset{H}{\underset{|}{C}}=\underset{C_{12}H_{25}(n)}{\underset{|}{C}}-COOH$$

(h-2)

$$HOOC-\underset{H}{\underset{|}{C}}=\underset{C_{14}H_{29}(n)}{\underset{|}{C}}-COOH$$

(h-3)

$$HOOC-\underset{(n)_{25}H_{12}C}{\underset{|}{C}}=\underset{C_{12}H_{25}(n)}{\underset{|}{C}}-COOH$$

Specific examples of dicarboxylic acids represented by the formula (i) may include Compounds (i-1) and (i-2) below:

(i-1)

$$HOOC-\overset{H}{\overset{|}{C}}=\underset{(n)C_{12}H_{25}}{\underset{|}{C}}-COOH$$

(i-2)

$$HOOC-\overset{(n)C_{12}H_{25}}{\overset{|}{C}}=\underset{(n)C_{12}H_{25}}{\underset{|}{C}}-COOH$$

Specific examples of monocarboxylic acids represented by the formula (j) may include Compounds (j-1) to (j-5) below:

(n) $C_{13}H_{27}$—COOH (j-1)

(n) $C_{15}H_{31}$—COOH (j-2)

(i) $C_{15}H_{31}$—COOH (j-3)

(n) $C_{19}H_{39}$—COOH (j-4)

(n) $C_{23}H_{47}$—COOH (j-5)

Specific examples of monohydric alcohols represented by the formula (k) may include Compounds (k-1) to (k-5) below:

(n) $C_{12}H_{25}$—OH (k-1)

(i) $C_{12}H_{25}$—OH (k-2)

(n) $C_{14}H_{29}$—OH (k-3)

(n) $C_{20}H_{41}$—OH (k-4)

(n) $C_{30}H_{61}$—OH (k-5)

Examples of other monomers for constituting the polyester unit in the hybrid rein component may include the following:

Diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the following formula (l):

(1)

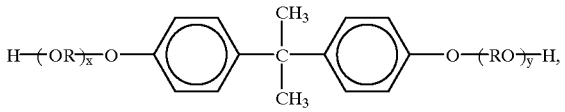

wherein R denotes an ethylene or propylene group, x and y are independently an integer of at least 1 with the proviso that the average of x+y is in the range of 2–10; diols represented by the following formula (m):

(m)

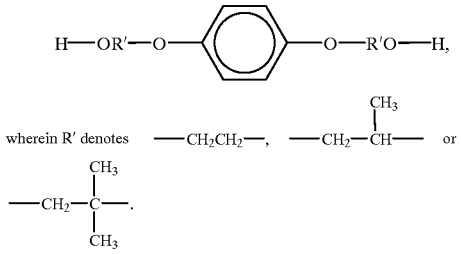

Examples of other acid components may include aromatic dicarboxylic acids, such as phthalic acid, isophthalic acid and terephthalic acid, and their anhydrides; alkyldicarboxylic acids, such as succinic acid, adipic acid, sebacic acid and azelaic acid, and their anhydrides; $C_6$–$C_{12}$ alkyl-substituted succinic acids, and their anhydrides; and unsaturated dicarboxylic acids, such as fumaric acid, maleic acid and citraconic acid, and their anhydrides.

Examples of a vinyl monomer to be used for providing the vinyl polymer unit of the hybrid resin component may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, m-nitrostyrene, o-nitrostyrene, and p-nitrostyrene; ethylenically unsaturated monoolefins, such as ethylene, propylene, butylene, and isobutylene; unsaturated polyenes, such as butadiene and isoprene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; esters of the below-mentioned α,β-unsaturated acids and diesters of the below-mentioned dibasic acids.

Examples of carboxy group-containing monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids.

It is also possible to use a hydroxyl group-containing monomer: inclusive of acrylic or methacrylic acid esters, such as 2-hydroxyethyl acrylate, 2-hydroxyethyl methacrylate and 2-hydroxypropyl methacrylate; 4-(1-hydroxy-1-methylbutyl)styrene, and 4-(1-hydroxy-1-methylhexyl) styrene.

In the hybrid binder resin used in the toner according to the present invention, the polyester unit in the hybrid resin component may have a crosslinked structure formed by using a polybasic carboxylic acid having three or more carboxyl group or its anhydride, or a polyhydric alcohol having three or more hydroxyl groups. Examples of such a polybasic carboxylic acid or anhydride thereof may include: 1,2,4-benzenetricarboxylic acid, 1,2,4-cyclohexanetricarboxylic acid, 1,2,4-naphthalenetricarboxylic acid, pyromellitic acid and anhydrides and lower alkyl esters of these acids. Examples of polyhydric alcohols may include: 1,2,3-propane triol, trimethylolpropane, hexanetriol, and pentaerythritol. It is preferred to use 1,2,4-benzenetricarboxylic acid or its anhydride.

In the hybrid binder resin used in the present invention, the vinyl polymer unit can include a crosslinking structure obtained by using a crosslinking agent monomer having two or more vinyl groups, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nippon Kayaku K.K.). Polyfunctional crosslinking agents, such as pentaerythritol triacrylate, trimethylolethane triacrylate, trimethylolpropane triacrylate, tetramethylolmethane tetraacrylate, oligoester acrylate, and compounds obtained by substituting methacrylate groups for the acrylate groups in the above compounds; triallyl cyanurate and triallyl trimellitate.

Such a crosslinking agent may be used in an amount of 0.01–10 wt. parts, preferably 0.03–5 wt. parts, per 100 wt. parts of the other monomers for constituting the vinyl polymer unit.

Among the crosslinking monomers, aromatic divinyl compounds, particularly divinylbenzene, and diacrylate compounds bonded by a chain including an aromatic group and an ether bond, are particularly preferred in order to provide the resultant toner with good fixability and anti-offset performances.

In the hybrid binder resin, it is preferred that the vinyl polymer unit and/or the polyester unit contain a monomer component reactive with these units. Examples of such a monomer component constituting the polyester unit and reactive with the vinyl polymer unit may include: unsaturated dicarboxylic acids, such as phthalic acid, maleic acid, citraconic acid and itaconic acid, and anhydrides thereof. Examples of such a monomer component constituting the vinyl polymer unit and reactive with the polyester unit may include: carboxyl group-containing or hydroxyl group-containing monomers, and (meth)acrylate esters.

In order to obtain a reaction product between the vinyl polymer unit and polyester unit), it is preferred to effect a polymerization reaction for providing one or both of the vinyl polymer unit and the polyester unit in the presence of a polymer (unit) formed from a monomer mixture including a monomer component reactive with the vinyl polymer unit and the polyester unit as described above.

Examples of polymerization initiators for providing the vinyl polymer unit according to the present invention may include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methylpropane); ketone peroxides, such as methyl ethyl ketone peroxide, acetylacetone peroxide, and cyclohexanone peroxide; 2,2-bis(t-butylperoxy)-butane, t-butylhydroperoxide, cumene hydroperoxide, 1,1,3,3-tetramethylbutyl hydroperoxide, di-tert-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

The hybrid binder resin for constituting the toner according to the present invention may comprise at least the hybrid resin component described above and may preferably be a resin composition comprising the hybrid resin component, a vinyl resin (polymer) and a polyester resin, so as to keep the organic zirconium compound in a good dispersion state in the toner and provide the toner with good developing and fixing performances and effectively prevent the toner from being attached to the fixing member.

Such a resin composition constituting the hybrid binder resin may for example be produced according to the following methods (1)–(6):

(1) The vinyl resin, the polyester resin and the hybrid resin component are separately formed and then blended. The blending may be performed by dissolving or swelling the resins in an organic solvent, such as xylene, followed by distilling-off of the organic solvent. Preferably, a wax may be added in the blending step. The hybrid resin component may be produced as a copolymer (esterified compound) by dissolving or swelling a vinyl resin and a polyester resin prepared separately in advance in a small amount of an organic solvent, followed by addition of an esterification catalyst and an alcohol and heating to effect transesterification.

(2) A vinyl resin is first produced, and in the presence thereof, a polyester resin and hybrid resin component are produced. The hybrid resin component may be produced through a reaction of the vinyl resin (and a vinyl monomer optionally added) with polyester monomers (such as an alcohol and a carboxylic acid) and/or a polyester. Also in this case, an organic solvent may be used as desired. During the production, a wax may preferably be added.

(3) A polyester resin is first produced, and in the presence thereof, a vinyl resin and a hybrid resin component are produced. The hybrid resin component may be produced through the reaction of the polyester resin (and polyester monomers optionally added) with vinyl monomers and/or a vinyl resin in the presence of an esterification catalyst.

(4) A vinyl resin and a polyester resin are first produced, and in the presence of these resins, vinyl monomers and/or polyester monomers (alcohol and carboxylic acid) are added thereto for polymerization and transesterification. Also this instance, an organic solvent may be used as desired. A wax may preferably be added in this step.

(5) A hybrid resin component is first prepared, and then vinyl monomers and/or polyester monomers are added to effect addition polymerization and/or polycondensation. In this instance, the hybrid resin component may be one prepared in the methods of (1)–(4), or may be one produced through a known process. An organic solvent may be added as desired. A wax may preferably be added in this step.

(6) Vinyl monomers and polyester monomers (alcohol and carboxylic acid) are mixed to effect addition polymerization and polycondensation successively to provide a vinyl resin, a polyester resin and a hybrid resin component. An organic solvent may be added as desired. A wax may preferably be added in this step.

In the above methods (1)–(5), the vinyl resin and/or the polyester resin may respectively comprise a plurality of polymers having different molecular weights and crosslinking degrees.

In the above-described methods (1)–(6), the method (3) may be preferred because of easy molecular weight control of the vinyl resin, controllability of formation of the hybrid resin component and control of the wax dispersion state, if the wax is added at that time.

When the toner according to the present invention is formed as a magnetic toner, the toner contains a powdery magnetic material as a colorant.

The magnetic material used in the present invention may comprise an iron oxide, such as magnetite, maghemite, ferrite or a mixture of these containing a different (i.e., non-iron) element.

It is particularly preferred to use a magnetic iron oxide containing at least one element selected from lithium, beryllium, boron, magnesium, aluminum, silicon, phosphorus, sulfur, germanium, titanium, zirconium, tin, lead, zinc, calcium, barium, scandium, vanadium, chromium, manganese, cobalt, copper, nickel, gallium, indium, silver, palladium, gold, platinum, tungsten, molybdenum, niobium, osmium, strontium, yttrium, technetium, ruthenium, rhodium, and bismuth. It is particularly preferred to contain at least one of lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium. It is most preferred to use a magnetic iron oxide containing a different element selected from the group consisting of magnesium, aluminum, silicon, phosphorus and zirconium.

Such a different element may be introduced into the crystal lattice of the iron oxide, incorporated as an oxide thereof in the iron oxide, or present as an oxide or a hydroxide thereon on the surface of the iron oxide particles. In a preferred embodiment, such a different element is contained as an oxide in the iron oxide.

Such a different element may be incorporated into magnetic iron oxide particles at the time of separation of the magnetic iron oxide in the co-presence of the different element under a controlled pH, or alternately may be precipitated on the surface of the magnetic iron oxide particles by controlling the pH or adding a salt of the different element and controlling the pH, respectively after forming the magnetic iron oxide particles.

The magnetic material containing such a different element exhibits a good affinity with and very good dispersibility in the binder resin. Further, the good dispersibility of the magnetic material also improves the dispersibility of the organic zirconium compound used in the present invention, thus allowing full exhibition of the effect of the organic zirconium compound. Thus, the magnetic material functions as a dispersion promoting medium to promote the dispersion of the organic zirconium compound. Further, the magnetic material adsorbs water to promote the chargeability-imparting effect of the organic zirconium compound exhibited in cooperation with water molecules. The effect is further promoted when used in combination with a binder resin having an acid value.

The magnetic material particles may have a uniform particle size distribution, thus providing the resultant toner with a stable chargeability, in cooperation with a good dispersibility of the organic zirconium compound based on the good dispersibility thereof in the binder resin. Further, while the toner particle size has been reduced in recent years, the toner thus obtained according to the present invention may be provided with an enhanced uniformity of chargeability and reduced toner agglomeratability, thus providing an increased image density and improved fog prevention effect, even at a weight-average particle size of 2.5–10 $\mu$m of the toner particles. The effect is particularly remarkable for a toner having a weight-average particle size of 2.5–6 $\mu$m, and a very high-definition image can be produced. A weight-average particle size of at least 2.5 $\mu$m is preferred in order to obtain a sufficient image density. On the other hand, as the toner particle size is reduced, the liberation of the zirconium compound is more liable to occur. However, as the toner according to the present invention is excellent in changing uniformity, the toner is less liable to be affected by sleeve soiling with some isolated zirconium compound.

The toner according to the present invention including the magnetic toner and non-magnetic toner may preferably have a weight-average particle size of 2.5–10 $\mu$m, more preferably 2.5–6.0 $\mu$m.

The above-mentioned different element may preferably be contained in 0.05–10 wt. % based on the iron element in the magnetic iron oxide. The content is more preferably be 0.1–7 wt. %, particularly preferably 0.2–5 wt. %, most preferably 0.3–4 wt. %. Below 0.05 wt. %, the addition effect of the different element is scarce, thus failing to achieve good dispersibility and uniformity of chargeability. Above 10 wt. %, the charge liberation is liable to be excessive to cause insufficient chargeability, thus resulting in a lower image density and an increased fog.

It is preferred that the different element is distributed so that it is richer in the vicinity of the surface of the magnetic iron oxide particles. For example, it is preferred that 20–100% of the different element is present at the surface portion to be dissolved up to an iron dissolution percentage of 20%. The percentage is preferably 25–100%, more preferably 30–100%. By increasing the proportion of the presence at the surface portion, the dispersibility and electrical diffusion effect of the different element can be improved.

The magnetic material, preferably magnetic iron oxide particles containing a different element as described above, may preferably have a number-average particle size of 0.05–1.0 $\mu$m, further preferably 0.1–0.5 $\mu$m. The magnetic material may preferably have a BET specific surface area of 2–40 $m^2/g$, more preferably 4–20 $m^2/g$. The magnetic material particles may have an arbitrary shape without particular restriction. As for magnetic properties, the magnetic material may desirably have a saturation magnetization of 10–200 $Am^2/kg$, preferably 70–100 $Am^2/kg$, a residual magnetization of 1–100 $Am^2/kg$, preferably 2–20 $Am^2/kg$, and a coercive force of 1–30 kA/m, preferably 2–15 kA/m as measured under a magnetic field of 795.8 kA/m. The magnetic material may be added in 20–200 wt. parts per 100 wt. parts of the binder resin.

The toner according to the present invention can contain a colorant comprising any suitable pigment or dye in addition to the above-described magnetic material. For example, suitable examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. Such a pigment may be used in an amount necessary to provide a required optical density of fixed image, e.g., 0.1–20 wt. parts, preferably 0.2–10 wt. parts, per 100 wt. parts of the binder resin. For similar purpose, a dye may be used. There are, for example, azo dyes, anthraquinone dyes, xanthene dyes and methin dyes, which may be added in 0.1–20 wt. parts, preferably 0.3–10 wt. parts, per 100 wt. parts of the binder resin.

In the present invention, it is preferred to externally add inorganic fine powder, e.g., fine powder of inorganic oxides, such as silica, alumina and titanium oxide; carbon black or fine powdery fluorinated carbon.

For example, silica powder, alumina powder or titanium oxide powder may preferably be in such a fine particulate form as to be attached as fine particles onto the surface of the toner particles, thus improving a flowability-imparting performance. More specifically, such an inorganic fine powder may preferably have a number-average particle size of 5–100 nm, more preferably 5–50 nm, and a specific surface area of at least 30 $m^2/g$, particularly 60–400 $m^2/g$, as base powder, and a specific surface area of at least 20 $m^2/g$, particularly 40–300 $m^2/g$, as surface-treated powder, respectively as measured by the BET method according to nitrogen adsorption.

Such inorganic fine powder may be added externally in 0.03–5 wt. parts per 100 wt. parts of toner particles so as to provide an adequate surface coverage rate.

The inorganic fine powder may preferably have a hydrophobicity of at least 30%, more preferably at least 50%, in terms of methanol wettability. The hydrophobicity-imparting agent (or hydrophobizing agent) may preferably comprise a silicon-containing surface-treating agent, such as a silane compound and/or a silicone oil.

For example, it is appropriate to use a silane coupling agent, examples of which may include: alkylalkoxysilanes, such as dimethyldimethoxysilane, trimethylethoxysilane and butyltrimethoxysilane; dimethyldichlorosilane, trimethylchlorosilane, allyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinylchlorosilane, and dimethylvinylchlorosilane.

The toner according to the present invention can also be blended with a carrier to provide a two-component developer. The carrier particles may preferably have a resistivity of $10^6$–$10^{10}$ ohm.cm by controlling the surface roughness and the amount of coating resin.

The carrier particles may be coated with a resin, examples of which may include: styrene-acrylate copolymer, styrene-methacrylate copolymer, acrylate copolymers, methacrylate copolymers, silicone resin, fluorine-containing resin, polyamide resin, ionomer resin, polyphenylene sulfide resin, and mixtures of these.

The carrier core particles may comprise a magnetic material, examples of which may include: iron oxides, such as ferrite, iron-excessive ferrite, magnetite, and γ-iron oxide; metals such as iron cobalt or nickel, and alloys of these metals. Further, the magnetic material may contain an element, such as iron, cobalt, nickel, aluminum, copper, lead, magnesium, tin, zinc, antimony, beryllium, bismuth, calcium, manganese, selenium, titanium, tungsten, or vanadium.

To the toner according to the present invention, it is also possible to add various additives in order to impart various properties. Examples of such additives are as follows:

(1) Abrasive: metal oxides (strontium titanate, cerium oxide, aluminum oxide, magnesium oxide, chromium oxide, etc.), nitrides (silicon nitride, etc.), carbide (silicon carbide, etc.), metal salts (calcium sulfate, barium sulfate, calcium carbonate, etc.), etc.

(2) Lubricants: powder of fluorine-containing resin (polyvinylidene fluoride, polytetrafluoroethylene, etc.), aliphatic acid metal salts (zinc stearate, calcium stearate, etc.), etc.

(3) Charge control particles: particles of metal oxides (tin oxide, titanium oxide, zinc oxide, silicon oxide, aluminum oxide), carbon black, resin particles, etc.

These additives may preferably be added externally in 0.05–10 wt. parts, more preferably 0.1–5 wt. parts per 100 wt. parts of the toner particles. These additives may be added singly or in combination of two or more species.

In the case of a magnetic toner, it is preferred to use fine powder of two or more species of inorganic oxides or metal oxides in order to provide good developing performance in continuous image formation and stable developing performance after standing. In the case of a non-magnetic mono-component developer, it is preferred to use titanium oxide or alumina in order to provide improved flowability and image uniformity.

Toner particles constituting the toner according to the present invention may preferably be formed through a process wherein the above-mentioned toner component materials (including the (polyester or hybrid) binder resin, colorant, organic zirconium oxide, etc.) are sufficiently blended by a blender, such as a ball mill, well kneaded by a hot kneading machine, such as a hot roller kneader or an extruder, and the kneaded product, after cooling for solidification, is mechanically pulverized and classified, to provide toner particles. It is also possible to adopt a polymerization toner production process wherein prescribed materials are mixed with a monomer (mixture) constituting the binder resin to form an emulsion or suspension liquid, followed by polymerization; a microencapsulation for providing so-called microcapsule toner particles wherein prescribed materials are incorporated into either one or both of the core material and the shell material; and a spray drying process wherein constituent materials are dispersed in a binder resin solution, and the resultant dispersion is spray-dried into toner particles. Further, the resultant toner particles may be further blended sufficiently with additive particles, as desired by a blender, such as a Henschel mixer, to provide a toner according to the present invention.

Hereinbelow, some preferred embodiments of the image forming method according to the present invention using the toner of the present invention will be described with reference to drawings.

First, developing means (apparatus) applicable to the image forming method of the present invention will be explained.

Referring to FIG. 1, an electrophotographic photosensitive drum 7 (as an example of an image-bearing member for bearing an electrostatic latent image formed by a known process) is rotated in a direction of arrow B. On the other hand, a developing sleeve 14 (as a developer-carrying member) carrying a toner 10 (as a mono-component developer) supplied from a hopper 9 is rotated in a direction of arrow A to convey a layer of the toner 10 to a developing region D where the developing sleeve 14 and the photosensitive drum 7 oppose each other. In case where the toner 10 is a magnetic toner, a magnet 11 is disposed within the developing sleeve so as to magnetically attract and hold the magnetic toner 10 on the developing sleeve, whereby the toner is subjected to friction with the developing sleeve 14 to acquire a triboelectric charge sufficient for developing an electrostatic latent image on the photosensitive drum 7.

In order to regulate the layer thickness of the magnetic toner 10, a regulating magnetic blade 8 comprising a ferromagnetic metal is hung down from the hopper 9 to confront the developing sleeve 14 with a gap of ca. 200–300 μm from the surface of the developing sleeve 14. Lines of magnetic induction from a magnetic pole $N_1$ of the magnet 11 are concentrated to the blade 8, whereby a thin layer of the toner 10 is formed on the developing sleeve 14. The blade 8 can also comprise a non-magnetic blade. Further, in case where the toner 10 is a non-magnetic toner, the blade 8 may be an elastic blade comprising urethane rubber, silicone rubber, tip blade, etc.

The thin layer thickness of the toner 10 formed on the developing sleeve 14 may preferably be smaller than the minimum gap between the developing sleeve 14 and the photosensitive drum 7 at the developing region D. The image forming method according to the present invention is particularly effective in such a developing apparatus for the scheme wherein an electrostatic latent image is developed with such a thin layer of toner, i.e., a non-contact type developing apparatus. However, the image forming method according to the present invention is also applicable to a developing apparatus wherein the toner layer thickness is larger than the minimum gap between the developing sleeve 14 and the photosensitive drum 7 at the developing region, i.e., a contact-type developing apparatus.

Hereinbelow, further description of a non-contact type developing apparatus will be made.

Referring again to FIG. 1, the developing sleeve 14 is supplied with a developing bias voltage from a power supply 15 so as to cause a jumping of a toner 10 (as a mono-component developer) carried on the developing sleeve 14. In case where the developing bias voltage is a DC voltage, it is preferred that the developing sleeve 14 is supplied with a developing bias voltage which is equal to a voltage given as a difference between a potential of an image region (where the toner 10 is attached to provide a visual image region) and a potential of a background region of an electrostatic latent image. On the other hand, in order to increase the density or gradational characteristic of a developed image, it is also possible to apply an alternating bias voltage to the developing sleeve 14, thereby forming a vibrating field of which the voltage polarity alternates with time at the developing region D. In this case, it is preferred that the developing sleeve 14 is supplied with an alternating bias voltage superposed with a DC voltage component equal to the above-mentioned difference between the image region potential and the background region potential.

Further, in the case of so-called normal development scheme wherein a toner is attached to a higher potential region of an electrostatic latent image having such a higher-potential region and a lower potential region, a toner charged to a polarity opposite to that of the electrostatic latent image is used. On the other hand, in the case of the reversal development scheme wherein a toner is attached to a lower-potential region of an electrostatic latent image, a toner charged to a polarity identical to that of the electrostatic latent image is used. Herein, a higher-potential and a lower-potential refers to potential in terms of absolute value. In any case, the toner 10 is triboelectrically charged due to friction between the toner 10 and the developing sleeve 14 to a polarity appropriate for developing an electrostatic latent image on the photosensitive drum 7.

Figure 2:
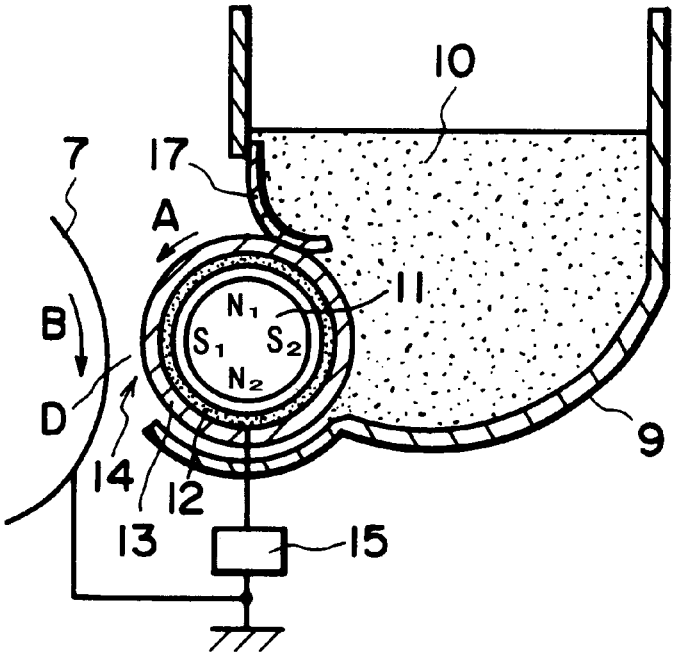

In a developing apparatus shown in FIG. 2, an elastic plate 17 comprising a material having a rubber elasticity, such as urethane rubber or silicone rubber, or a material having a metal elasticity, such as phosphor bronze or stainless steel, is used as a member for regulating the layer thickness of toner 10 on a developing sleeve 14, and the elastic plate 17 is pressed against the developing sleeve 14. In such a developing apparatus, a further thin toner layer can be formed on the developing sleeve 14. The other structure of the developing apparatus shown in FIG. 2 is basically identical to that of the apparatus shown in FIG. 1, and identical numerals in FIG. 2 represent identical members as in FIG. 1.

In the developing apparatus of FIG. 2, the toner is applied by rubbing with the elastic plate 17 onto the developing sleeve 14 to form a toner layer thereon, so that the toner can be provided with a larger triboelectric charge and thus results in a higher image density. This type of developing apparatus is used for a non-magnetic mono-component toner.

Figure 3:
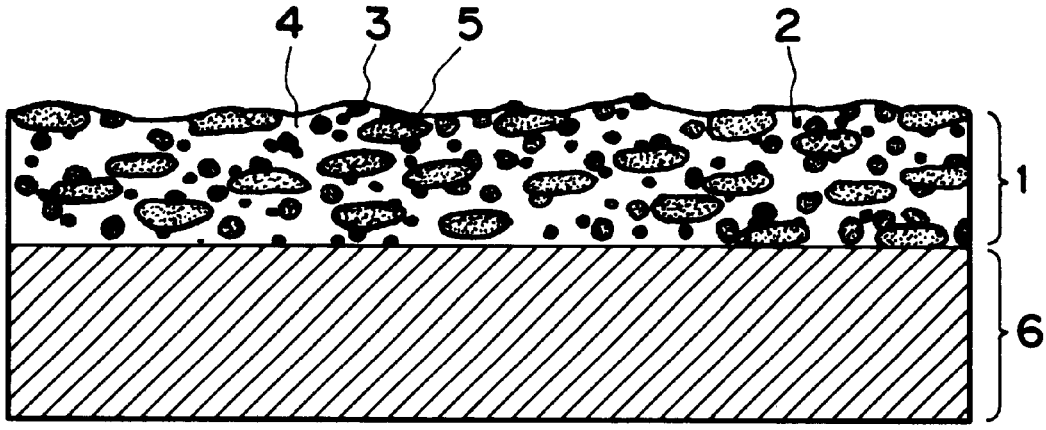
FIG. 3 is a partial sectional illustration of a developer-carrying member applicable to an embodiment of the image forming method according to the invention.

The developing sleeve used as a developer-carrying member in the present invention may preferably comprise a cylindrical substrate and a resinous coating layer coating the substrate surface. An example of such a structure is illustrated in FIG. 3 which is a partial sectional view of the sleeve. Referring to FIG. 3, a cylindrical substrate 6 is coated with a resinous coating layer 1 which may comprise a binder resin 4 and optionally an electroconductive substance 2, a filler 3, a solid lubricant 5, etc., as desired. In case where the electroconductive substance 2 is contained, the resin coating layer 1 becomes electroconductive. This is effective for preventing excessive charge of the toner. In case where the filler 3 is contained, the wearing of the resin coating layer 1 may be suppressed, and the toner charge can be suitably controlled by the charge-imparting ability of the filler 3. Further, in the case where the solid lubricant 5 is contained, the releasability between the toner and the developing sleeve can be improved, thereby preventing melt-sticking of the toner onto the developing sleeve.

In the case of incorporating an electroconductive substance in a resinous coating layer, the resinous coating layer may preferably exhibit a volume resistivity of at most $10^6$ ohm.cm, more preferably at most $10^3$ ohm.cm. In case where the volume resistivity of the resinous coating layer exceeds $10^6$ ohm.cm, the toner is liable to be excessively charged, thus resulting in occurrence of blotches or inferior developing performance.

The resinous coating layer may preferably have a surface roughness Ra in the range of 0.2–3.5 $\mu$m in terms of JIS center-line-average roughness. If Ra is below 0.2 $\mu$m, the toner charge in proximity to the sleeve is liable to be excessive, so that the toner is rather firmly held by the sleeve due to an image force and accordingly a fresh toner portion cannot be charged by the sleeve, thereby lowering the developing performance. If Ra exceeds 3.5 $\mu$m, the toner coating amount on the sleeve is liable to be excessive, so that the toner cannot be sufficiently charged but is ununiformly charged, thereby causing a lowering and irregularity of image density.

The resinous coating layer 1 may comprise materials as follows.

Referring to FIG. 3, examples of the electroconductive substance 2 may include: powder of metals, such as aluminum, copper, nickel and silver; powder of metal oxides, such as antimony oxide, indium oxide and tin oxide; and carbon homologues, such as carbon fiber, carbon black and graphite powder. Among these, carbon black is particularly excellent in electroconductivity and is suitably used because it imparts an electroconductivity when incorporated in a polymeric material at a fairly arbitrarily controlled level by controlling the addition amount thereof. The carbon black may preferably have a number-average particle size of 0.001–1.0 $\mu$m, more preferably 0.01–0.8 $\mu$m. In excess of 1 $\mu$m, it becomes difficult to control the volume resistivity of the resinous coating layer.

The electroconductive substance 2 may preferably be added in 0.1–300 wt. parts, more preferably 1–100 wt. parts, per 100 wt. parts of the binder resin 4 constituting the resinous coating layer 1.

The filler 3 may comprise a negative or positive charge control agent for toners. Examples of other materials constituting the filler 3 may include: inorganic compounds, such as aluminum, asbestos, glass fiber, calcium carbonate, magnesium carbonate, barium carbonate, barium sulfate, silica and calcium silicate; phenolic resin, epoxy resin, melamine resin, silicone resin, polymethyl methacrylate, methacrylate copolymers such as styrene/n-butylmethacrylate/silane terpolymer, styrene-butadiene copolymer, polycaprolactone; nitrogen-containing compounds, such as polycaprolactam, polyvinylpyridine, and polyamide; halogen-containing polymer, such as polyvinylidene fluoride, polyvinyl chloride, polytetrafluoroethylene, polychlorotrifluoroethylene, perfluoroalkoxyltrifluoroethylene, polytetrafluoroalkoxyethylene, hexafluoropropylene-tetrafluoroethylene copolymer, and trifluorochloroethylene-vinyl chloride copolymer; polycarbonate, and polyester. Among these, silica and alumina are preferred because of their hardness and toner chargeability controlling effect.

Such fillers 3 may preferably be used in 0.1–500 wt. part, more preferably 1–200 wt. parts, per 100 wt. parts of the binder resin 4.

The solid lubricant 5 may comprise, e.g., molybdenum disulfide, boron nitride, graphite, fluorinated graphite, silver-niobium selenide, calcium chloride-graphite, or talc. Among these, graphite may preferably be used because it has electroconductivity in addition to lubricity and may exhibit a function of reducing a portion of toner having an excessive charge to provide a level of charge suitable for development.

The solid lubricant 5 may preferably be added in 0.1–300 wt. parts, more preferably 1–150 wt. parts, per 100 wt. parts of the binder resin 4.

The binder resin 4 used for constituting the resinous coating layer 1 optionally together with such electroconductive substance 2, filler 3 or/and solid lubricant 5, added as desired, may comprise a resin, such as phenolic resin, epoxy resin, polyamide resin, polyester resin, polycarbonate resin, polyolefin resin, silicone resin, fluorine-containing resin, styrene resin or acrylic resin. It is particularly preferred to use a thermosetting or photocurable resin.

The developing sleeve may be provided with further preferable performances by surface treatment thereof as by abrasion or polishing for surface smoothing so as to expose the electroconductive substance 2, filler 3 or/and solid lubricant 5 to the sleeve surface at an appropriate level, or/and to smooth the surface for providing a surface with a uniform unevenness. This is particularly effective for suppressing longitudinal streaks appearing in solid black or halftone images or quickly providing a sufficient image density at the startup of image formation, particularly in a high temperature/high humidity environment. The abrasion or polishing treatment may be performed by using an abrasion or polishing stripe of felt or abrasive particle-attached strip for finishing the sleeve surface to a uniform unevenness, whereby the toner coating amount on the sleeve can be uniformized, thereby allowing only toner particles subjected to triboelectrification with the sleeve to be conveyed to the developing region. This is assumed to be the mechanism for the improved performances.

After the surface-smoothing treatment, the coating layer may preferably retain a surface roughness Ra (according to JIS B0601) in the range of 0.2–3.5 $\mu$m, more preferably 0.3–2.5 $\mu$m, for the same reason as described above.

The cylindrical substrate 6 may preferably comprise a cylinder of a non-magnetic metal or a resin. For example, a non-magnetic cylindrical tube, such as that of stainless steel, aluminum or copper. Such a cylindrical tube may be produced through drawing or extrusion, preferably followed by cutting or polishing for improving the size accuracy to a prescribed size accuracy. The cylindrical tube may preferably have a straight allowance of at most 30 $\mu$m, more preferably at most 20 $\mu$m, thus providing good images. The tube may be subjected to sand blasting or abrasion for provide a rough surface with an appropriate degree of surface unevenness. The blasting may be performed by using abrasive particles which may be definitely shaped or indefinitely shaped.

Now, an example of the image forming method according to the present invention, will be described with reference to FIG. 4, which illustrates an image forming apparatus including a contact charging means and a contact transfer means. In the present invention, it is possible to employ an image forming method including a corona charging scheme or/and a corona transfer scheme.

Figure 4:
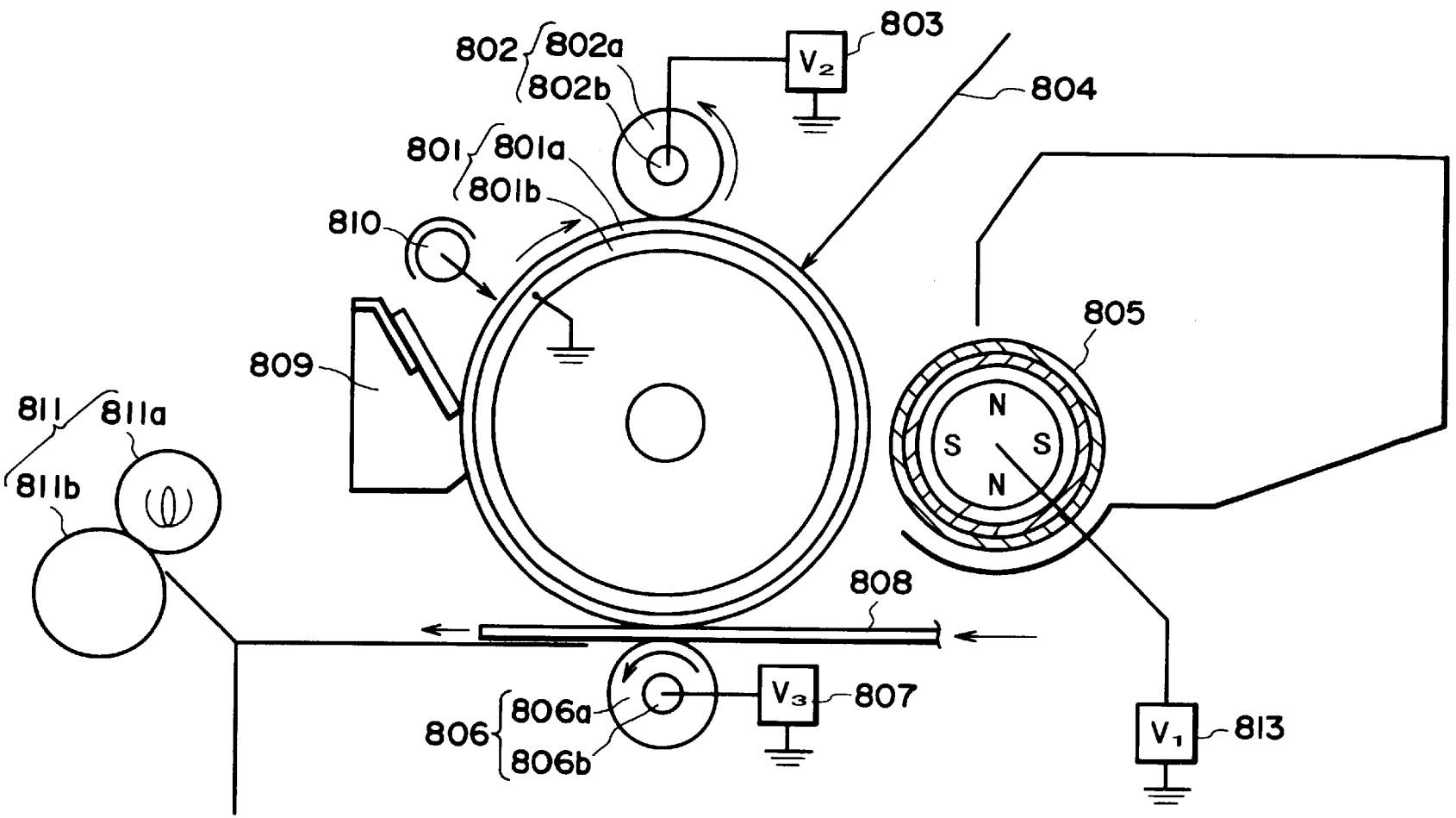
FIG. 4 is an illustration of an image forming apparatus to which the developing method according to the invention is applicable.

Referring to FIG. 4, a rotating drum-type photosensitive member 801 comprising a photoconductor layer 801*a* and an electroconductive substrate 801*b* is rotated at a prescribed peripheral speed (process speed) in a clockwise direction as shown on the drawing. A charging roller 802 comprising an electroconductive elastic layer 802*a* and a core metal 802*b* is supplied with a bias voltage V2 from a charging bias voltage supply 803. The charging roller 802 is pressed against the photosensitive member 801 and is rotated following the rotation of the photosensitive member 801.

Based on the bias voltage applied to the charging roller 802, the surface of the photosensitive member 801 is charged to a prescribed voltage of a prescribed polarity. Then, the charged photosensitive member 801 is exposed to image light 804 to form an electrostatic latent image thereon, which is then visualized as a toner image by a developing means 805. The developing means 805 includes a developing sleeve which is supplied with a bias voltage V1 from a developing bias voltage supply 813.

The toner image formed on the photosensitive member 801 is electrostatically transferred onto a transfer-receiving material 808 under the action of a transfer bias voltage V3 supplied from a voltage supply 807 via a transfer roller 806 (as a contact transfer means for pressing the transfer-receiving material 808 onto the photosensitive member 801) comprising an electroconductive elastic layer 806*a* and a core metal 806*b*. The toner image transferred onto the transfer-receiving material 808 is then fixed onto the transfer-receiving material 808 under application of heat and pressure by a heat-pressure fixing means 811 comprising a heating roller 811*a* and a pressure roller 811*b*. The surface of the photosensitive member 801 is subjected to cleaning for removal of attached soiling substance, such as transfer residual toner by a cleaning device 809 having an elastic cleaning blade abutted against the photosensitive member 801 in a counter direction, and then charge-removed by a charge-removing exposure means 810, to be used for a subsequent cycle of image formation.

While the charging roller 802 has been described as a contact charging means in the above embodiment, the primary charging means can also comprise another contact charging means, such as a charging blade or a charging brush, or alternatively a non-contact corona charging means. However, the contact charging means is less liable to cause the generation of ozone.

Further, while the transfer roller 806 has been described, the transfer means can also comprise another contact transfer means, such as a transfer blade or a transfer belt, or alternatively a non-contact corona transfer means. The contact transfer means is less liable to cause the occurrence of ozone.

Figure 5:
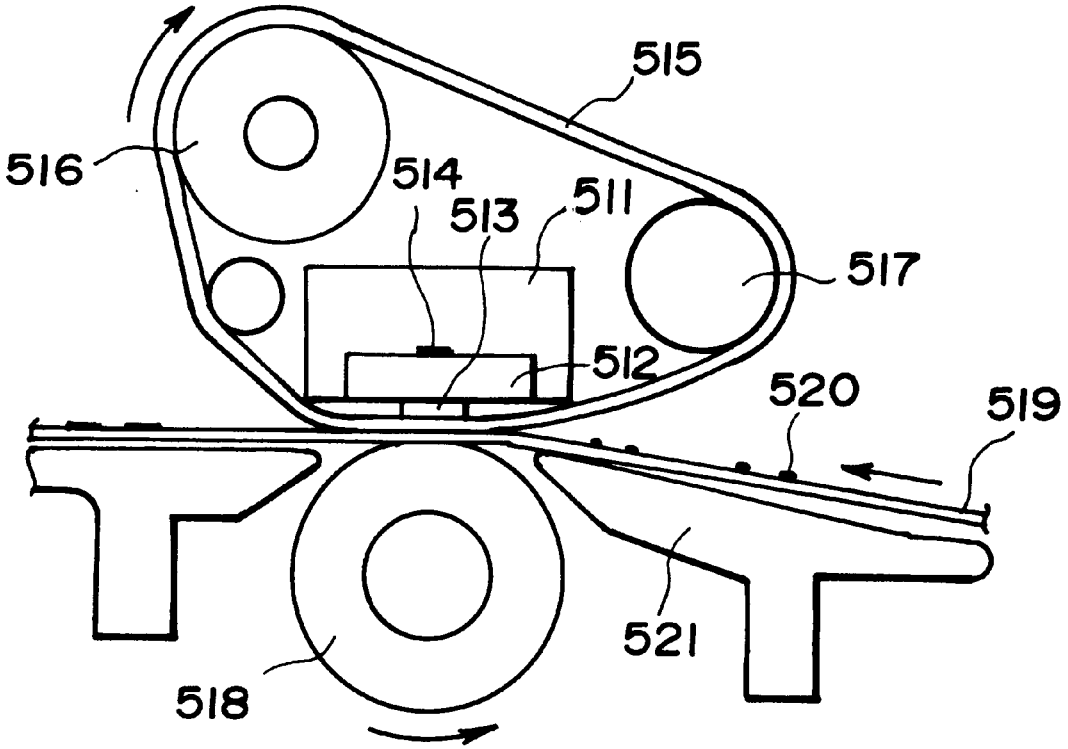
FIG. 5 is a schematic illustration of a film heat-fixing device as another heat-fixing means usable in an embodiment of the image forming method of the present invention.

In the image forming method according to the present invention, the heat-pressure fixing means used in a fixing step can be replaced a film heat-fixing device as another heat-fixing means. FIG. 5 shows an example of such a film heat-fixing device, wherein a transfer material 519 carrying thereon an unfixed toner image is passed between oppositely disposed heating member 511 and pressing member 518 via a fixing film 515 under a prescribed pressure to obtain a fixed toner image.

Referring to FIG. 5, the fixing device includes the heating member 511 which has a heat capacity smaller than that of a conventional hot roller and has a linear heating part exhibiting a maximum temperature of preferably 100–300° C.

The fixing film 515 disposed between the heating member 511 and the pressing member 518 (pressing roller in this case) may preferably comprise a heat-resistant sheet having a thickness of 1–100 μm. The heat-resistant sheet may comprise a sheet of a heat-resistant polymer, such as polyester, PET (polyethylene terephthalate), PFA (tetrafluoroethylene-perfluoroalkyl vinyl ether copolymer), PTFE (polytetrafluoroethylene), polyimide, or polyamide; a sheet of a metal such as aluminum, or a laminate of a metal sheet and a polymer sheet.

The fixing film 515 may preferably have a release layer and/or a low resistivity layer on such a heat-resistant sheet.

An specific embodiment of the fixing device will be described with reference to FIG. 5.

The device includes a low-heat capacity linear heating member 511, which may for example comprise an aluminum substrate 512 of 1.0 mm-t×10 mm-W×240 mm-L, and a resistance material 513 which has been applied in a width of 1.0 mm on the aluminum substrate and is energized from both longitudinal ends. The energization is performed by applying pulses of DC 100 V and a cycle period of 20 msec while changing the pulse widths so as to control the evolved heat energy and provide a desired temperature depending on the output of a temperature sensor 514. The pulse width may range from ca. 0.5 msec to 5 msec. In contact with the heating member 511 thus controlled with respect to the energy and temperature, a fixing film 515 is moved in the direction of an indicated arrow.

The fixing film 515 may for example comprise an endless film including a 20 μm-thick heat-resistant film (of, e.g., polyimide, polyether imide, PES or PFA, provided with a coating of a fluorine-containing-resin such as PTFE or PAF on its image contact side) and a 10 μm-thick coating release layer containing an electroconductive material therein. The total thickness may generally be less than 100 μm, preferably less than 40 μm. The film is driven in the arrow direction under tension between a drive roller 516 and a mating roller 517.

The fixing device further includes a pressure roller 518 having a releasable elastomer layer of, e.g., silicone rubber and pressed against the heating member 511 via the film 515 at a total pressure of 4–20 kg, while moving together with the film 515 in contact therewith. A transfer material 519 carrying an unfixed toner image 520 is guided along an inlet guide 521 to the fixing station to obtain a fixed image by the heating described above.

The above-described embodiment includes a fixing film 515 in the form of an endless belt but the film can also be an elongated sheet driven between a sheet supply axis and a sheet winding axis.

Various properties and/or parameters described herein for characterizing the toner according to the present invention are based on measurement methods described below.

(1) THF-insoluble Content

The THF-insoluble contents of a binder resin in a toner composition and a binder resin as a toner material are measured in the following manner, respectively.

Ca. 0.5–1.0 g of a toner sample is weighed (at $W_1$ g), placed in a cylindrical filter (e.g., "No. 86R", available from Toyo Roshi K.K.) and then subjected to extraction with 200 ml of solvent THF in a Soxhlet's extractor for 10 hours. The solvent is evaporated from the extract solution to leave a THF-soluble resin content, which is dried under vacuum at 100° C. for several hours and then weighed (at $W_2$ g). The weight of components, such as a magnetic material or a pigment, other than the resinous component is determined (at $W_3$ g). THF-insoluble content ($THF_{ins.}$) of the binder resin in the toner sample is calculated as follows:

$$THF_{ins.}\ (\text{wt. }\%)=[W_1-(W_2+W_3)]/(W_1-W_3)\times 100.$$

Alternately, THF-insoluble content ($THF_{ins.}$) may also be determined based on the extraction residue (weighed at $W_4$ g) as follows:

$$THF_{ins.}\ (\text{wt. }\%)=(W_4-W_3)/(W_1-W_3)\times 100.$$

The insoluble content ($THF_{ins.}$) of the binder resin as a toner material (before contained in the toner composition may be determined in the same manner as in the above case based on a binder sample (weighed at $W_5$ g) and the extraction residue (weighed at $W_6$ g) as follows:

$$THF_{ins.}\ (\text{wt. }\%)=(W_6/W_5)\times 100.$$

(2) Acid Value

The acid value of a binder resin as a toner material, a binder resin after contained in a toner or a wax is measured basically according to JIS K-0070 in the following manner.

Apparatus: Automatic potentiometer titration apparatus, "AT-400" (available from Kyoto Denshi K.K.)

Apparatus calibration: Performed by using a mixture solvent of toluene 120 ml and ethanol 30 ml Temperature: 25° C.

Sample: Prepared by adding 1 g of a toner or a wax in 120 ml of toluene, followed by stirring at room temperature (ca. 25° C.) for ca. 10 hours for dissolution, and addition of 30 ml of ethanol.

As a specific preparatory step, from a toner sample, the other components are removed to recover a binder resin (polymer component) as a sample to be used for measurement. Alternatively, the acid value and content of components other than the polymer components (polyester binder resin and hybrid binder resin) are determined in advance. (For example, in the case where a toner sample is directly subjected to measurement, the contributions of the other components, such as a colorant or a magnetic material are determined based on their acid values and contents and subtracted from the measured value of the sample toner to calculate an acid value of the binder resin.) The measurement is performed as follows.

1) Ca. 0.5–2 g (e.g., 1 g) of a sample is accurately weighed to record its weight at W (g).
2) The sample is placed in a 300 ml-beaker and 150 ml of a toluene/ethanol (4/1) mixture solution is added thereto to dissolve the sample.
3) The solution in the beaker is titrated with a 0.1 mol/liter-KOH ethanol solution by using a potentiometric titrator (e.g., automatically titrated by using a potentiometric titrator and an electrically driven burette (e.g., "AT-400" (equipped with Win workstation) and "ABP-410", respectively, available from Kyoto Denshi K.K.).
4) The amount of the KOH solution used for the titration is denoted by S (ml). A blank test is performed in parallel to determine the amount of the KOH solution for the blank titration at B (ml).

5) The acid value of the sample is calculated by the following formula:

$$\text{Acid value (mgKOH/g)}=(S-B)\times f\times 5.61/W,$$

wherein f denotes a factor of the KOH solution.

Further, the acid value of a chloroform-insoluble (gel) content (Av.G) is calculated by the following formula:

$$Av.B=(Av.G-Av.S\times\text{chloroform-soluble content (wt. \%)})/\text{insoluble content (wt. \%)},$$

wherein Av.B represents an acid value of the binder resin after contained in the toner and Av.S represents an acid value of the chloroform-soluble content.

(3) Molecular Weight Distribution

The molecular weight distribution of a binder resin as a toner material or a (THF (tetrahydrofuran)-soluble content in a toner is measured with respect to a molecular weight of at least 1000 according to GPC (gel permeation chromatography) using THF (tetrahydrofuran) as a solvent in the following manner.

In the GPC apparatus, a column is stabilized in a heat chamber at 40° C., tetrahydrofuran (THF) solvent is caused to flow through the column at that temperature at a rate of 1 ml/min., and about 100 $\mu$l of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex GPC KF-801, 802, 803, 804, 805, 806, 807 and 800P; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guardcolumn available from Toso K.K.

Figure 12:
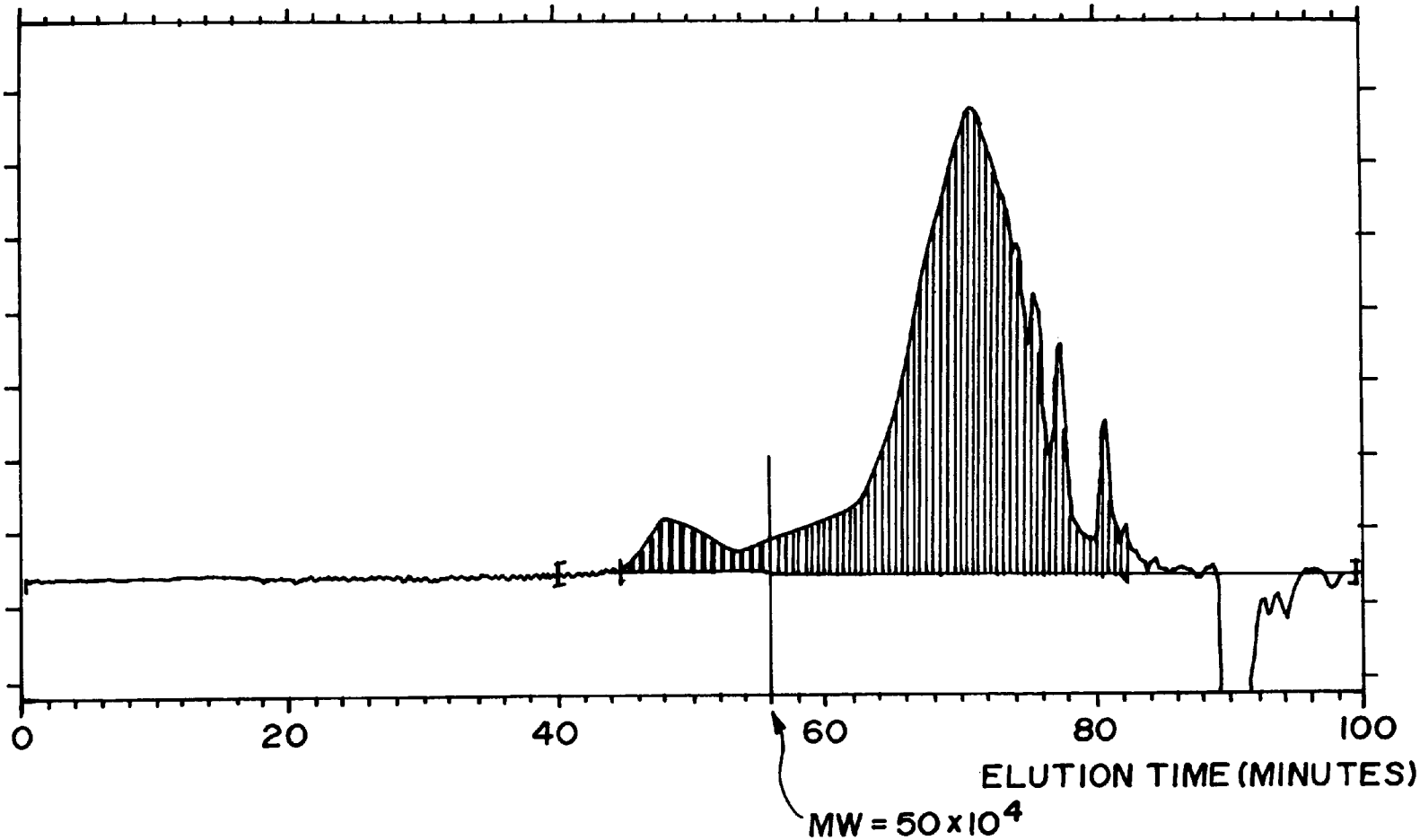
FIG. 12 is a GPC chart of a THF-soluble content of the toner prepared in Example 1 according to the invention.

Based on the thus-obtained molecular weight distribution (e.g., a GPC chart as shown in FIG. 12), a proportion of a component in a molecular region of at least $10^5$ to a component in a molecular region of at least $10^3$ is calculated to determine the former content ($\geqq 10^5$%).

The GPC sample may be prepared as follows.

A resinous sample is placed in THF and left standing for several hours (e.g., 5–6 hours). Then, the mixture is sufficiently shaken until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.2–0.5 $\mu$m (e.g., "Maishoridisk H-25-2", available from Toso K.K.) to recover the filtrate as a GPC sample. The sample concentration is adjusted to provide a resin concentration within the range of 0.5–5 mg/ml.

(4) Chloroform-insoluble Content

The chloroform-insoluble content of a binder resin as a toner material is measured in the following manner.

1 g of a toner sample is accurately weighed, placed in a beaker containing 200 ml of chloroform and dispersed at room temperature under stirring with a magnetic stirrer for ca. 24 hours. The supernatant liquid is carefully filtered out so as not to include the magnetic material etc. by using a filter ("Millipore Filter"; opening=0.15 $\mu$m) through decantation. Thereafter, the chloroform-insoluble content (e.g., the magnetic material) was washed and filtered two times each with ca. 50 ml of chloroform. The resultant filtrate is evaporated to obtain a solid matter, followed by vacuum drying for ca. 24 hours at 40° C. to determine the chloroform-soluble content.

Based on a difference in weight between the total amount of the binder resin component in the toner and the above-determined chloroform-soluble content, the chloroform-insoluble content is determined.

(5) Melting Point of a Wax

Measurement may be performed in the following manner by using a differential scanning calorimeter ("DSC-7", available from Perkin-Elmer Corp.) according to ASTM D3418-82.

A sample in an amount of 2–10 mg, preferably about 5 mg, is accurately weighed.

The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a main absorption peak appears at a temperature ($T_{MHA}$) in the range of 30–200° C. on a DSC curve. The temperature is taken as a wax melting point.

(6) Toner DSC Curve

A toner's DSC curve is taken in the course of temperature increase similarly as in the above-described wax melting point measurement.

(7) Glass Transition Temperature (Tg) of a Binder Resin

Measurement may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed.

The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a main absorption peak appears in the temperature region of 40–100° C.

In this instance, the glass transition temperature (Tg) is determined as a temperature of an intersection between a DSC curve and an intermediate line passing between the base lines obtained before and after the appearance of the absorption peak.

(8) Molecular Weight Distribution of a Wax

The molecular weight (distribution) of a wax may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and recalculated into a distribution corresponding to that of polyethylene using a conversion formula based on the Mark-Houwink viscosity formula.

(9) Contact Angle of a Toner

The contact angle of a toner with respect to water is measured in the following manner.

Apparatus: FACE contact angle measurement apparatus (available from Kyowa Kaimen Kagaku K.K.)

Temperature: 23–25° C.

Humidity: 40–70% RH

A sample is prepared in the following manner. Ca. 10 g of a toner is compressed for 2 min. under a pressure of 200 $kgf/cm^2$ into a cylindrical tablet (diameter=25 mm, thickness=ca. 10 mm). The toner tablet is placed in a glass sample bottle (inner diameter=ca. 27 mm) (e.g., "Snap cup No. 30") and placed on a hot plate heated at 100–120° C. via a Teflon sheet, followed by application of a pressure of 5–10 $kgf/cm^2$ for ca. 5–10 min. After the toner is softened or melted, the glass sample bottle containing the toner is cooled and broken to take out the toner therefrom. The resultant melt-formed toner is successively abraded with abrasive papers (#280, #800 and #1500) to prepare a cylindrical tablet sample (diameter=25 mm, thickness=5 mm) having a measurement surface free from scars or flaws by eye observation.

Measurement of a contact angle is performed five times for the sample by using the above measurement apparatus in combination with deionized water or commercially-available purified water.

Based on the thus-measured five values, an average thereof is taken as a contact angle to water of the sample toner.

(10) Weight-average Particle Size ($D_4$) of a Toner

The weight-average particle size and particle size distribution of a toner may be measured according to the Coulter counter method, e.g., by using Coulter Multisizer II (available from Coulter Electronics Inc.) together with an electrolytic solution comprising a ca. 1% NaCl aqueous solution which may be prepared by dissolving a reagent-grade sodium chloride or commercially available as "ISOTON-II" (from Counter Scientific Japan). For measurement, into 100 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the above-mentioned apparatus equipped with a 100 μm-aperture. The volume and number of toner particles having particle sizes of 2.00 μm or larger are measured for respective channels to calculate a volume-basis distribution and a number-basis distribution of the toner. From the volume-basis distribution, a weight-average particle size ($D_4$) of the toner is calculated by using a central value as a representative for each channel.

The channels used include 13 channels of 2.00–2.52 μm; 2.52–3.17 μm; 3.17–4.00 μm; 4.00–5.04 μm; 5.04–6.35 μm; 6.35–8.00 μm; 8.00–10.08 μm, 10.08–12.70 μm; 12.70–16.00 μm; 16.00–20.20 μm; 20.20–25.40 μm; 25.40–32.00 μm: and 32.00–40.30 μm.

(11) Determination of a Polyester Unit in a Hybrid Binder Resin According to $^1$H-NMR (nuclear magnetic resonance) and $^{13}$C-NMR The respective monomer unit contents in a resinous sample are determined at mol ratios according to $^1$H-NMR and $^{13}$C-NMR and are used for calculation together with the molecular weights of the respective monomers to determine the contents of polyester resin components in weight percent while ignoring the amount of water removed during esterification.

(Measurement of $^1$H-NMR spectrum)

Apparatus: FT NMR apparatus "JNM-EX400" available from Nippon Denshi K.K.

Frequency: 400 MHz

Pulse condition: 5.0 μsec

Data points: 32768

Frequency range: 10500 Hz

Integration times: 10000 times

Temperature: 60° C.

Sample: For preparation, a resinous sample in an amount of 50 mg is placed in a 5 mm-dia. sample tube and $CDCl_3$ is added as a solvent for dissolution at 60° C. in a thermostat vessel (Measurement of $^{13}$C-NMR spectrum)

Apparatus: FT NMR apparatus "JNM-EX400" available from Nippon Denshi K.K.

Frequency: 400 MHz

Pulse condition: 5.0 μsec

Data points: 32768

Delay time: 25 sec.

Frequency range: 10500 Hz

Integration times: 16 times

Temperature: 40° C.

Sample: For preparation, a resinous sample in an amount of 200 mg is placed in a 5 mm-dia. sample tube and $CDCl_3$ (containing 0.05% of TMS) is added as a solvent for dissolution at 40° C. in a thermostat vessel.

A specific example of determination of polyester resin content in ethyl acetate-insoluble content and -soluble content of a sample according to $^1$H-NMR and $^{13}$C-NMR will be described below with reference to FIGS. 6–11.

Figure 8:
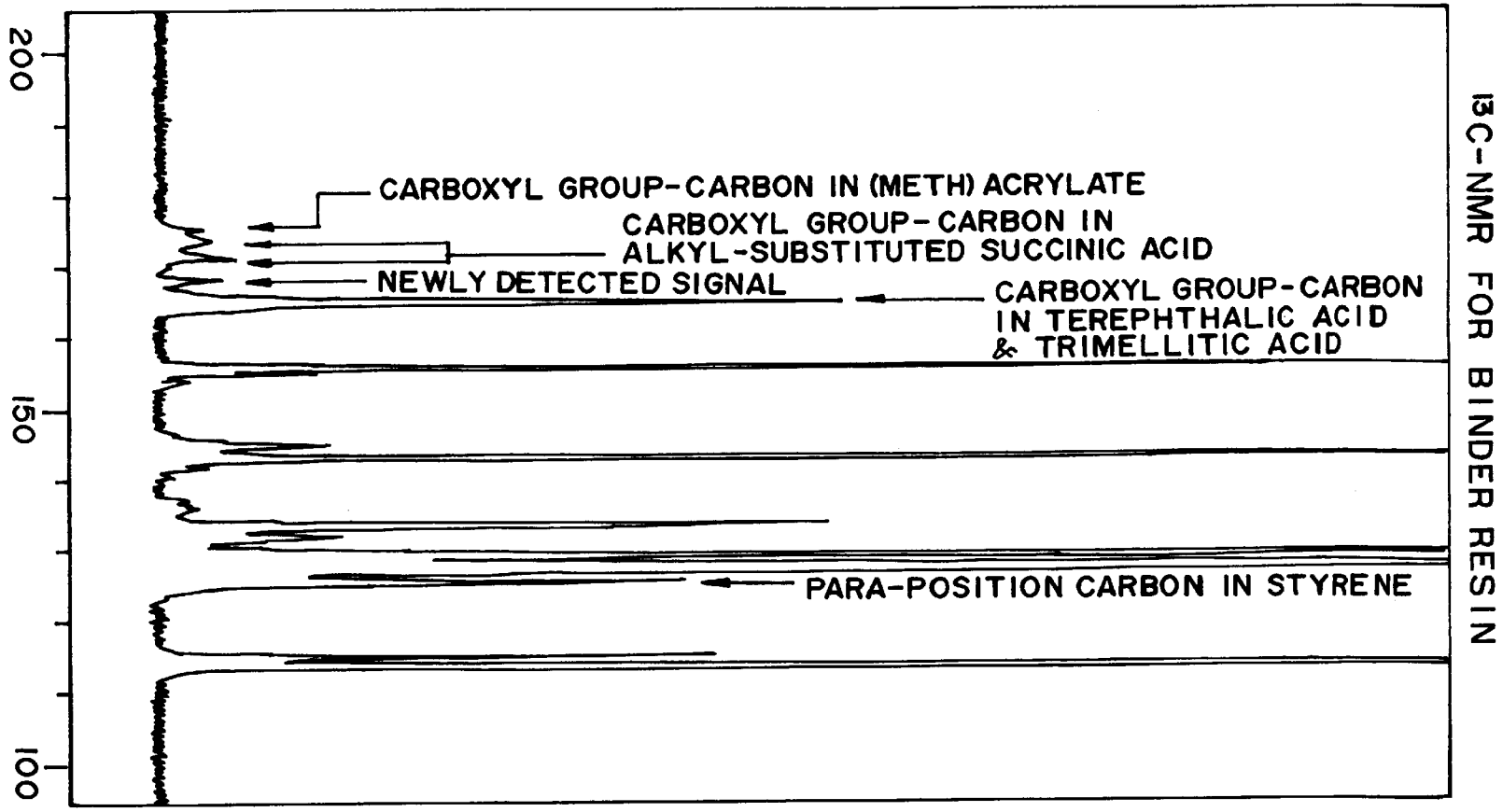
FIG. 8 shows a $^{13}$C-NMR spectrum of Resin composition (a) according to the invention.
Figure 9:
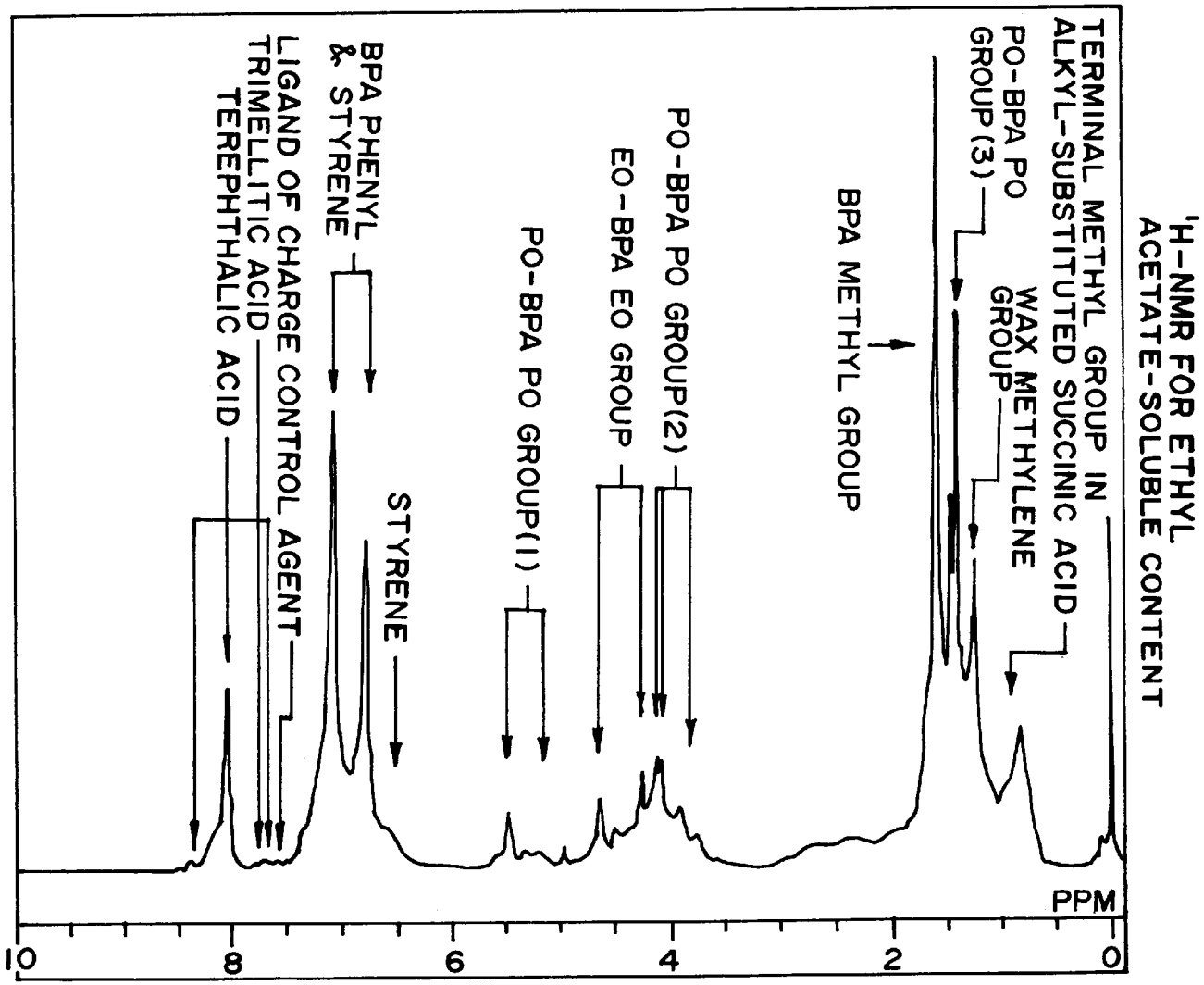
FIGS. 9 and 10 show $^1$H-NMR spectra of an ethyl acetate-soluble content and an ethyl acetate-insoluble content, respectively, of Resin composition (a) according to the invention.

(i) Determination of Alcohol Component Ratio According to $^1$H-NMR (FIGS. 8 and 9)

Figure 11:
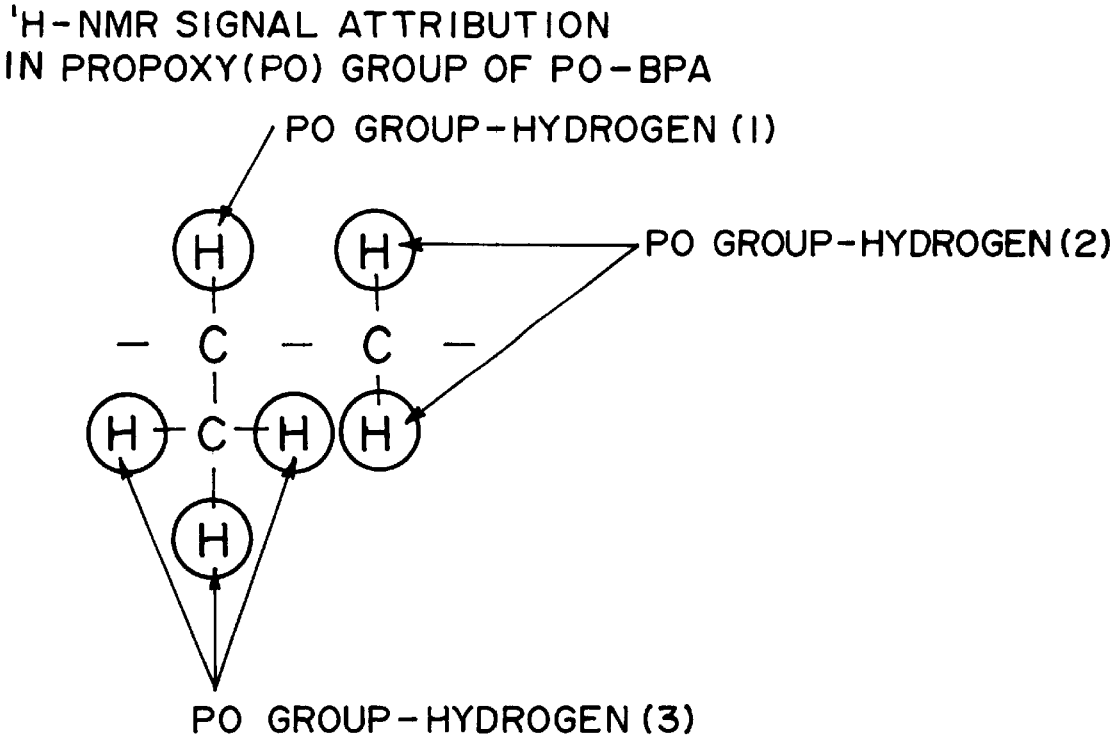
FIG. 11 illustrates assignment of $^1$H-NMR signals for a PO group in PO-BPA.

A quantitative ratio between propoxylated bisphenol A (PO-BPA) and ethoxylated bisphenol A is determined based on a ratio of intensity of signals at ca. 5.2 ppm, 5.3 ppm and 5.4 ppm for propoxy group-hydrogen (for each 1H, as illustrated in FIG. 11) and signals at ca. 4.3 ppm and 4.65 ppm for ethoxy group-hydrogen (for each 4H) on a $^1$H-NMR spectrum.

Figure 10:
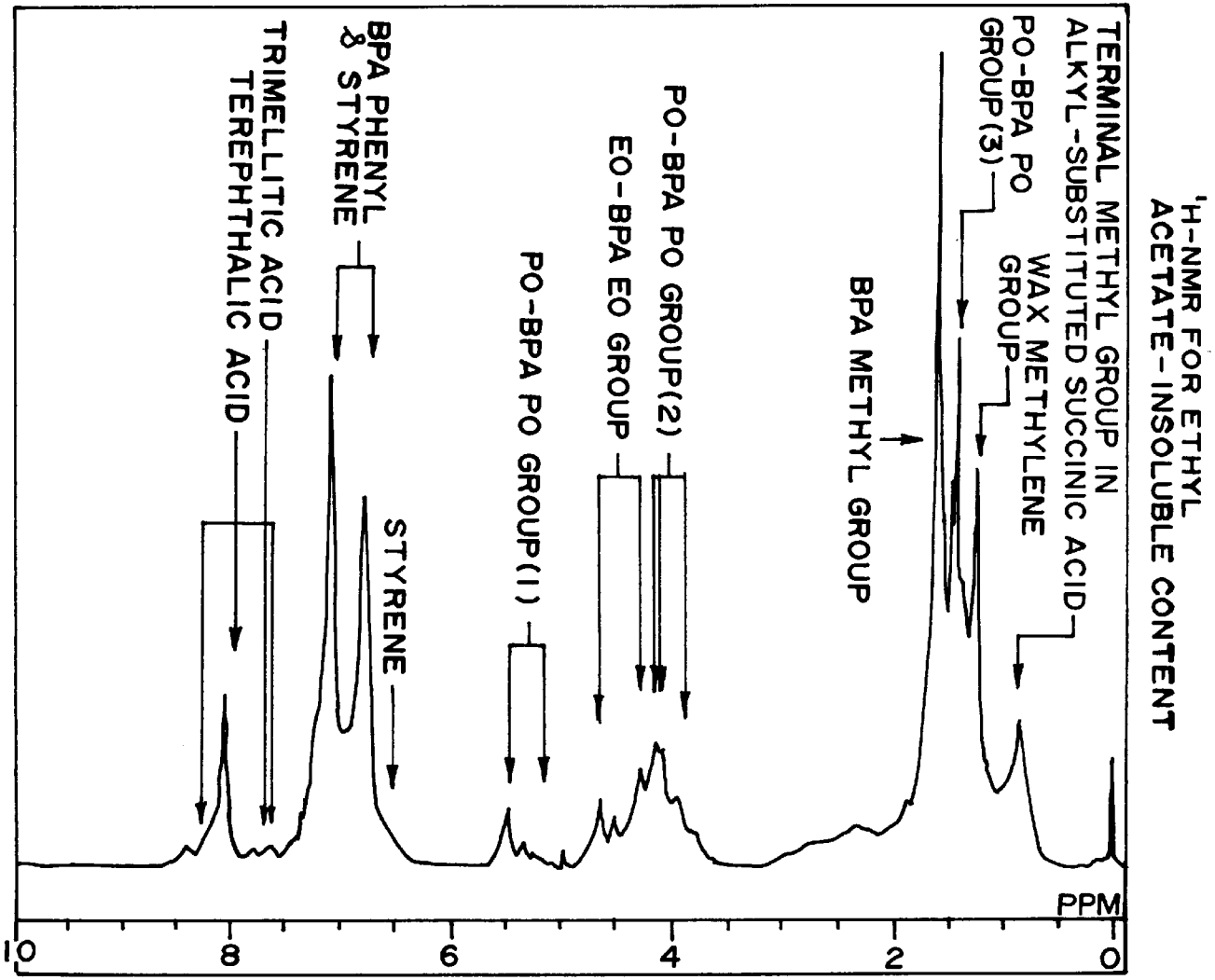

(ii) Determination of Aromatic Carboxylic Acid Component Ratio According to $^1$H-NMR (see FIGS. 9 and 10)

A quantitative ratio between terephthalic acid and trimellitic acid is determined based on an intensity ratio of a signal at ca. 8 ppm for hydrogen (for 4H) of terephthalic acid and signals at ca. 7.6 ppm, 7.8 ppm and 8.4 ppm for hydrogen (for each 1H) of trimellitic acid.

(iii) Determination of Styrene Content According to $^1$H-NMR (see FIGS. 9 and 10)

A styrene content is determined based on a relative signal intensity for hydrogen (for 1H) at ca. 6.6 ppm on a $^1$H-HMR spectrum.

Figure 6:
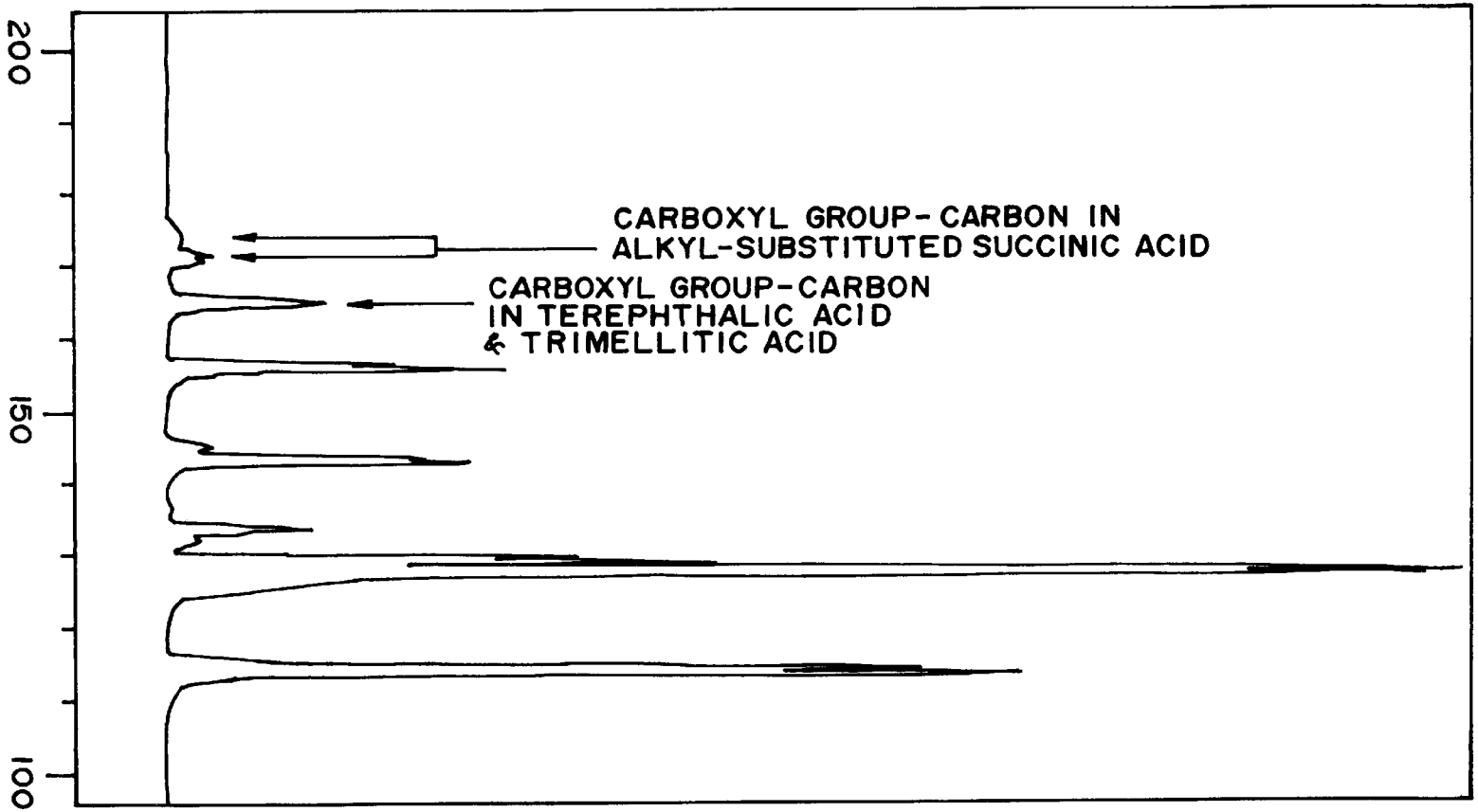
FIGS. 6 and 7 show $^{13}$C-NMR spectra of a low-crosslinked polyester resin (composition) and styrene-2-ethylhexyl acrylate copolymer, respectively.
Figure 7:
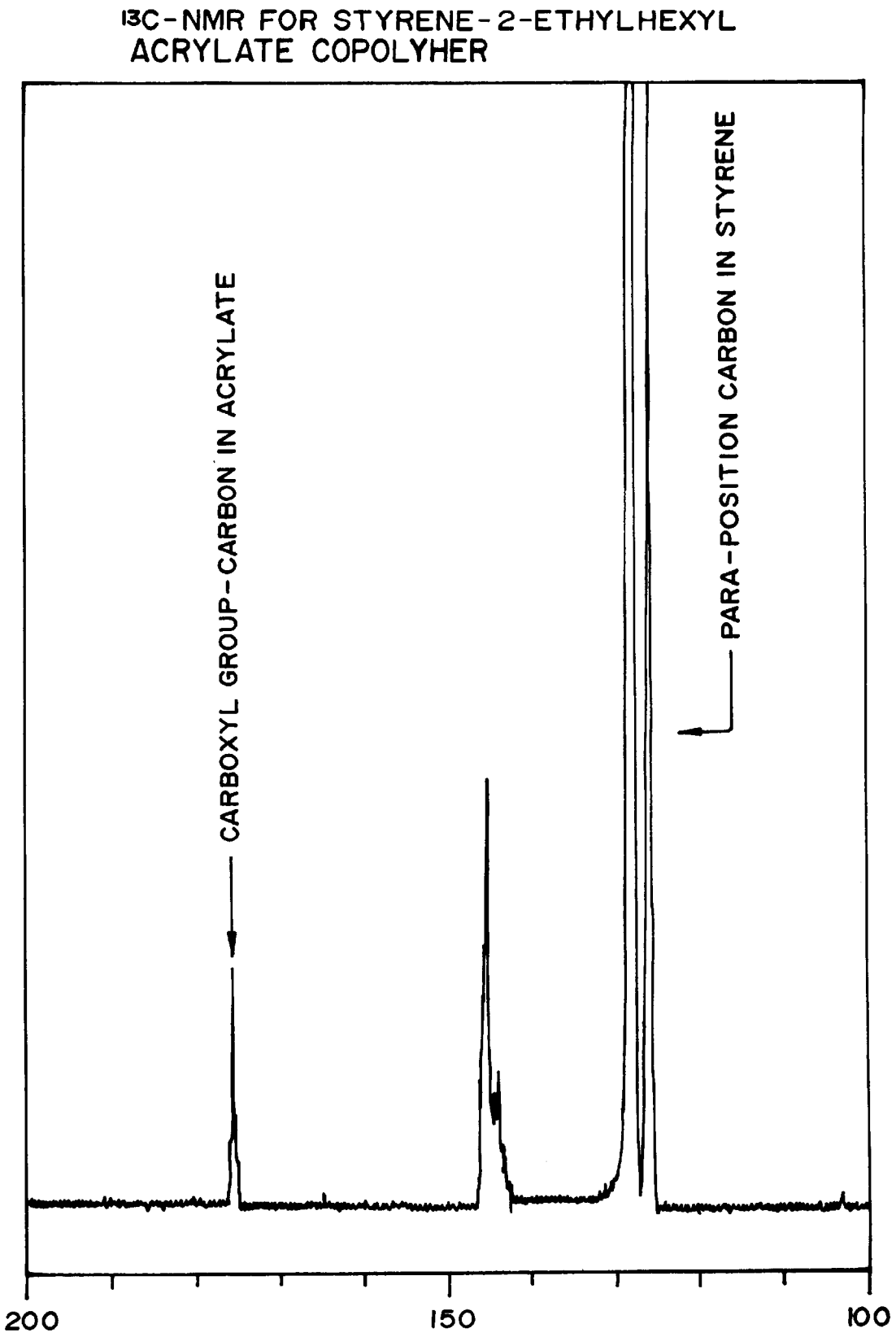

(iv) Determination of Aliphatic Carboxylic Acid, (meth) acrylate, and (meth)acrylate of PO-BPA and EO-BPA (reaction product between a vinyl polymer and polyester resin) (see FIG. 8 in comparison with FIGS. 6 and 7)

Relative contents of aliphatic carboxylic acid, (meth) acrylate, and a reaction product between a vinyl polymer and a polyester resin are determined based on relative intensities of signals at ca. 173.5 ppm and 174 ppm for carboxyl group-carbon in aliphatic carboxylic acid (for 1c), a signal at ca. 176 ppm for carboxyl group-carbon in (meth)acrylate and a newly found peak signal for carboxyl group-carbon in (meth)acrylate on a $^{13}$C-NMR spectrum.

(v) Determination of Aliphatic Carboxylic Acid and Aromatic Carboxylic Acid (FIG. 8)

Relative contents of aliphatic carboxylic acid and aromatic carboxylic acid are determined based on relative intensities of signals at ca. 165 ppm for carboxyl group-carbon in terephthalic acid (for 1C) and the signals for carboxyl group-carbon in aliphatic carboxylic acid (for 1C) discussed in (iv) above on a $^{13}$C-NMR spectrum.

(vi) Determination of Styrene According to $^{13}$C-NMR (FIG. 8)

Relative content of styrene is determined based on a relative intensity of a signal at ca. 125 ppm for para-position carbon (for 1C) on a $^{13}$C-NMR spectrum.

(vii) Determination of Polyester Resin in Ethyl Acetate-insoluble and -soluble Contents From the $^{1}$N-NMR spectra (as shown in FIGS. 4 and 5) discussed in (i)–(iii) above, the relative amounts of monomers of PO-BPA, EO-BPA, terephthalic acid, trimellitic acid and styrene are determined in terms of mol ratios. From the $^{13}$C-NMR spectra (e.g., as shown in FIG. 8) discussed in (iv)–(vi) above, the relative amounts of (meth)acrylates of PO-BPA and EO-BPA (including a reaction product between a vinyl polymer and a polyester resin), aliphatic carboxylic acid, aromatic carboxylic acid and styrene monomers are determined in terms of mol ratios. From these values, the relative amounts of all the monomers are determined in mol ratios, from which a polyester resin content is calculated in wt. % while disregarding the amount of water removed during esterification.

(12) $^{13}$C-NMR Spectrum of a Hybrid Binder Resin Contained in a Toner

Measurement may be performed by using an FT-NMR (Fourier transform-nuclear magnetic resonance) apparatus ("JNM-EX400", available from Nippon Denshi K.K.) under the following conditions.

Measurement frequency: 100.40 MHz

Pulse condition: 5.0 μsec (45 deg.) according to the DEPT method

Data point: 32768

Delay time: 25 sec.

Frequency range: 10500 Hz

Integration times: 50000 times

Temperature: 30° C.

Sample: Prepared by adding 10 g of a toner to 100 ml of conc. (ca. 12M) hydrochloric acid and stirring the mixture for ca. 70 hours at room temperature to dissolve a magnetic material contained therein, followed by repetition of filtration and washing with water until the filtrate becomes weakly acidic (ca. pH 5), and vacuum drying of the residual resin at 60° C. for ca. 20 hours. Ca. 1 g of the sample resin is placed in a 10 mm-dia. sample tube and dissolved by adding 3 ml of deuterium chloroform ($CDCl_3$) and standing at 55° C. in a thermostat vessel.

(13) Different Element Quantity in Magnetic Iron Oxide

The different element quantity in the magnetic iron oxide may be measured by fluorescent X-ray analysis using a fluorescent X-ray analyzer (e.g., "SYSTEM 3080", mfd. by Rigaku Denki Kogyo K.K.) according to JIS K0119 "General Rules for Fluorescent X-ray Analysis").

(14) Different Element Distribution and Concentration in Magnetic Iron Oxide

The different element distribution may be measured by gradual fractional dissolution of the magnetic iron oxide particles with hydrochloric acid or hydrofluoric acid and measurement of the element concentration in the solution at each fractional dissolution relative to the element concentration in the complete solution, respectively according to ICP (inductively coupled plasma) emission spectroscopy.

(15) Number-average Particle Size of a Magnetic Material

The number-average particle size of the magnetic material may be measured by taking photographs (magnification: 40,000) of some particles thereof through a transmission electron microscope and measuring the particle sizes on the photographs with respect to randomly selected 300 particles by a digitizer, etc.

(16) Magnetic Properties of a Magnetic Material

The magnetic properties of the magnetic material are based on values measured by using a vibrating sample-type magnetometer ("VSM-3S-15", available from Toei Kogyo K.K.) under an external magnetic filed of 795.8 kA/m.

(17) Specific Surface Area of a Magnetic Material

The specific surface area values are based on values measured by using a specific surface area meter ("Autosorb 1", available from Yuasa Ionics K.K.) through the nitrogen adsorption according to the BET multi-point method.

(18) Methanol Wettability of Inorganic Fine Powder 0.2 g of a sample inorganic fine powder is added to 50 ml of water in a 250 ml-Erlenmeyer flask. While continuously stirring the liquid in the flask with a magnetic stirrer, methanol is added to the flask from a buret until the whole sample powder is wetted with the liquid (water+methanol mixture) in the flask. The end point can be confirmed by the suspension of the total amount of the sample powder. The methanol wettability is given as the percentage of methanol in the methanol-water mixture on reaching the end point.

(19) Hydroxyl Value OHv of a Binder Resin

The hydroxyl value of a binder resin is measured in the following manner according to JIS k0070-1966.

Ca. 2 g of a sample is accurately weighed (mg unit) into a 200 ml-Erlenmeter flask, and 5 ml of a mixture liquid of acetic anhydride/pyridine (=¼) is added thereto by using a whole pipette and further thereto, 25 ml of pyridine is added by using a graduated cylinder. The Erlenmeter flask is equipped with a condenser, followed by reaction for 90 min. in an oil bath at 100° C.

After the reaction, 3 ml of distilled water is added to the system from the upper portion of the condenser, followed by sufficient shaking and standing for 10 min. Then, the Erlenmeter flask provided with the condenser is taken out of the oil bath and allowed to cool by standing, and a small amount (ca. 10 ml) of acetone is added therein from the upper portion of the condenser at ca. 30° C., thus washing the condenser wall and flask wall. To the resultant system, 50 ml of tetrahydrofuran (THF) is added from a graduated cylinder. Then after adding a phenolphthalein indicator (alcohol solution), the resultant liquid is titrated by using a 50 ml burette (0.1 ml-scale) with a 0.5N-KOH/THF titration liquid. The titration is performed until the liquid, to which 25 ml of neutral alcohol (methanol/acetone=1/1 by volume) is added immediately before the end of neutralization titration, assumes pale pink. Similarly, a blank titration test is performed.

The hydroxyl value (OHv) is determined according to the following formula:

$$OHv\ (mgKOH/g)=(B-A)\times f\times 28.05/S+C,$$

wherein A represents an amount (ml) of the titration liquid (0.5N-KOH/THF) required for titrating the sample; B represents an amount (ml) of the titrating liquid required for titrating the blank; f represents a factor of the titrating liquid; S represents a sample weight (g); and C represents an acid value or alkalinity (alkaline value) of the sample with the proviso that C has a negative value when the sample has an alkalinity.

(20) Penetration of a Wax

The penetration of wax is based on measurement according JIS K-2207.

Specifically, a stylus having a conical tip with a diameter of about 1 mm and an apex angle of 9 degrees is caused to penetrate into a sample wax for 5 sec. under a prescribed weight of 100 g at a sample temperature of 25° C. The measured value is expressed in the unit of 0.1 mm.

As described hereinabove, according to the toner of the present invention using the polyester binder resin in combination with the organic zirconium compound, it is possible to obtain a high chargeability even in a high temperature—high humidity environment while maintaining quick chargeability at an initial stage of image formation, irrespective of specification, mode and process speed of, e.g., a copying machine or printer and to provide excellent developing performances while suppressing excessive charging even in a low humidity environment. In addition, the toner can prevent an occurrence of fixed image soiling for a long period of time even in the case of using recycled paper prepared by utilizing used paper.

According to the toner of the present invention using the hybrid binder resin in combination with the organic zirconium compound, it is possible to obtain not only sufficient low-temperature fixability and anti-high-temperature offset performance but also an improved releasability to a fixing member, thus providing high-quality images free from offset phenomenon regardless of heating mode of a fixing apparatus even in long-term use.

Hereinbelow, the present invention will be described more specifically based on Examples, to which the present invention should not be contrued to be limited.

RESIN PRODUCTION EXAMPLE 1

| | |
|---|---|
| Terephthalic acid | 15 mol. % |
| Fumaric acid | 25 mol. % |
| Trimellitic anhydride | 5 mol. % |
| PO-BPA (propoxylated bisphenol A) | 30 mol. % |
| EO-BPA (ethoxylated bisphenol A) | 25 mol. % |

In the above, PO-BPA represented polyoxypropylene (2.2)-2,2-bis(4-hydroxyphenyl)propane and EO-BPA represented polyoxyethylene (2.2)-2,2-bis(4-hydroxyphenyl) propane.

The above polyester monomers were charged in a 5 liter-four-necked flask equipped with a reflux condenser, a water separator, a nitrogen gas induction device, a thermometer and a stirring device. The system was subjected to polycondensation at 230° C. while introducing $N_2$ gas into the flask to obtain Polyester resin A.

Polyester resin A thus prepared showed an Mn (number-average molecular weight) of 2,500, an Mw (weight-average molecular weight) of 10,000, an Mp (peak molecular weight) of 6,800, a Tg (glass transition temperature) of 57° C. and an Av (acid value) of 28 mgKOH/g.

These physical properties of Polyester resin A are also show in Table 2 appearing hereinbelow together with those of other polyester resins prepared below.

RESIN PRODUCTION EXAMPLE 2

| | |
|---|---|
| Fumaric acid | 35 mol. % |
| Trimellitic anhydride | 10 mol. % |
| PO-BPA | 30 mol. % |
| EO-BPA | 25 mol. % |

A polycondensation was performed in the same manner as in Resin Production Example 1 by using the above polyester monomers. Then, the system was further subjected to polycondensation after adding thereto (further) 3 mol. % of trimellitic anhydride in an intermediate stage of the polycondensation to obtain Polyester resin B.

Physical properties of Polyester resin B are shown in Table 2.

RESIN PRODUCTION EXAMPLE 3

| | |
|---|---|
| PO-BPA | 50 mol. % |
| Ethylene glycol | 10 mol. % |
| Terephthalic acid | 25 mol. % |
| Fumaric acid | 10 mol. % |
| Trimellitic anhydride | 5 mol. % |

The above polyester monomers were subjected to polycondensation in the same manner as in Resin Production Example 1 except for changing the reaction temperature (230° C.) to 200° C., followed by further polycondensation at 220° C. under reduced pressure to obtain Polyester resin C.

Physical properties of Polyester resin C are shown in Table 2.

RESIN PRODUCTION EXAMPLE 4

| | |
|---|---|
| Terephthalic acid | 3 mol. % |
| Isophthalic acid | 30 mol. % |
| Trimellitic anhydride | 15 mol. % |
| n-Dodecenyl succinic acid | 10 mol. % |
| PO-BPA | 30 mol. % |
| EO-BPA | 12 mol. % |

The above polyester monomers were subjected to polycondensation in the same manner as in Resin Production Example 1 to obtain Polyester resin D.

Physical properties of Polyester resin D are shown in Table 2.

RESIN PRODUCTION EXAMPLE 5

| | |
|---|---|
| Terephthalic acid | 5 mol. % |
| Isophthalic acid | 30 mol. % |
| Trimellitic anhydride | 13 mol. % |
| n-Dodecenyl succinic acid | 10 mol. % |
| PO-BPA | 30 mol. % |
| EO-BPA | 12 mol. % |

The above polyester monomers were subjected to polycondensation in the same manner as in Resin Production Example 1 to obtain Polyester resin E.

Physical properties of Polyester resin E are shown in Table 2.

RESIN PRODUCTION EXAMPLE 6

| | |
|---|---|
| Terephthalic acid | 30 mol. % |
| Trimellitic anhydride | 5 mol. % |
| n-Dodecenyl succinic acid | 15 mol. % |
| PO-BPA | 50 mol. % |

The above polyester monomers were subjected to polycondensation in the same manner as in Resin Production Example 1 to obtain Polyester resin F.

Physical properties of Polyester resin F are shown in Table 2.

RESIN PRODUCTION EXAMPLE 7

| | |
|---|---|
| PO-BPA | 50 mol. % |
| Ethylene glycol | 15 mol. % |
| Terephthalic acid | 23 mol. % |
| Fumaric acid | 10 mol. % |
| Trimellitic anhydride | 2 mol. % |

The above polyester monomers were subjected to polycondensation in the same manner as in Resin Production Example 3 to obtain Polyester resin G.

Physical properties of Polyester resin G are shown in Table 2.

TABLE 2

| Polyester resin | Mn | Mw | Mp | $THF_{ins}$* (wt. %) | Tg (° C.) | Av (mgKOH/g) |
|---|---|---|---|---|---|---|
| | Polyester resin | | | | | |
| A | 2500 | 10000 | 6800 | 0 | 57 | 28 |
| B | 3500 | 150000 | 9000 | 28 | 63 | 25 |
| C | 5500 | 180000 | 18500 | 3 | 62 | 5 |
| D | 2200 | 50000 | 2600 | 48 | 59 | 57 |
| E | 2300 | 90000 | 3300 | 34 | 61 | 48 |
| F | 2100 | 57000 | 7400 | 0 | 64 | 12 |
| G | 6000 | 250000 | 21000 | 0 | 60 | 1.8 |

*: THF-insoluble content

The above-prepared Polyester resin A–G were blended by Henschel mixer or used along to prepare Binder resins 1–8.

The mixing ratios (by weight) of Polyester resins used and physical properties of Binder resins 1–8 are shown in Table 3.

TABLE 3

| Binder resin | Weight ratio of Polyester resins | Mp | Tg (° C.) | $THF_{ins.}$ (wt. %) | Av (mgKOH/g) | Hydroxyl value (mgKOH/g) |
|---|---|---|---|---|---|---|
| | Binder resins | | | | | |
| 1 | A:B = 1:1 | 7400 | 60 | 14 | 28 | 35 |
| 2 | C:B = 1:1 | 13600 | 62 | 8 | 8 | 31 |

TABLE 3-continued

| Binder resin | Weight ratio of Polyester resins | Mp | Tg (° C.) | $THF_{ins.}$ (wt. %) | Av (mgKOH/g) | Hydroxyl value (mgKOH/g) |
|---|---|---|---|---|---|---|
| 3 | A:D = 1:1 | 5500 | 56 | 24 | 42 | 41 |
| 4 | C alone | 18500 | 62 | 3 | 5 | 44 |
| 5 | E alone | 3300 | 61 | 34 | 48 | 31 |
| 6 | F alone | 7400 | 64 | 0 | 12 | 20 |
| 7 | G alone | 21000 | 60 | 0 | 1.8 | 49 |
| 8 | D alone | 2600 | 59 | 48 | 57 | 36 |

In the following Examples, Waxes 1–7 having compositions and physical properties shown in Table 5 below each prepared by using Waxes A–H having physical properties shown in Table 4 below in the following manner.

Each of Waxes 1–7 was prepared by blending two of Waxes A–H in the indicated proportions, followed by spray drying to form powdery wax or by using a wax alone.

TABLE 4

| Wax | Species | Mn | Mw | Mw/Mn | Mp | Tmp (° C.) | Penetration ($10^{-1}$ mm) |
|---|---|---|---|---|---|---|---|
| | Waxes (starting waxes) | | | | | | |
| A | Paraffin wax | 324 | 372 | 1.15 | 380 | 72 | 6 |
| B | Wax of formula (I) (A = hydroxyl) | 438 | 745 | 1.70 | 700 | 98 | 1.5 |
| C | Hydrocarbon wax | 1147 | 1950 | 1.70 | 1785 | 113 | 1.5 |
| D | Polyethylene wax | 2001 | 3002 | 1.50 | 2900 | 125 | 0.5 |
| E | Maleic acid-modified polypropylene wax | 622 | 6100 | 9.80 | 5200 | 128 | 2 |
| F | Polypropylene wax | 479 | 6901 | 14.40 | 4700 | 137 | 0.7 |
| G | Paraffin wax | 250 | 268 | 1.07 | 280 | 58 | 6 |
| H | Polyethylene wax | 739 | 9611 | 13.00 | 8882 | 127 | 0.5 |

TABLE 5

| Wax | Weight ratio of waxes | Mw/Mn | Mp | Tmp (° C.) |
|---|---|---|---|---|
| | Waxes | | | |
| 1 | A:B = 1:1 | 1.25 | 538 | 79 |
| 2 | B:C = 1:1 | 4.00 | 1603 | 105 |
| 3 | D:E = 1:1 | 9.20 | 4383 | 126 |
| 4 | A alone | 1.15 | 380 | 72 |
| 5 | F alone | 14.40 | 4700 | 137 |
| 6 | G alone | 1.07 | 280 | 58 |
| 7 | F:H = 1:1 | 16.20 | 5600 | 134 |

EXAMPLE 1

| | |
|---|---|
| Binder resin 1 | 100 wt. parts |
| Magnetic iron oxide | 90 " |
| (Dav. (average particle size = 0.2 $\mu$m, Hc = 9.5 kA/m, $\sigma s$ = 65 $Am^2/kg$, $\sigma r$ = 7 $Am^2/kg$) | |
| Organic zirconium compound (42) | 2 " |
| Wax 2 | 5 " |

The above ingredients were preliminarily blended by a Henschel mixer and then melt-kneaded through a twin-screw kneading extruder ("PCM-30", mfd. by Ikegai Tekkosho K.K.) set at 140° C. During the melt-kneading, the viscosity of the kneaded mixture was increased, whereby the formation of fresh crosslinkage was confirmed.

The thus-kneaded product was cooled, coarsely crushed by a cutter mill and finely pulverized by a pulverizer using a jet air stream, followed by classification by a multi-division classifier utilizing the Coanda effect to form a magnetic toner (toner particles) having a weight-average particle size (D4) of 7.5 $\mu$m. To 100 wt. parts of the magnetic toner, 1.0 wt. part of hydrophobic silica fine powder (hydrophobized with 20 wt. % based on starting silica fine powder of hexamethyldisilazane and having a methanol-wettability of 65% and a BET specific surface area of 260 $m^2/g$) and 4.0 wt. parts of strontium titanate fine powder were externally blended to prepare Magnetic toner No. 1.

Magnetic toner No. 1 exhibited D4=7.5 $\mu$m and a contact angle to water ($\theta cA$) of 117 deg. When a THF-soluble content of Magnetic toner No. 1 was subjected to molecular weight measurement based on a GPC, the THF-soluble content provided a GPC chart shown in FIG. 12 and was found to provide a peak molecular weight (Mp) of 7,500 and a component having molecular weights of at least $5\times10^5$ ($\geqq10^5$%) of 7.4%. Further, Binder resin 1 used in Magnetic toner No. 1 exhibited an acid value (Av) of 26 mgKOH/g, a THF-insoluble content ($THF_{ins.}$) of 30 wt. % and a hydroxyl value (OHv) of 36 mgKOH/g.

These properties of Magnetic toner No. 1 and Binder resin 1 are shown in Table 7 appearing hereinafter.

Magnetic toner No. 1 was evaluated by using a commercially available electrophotographic copying machine having contact charging and transfer means ("NP-6085", mfd. by Canon K.K.) after remodeling for equipping a developing sleeve prepared by coating a sleeve substrate with a resinous coating layer (phenolic resin:graphite=3:1 by weight) and a non-magnetic regulating elastic blade disposed in contact with the developing sleeve for continuous copying on 50,000 sheets in three environments including a normal temperature/low humidity (NT/LH) environment (23° C./5% RH), a high temperature/high humidity (HT/HH) environment (30° C./80% RH), and a normal temperature/normal humidity (NT/NH) environment (23° C./60% RH), respectively. The test was performed while removing the aluminum cleaning roller contacting the pressure roller of the fixing device. The transfer paper was A4-sized recycled paper (filler content=15% (as ash content), basis weight=66 $g/m^2$, used paper utilization=50%).

As a result, it was possible to obtain high-definition images having a high image density and free from fog in all the environments. When the surfaces of the fixing members (e.g., fixing film and pressure roller) were observed, toner deposition soiling due to the filler contained in the transfer paper and fixed image soiling were not found at all. Further, as a result of observation of the photosensitive member surface, no filming occurred.

The results are shown in Tables 8, 9 and 10.

The image density was measured by using a Macbeth densitometer (available from Macbeth Co.) equipped with an SPI filter for measurement of a reflection density with respect to a circular image of 5 mm in diameter.

The fog was determined by measuring a worst (maximum) reflection density Ds of a white background region after image formation and an average reflection density Dr of a transfer paper (recycled paper) to calculate Ds-Dr as a fog value. A smaller value represents a better fog suppression effect.

The image quality was evaluated by copying dot images of 20 gradation levels having image proportions of 5–100% at increments of 5% each to evaluate the number of reproducible gradation levels. A larger number of reproducible gradation levels represents a higher definition copying performance.

The soiling of the fixing member was evaluated according to the following standard:

A: No soiling on the fixing member.

B: Slight soiling on the fixing member.

C: Soiling on the fixing member was observed but no adverse effect was observed on the images.

D: The fixing member was soiled, and offset (toner soiling) was observed in the resultant images.

The cleaning performance was evaluated after the continuous copying test according to the following standard:

A: No filming on the photosensitive member surface.

B: Slight filming on the photosensitive member surface was observed at the portion not contacting the paper.

C: Slight filming on the photosensitive member surface was observed at the paper-contacting portion but no adverse effect was observed on the images.

D: Filming leading to fogs on the images was observed on the photosensitive member surface.

E: Toner melt-sticking leading to image spots was observed on the photosensitive member surface.

After the 50,000 sheets of continuous image formation in the HT/HH (30° C./80% RH) environment, the copying apparatus was left standing in the environment for three days, and then some images were formed again to measure the image density (image density after-standing).

In the continuous image formation in the NT/LH (23° C./5% RH) environment, the resultant images were evaluated with respect to the presence or absence of image defects due to soiling of the charging roller according to the following standard.

A: No image defects.

B: Some defect observed in a halftone image.

C: Some defect observed in a solid image.

D: Defects were observed even in ordinary image.

The fixable temperature range (° C.) in the NT/NH (23° C./60% RH) environment was measured in the following manner.

The fixing device of a commercially available copying machine ("NP-6085", mfd. by Canon K.K.) was taken out of the main body and remodeled so as to be able to arbitrarily set the fixing temperature and provide a process speed of 150 mm/sec, thereby providing an external fixing device. By using the external fixing device, yet-unfixed toner images on plain paper of 80 $g/m^2$ were subjected to evaluation of the fixability. By setting the fixing temperatures in the range of 120–190° C. at increments of 5° C. each, fixed images at the respective temperatures were rubbed for 5 reciprocations with a lens cleaning paper under a load of 4.9 kPa to determine the lowest fixing temperature giving an image density lowering after rubbing of at most 10% as a fixing initiation temperature. A lower fixing initiation temperature indicates a better fixability.

On the other hand, an external fixing device having a set process speed of 100 mm/sec was used to fix yet-unfixed images on plain paper of 60 g/m$^2$, thereby evaluating the anti-offset characteristic. For the evaluation, the fixing temperatures were set by increments of 5° C. each in a temperature range of 190–240° C., and the offset behavior was observed to determine a highest non-offset temperature as a measure of anti-offset characteristic. A higher highest non-offset temperature represents a better anti-offset characteristic.

The above evaluations were both performed in an environment of NT/NH (23° C./60% RH). A fixable temperature range was defined between the fixing initiation temperature and the highest non-offset temperature. A broader fixable temperature range represents a better fixing performance of a toner. In the evaluation test described above, the measurement conditions (i.e., paper species and process speeds) were made different between the measurement of the fixing initiation temperature and the highest non-offset temperature. This is a severer evaluation condition, so that a broader fixable temperature can be obtained under actual fixing conditions where the toner and higher limits of the fixable temperature range are measured under identical fixing conditions (paper and process speed).

EXAMPLES 2–14

Magnetic toners Nos. 2–14 were prepared according to prescriptions shown in Table 6 otherwise in a similar manner as in Example 1 and evaluated in the same manner as in Example 1. The properties of the respective magnetic toners are shown in Table 7, and the evaluation results are shown in Tables 8–10.

COMPARATIVE EXAMPLES 1–4

Magnetic toners Nos. 15–18 were prepared in the same manner as in Example 1 except for using the following Organic zinc compound (176), Organic iron compound (177), Organic aluminum compound (178) and Organic chromium compound (179), respectively, in place of Organic zirconium compound (42), and then evaluated in the same manner as in Example 1. The prescriptions and properties of the respective magnetic toners are shown in Tables 6 and 7, and the evaluation results are shown in Tables 8–10.

In the following formulae (176)–(179), coordinating water molecules are omitted from showing.

(176)

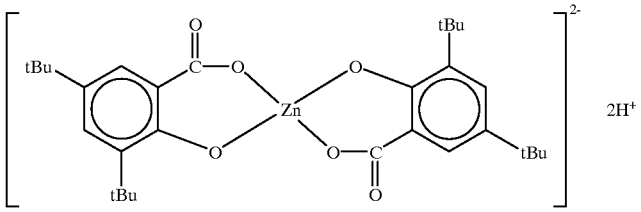

(177)

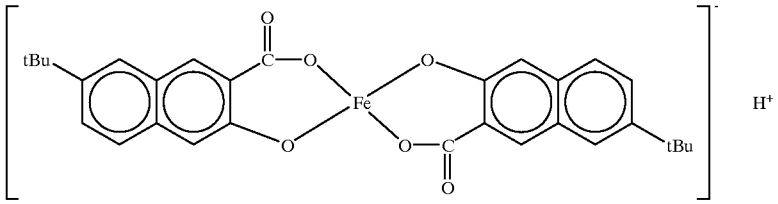

(178)

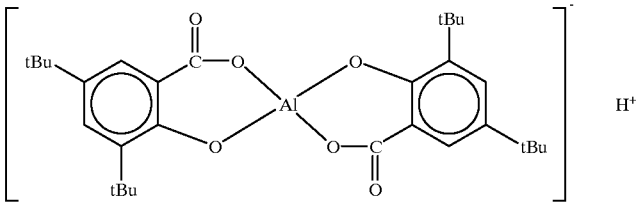

-continued (179)

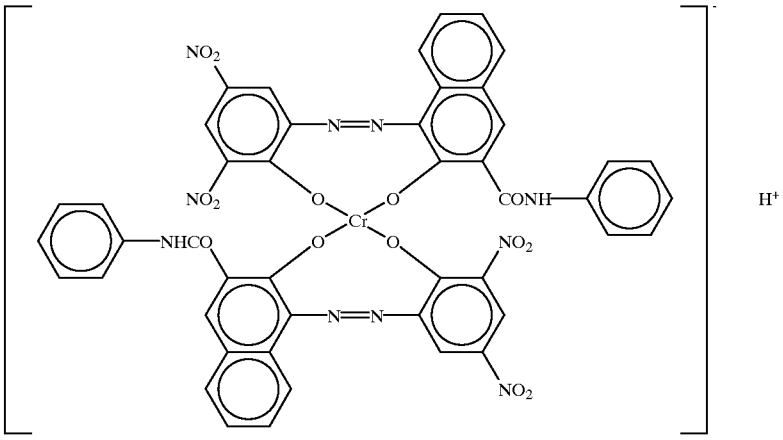

TABLE 6

| | Toner prescriptions | | | | |
|---|---|---|---|---|---|
| | Magnetic toner Nos. | Organic metal compound (wt. parts) | Binder resin (wt. parts) | Magnetic ion oxide (wt. parts) | Wax (wt. parts) |
| Ex. 1 | 1 | 42(2) | 1(100) | (90) | 2(2) |
| Ex. 2 | 2 | 67(2) | 1(100) | (90) | 2(2) |
| Ex. 3 | 3 | 87(2) | 1(100) | (90) | 2(2) |
| Ex. 4 | 4 | 120(2) | 1(100) | (90) | 2(2) |
| Ex. 5 | 5 | 134(2) | 1(100) | (90) | 2(2) |
| Ex. 6 | 6 | 50(2) | 1(100) | (90) | 2(2) |
| Ex. 7 | 7 | 81(2) | 1(100) | (90) | 2(2) |
| Ex. 8 | 8 | 92(2) | 1(100) | (90) | 2(2) |
| Ex. 9 | 9 | 128(2) | 1(100) | (90) | 2(2) |
| Ex. 10 | 10 | 158(2) | 1(100) | (90) | 2(2) |
| Ex. 11 | 11 | 166(2) | 1(100) | (90) | 2(2) |
| Ex. 12 | 12 | 148(2) | 1(100) | (90) | 2(2) |

TABLE 6-continued

| | Toner prescriptions | | | | |
|---|---|---|---|---|---|
| | Magnetic toner Nos. | Organic metal compound (wt. parts) | Binder resin (wt. parts) | Magnetic ion oxide (wt. parts) | Wax (wt. parts) |
| Ex. 13 | 13 | 171(2) | 1(100) | (90) | 2(2) |
| Ex. 14 | 14 | 137(2) | 1(100) | (90) | 2(2) |
| Comp. Ex. 1 | 15 | 176(2) | 1(100) | (90) | 2(2) |
| Comp. Ex. 2 | 16 | 177(2) | 1(100) | (90) | 2(2) |
| Comp. Ex. 3 | 17 | 178(2) | 1(100) | (90) | 2(2) |
| Comp. Ex. 4 | 18 | 179(2) | 1(100) | (90) | 2(2) |

TABLE 7

| | Toner and binder properties | | | | | | | |
|---|---|---|---|---|---|---|---|---|
| | Magnetic toner No. | D4 (μm) | Av (mgKOH/g) | Molecular weight distribution Mp | Molecular weight distribution $\geqq 10^5$ % | $THF_{ins.}$ (wt. %) | ΘcA (deg.) | OHv (mgKOH/g) |
| Ex. 1 | 1 | 7.5 | 26 | 7500 | 7.4 | 30 | 117 | 36 |
| 2 | 2 | 7.7 | 26 | 7450 | 7.3 | 33 | 117 | 36 |
| 3 | 3 | 7.4 | 25 | 7450 | 7.4 | 27 | 119 | 36 |
| 4 | 4 | 7.6 | 26 | 7550 | 7.5 | 28 | 118 | 36 |
| 5 | 5 | 7.8 | 27 | 7500 | 7.4 | 31 | 115 | 36 |
| 6 | 6 | 7.3 | 26 | 7500 | 7.2 | 30 | 116 | 36 |
| 7 | 7 | 7.5 | 27 | 7550 | 7.4 | 33 | 117 | 36 |
| 8 | 8 | 7.6 | 26 | 7550 | 7.6 | 29 | 118 | 36 |
| 9 | 9 | 7.6 | 25 | 7450 | 7.5 | 31 | 116 | 36 |
| 10 | 10 | 7.4 | 27 | 7450 | 7.4 | 30 | 117 | 36 |
| 11 | 11 | 7.8 | 26 | 7500 | 7.4 | 29 | 117 | 36 |
| 12 | 12 | 7.8 | 26 | 7500 | 7.2 | 32 | 115 | 36 |
| 13 | 13 | 7.6 | 27 | 7500 | 7.1 | 28 | 116 | 36 |
| 14 | 14 | 7.5 | 25 | 7550 | 7.7 | 29 | 118 | 36 |
| Comp. Ex. 1 | 15 | 7.5 | 27 | 7500 | 2.3 | 6 | 96 | 34 |
| 2 | 16 | 7.4 | 27 | 7450 | 2.5 | 9 | 100 | 34 |
| 3 | 17 | 7.5 | 27 | 7450 | 5.6 | 24 | 110 | 31 |
| 4 | 18 | 7.6 | 28 | 7350 | 1.0 | 3 | 91 | 36 |

TABLE 8

Evaluation results in NT/LH (23° C./5% RH)

| | Magnetic toner No. | Image density | Fog | Image quality | Fixing member soiling | Image defect | Cleaning perfor-mance |
|---|---|---|---|---|---|---|---|
| Ex. 1 | 1 | 1.42–1.45 | 0.4–0.7 | 17–19 | A | A | A |
| Ex. 2 | 2 | 1.43–1.46 | 0.4–0.8 | 17–19 | A | B | A |
| Ex. 3 | 3 | 1.41–1.47 | 0.5–0.7 | 17–19 | A | B | A |
| Ex. 4 | 4 | 1.39–1.42 | 0.6–0.9 | 17–19 | A | A | A |
| Ex. 5 | 5 | 1.38–1.43 | 0.6–0.7 | 17–18 | A | A | A |
| Ex. 6 | 6 | 1.36–1.40 | 0.6–0.8 | 17–18 | A | A | A |
| Ex. 7 | 7 | 1.41–1.46 | 0.5–0.9 | 17–19 | A | B | A |
| Ex. 8 | 8 | 1.34–1.35 | 0.7–0.9 | 16–18 | A | B | A |
| Ex. 9 | 9 | 1.37–1.40 | 0.5–0.9 | 16–19 | A | A | A |
| Ex. 10 | 10 | 1.37–1.39 | 0.6–0.9 | 17–18 | A | A | A |
| Ex. 11 | 11 | 1.43–1.46 | 0.4–0.6 | 17–19 | A | A | A |
| Ex. 12 | 12 | 1.43–1.45 | 0.5–0.6 | 17–19 | A | A | A |
| Ex. 13 | 13 | 1.39–1.42 | 0.6–0.8 | 17–18 | A | A | A |
| Ex. 14 | 14 | 1.38–1.41 | 0.6–0.7 | 17–18 | A | A | A |
| Comp. Ex. 1 | 15 | 1.31–1.33 | 0.6–1.1 | 15–17 | C | C | A |
| Comp. Ex. 2 | 16 | 1.29–1.32 | 0.5–1.2 | 15–17 | B | C | A |
| Comp. Ex. 3 | 17 | 1.32–1.34 | 0.6–1.3 | 16–17 | A | C | A |
| Comp. Ex. 4 | 18 | 1.33–1.34 | 0.5–1.1 | 16–17 | D | C | A |

TABLE 9

Evaluation results in HT/HH (30° C./80% RH)

| | Magnetic toner No. | Image density | Fog | Image quality | Fixing member soiling | Image density after-standing | Cleaning perfor-mance |
|---|---|---|---|---|---|---|---|
| Ex. 1 | 1 | 1.39–1.40 | 0.4–0.7 | 17–18 | A | 1.34 | A |
| Ex. 2 | 2 | 1.39–1.41 | 0.4–0.8 | 17–18 | A | 1.35 | A |
| Ex. 3 | 3 | 1.39–1.40 | 0.5–0.7 | 17–18 | A | 1.34 | A |
| Ex. 4 | 4 | 1.37–1.39 | 0.3–0.5 | 17–18 | A | 1.30 | A |
| Ex. 5 | 5 | 1.36–1.40 | 0.4–0.5 | 17–18 | A | 1.30 | A |
| Ex. 6 | 6 | 1.33–1.37 | 0.3–0.6 | 17–18 | A | 1.28 | A |
| Ex. 7 | 7 | 1.39–1.41 | 0.4–0.8 | 17–18 | A | 1.34 | A |
| Ex. 8 | 8 | 1.33–1.35 | 0.4–0.7 | 17–18 | A | 1.25 | A |
| Ex. 9 | 9 | 1.34–1.37 | 0.7–0.8 | 16–17 | A | 1.29 | A |
| Ex. 10 | 10 | 1.35–1.38 | 0.4–0.8 | 16–17 | A | 1.26 | A |
| Ex. 11 | 11 | 1.40–1.41 | 0.7–0.8 | 17–18 | A | 1.34 | A |
| Ex. 12 | 12 | 1.39–1.41 | 0.6–0.8 | 17–18 | A | 1.34 | A |
| Ex. 13 | 13 | 1.37–1.38 | 0.5–0.6 | 17–18 | A | 1.29 | A |
| Ex. 14 | 14 | 1.36–1.38 | 0.5–0.7 | 17–18 | A | 1.27 | A |
| Comp. Ex. 1 | 15 | 1.27–1.32 | 0.6–1.2 | 15–16 | C | 1.13 | A |
| Comp. Ex. 2 | 16 | 1.28–1.31 | 0.4–1.3 | 15–16 | B | 1.14 | A |
| Comp. Ex. 3 | 17 | 1.26–1.33 | 0.5–1.4 | 15–15 | A | 1.14 | A |
| Comp. Ex. 4 | 18 | 1.28–1.32 | 0.6–1.7 | 15–15 | D | 1.14 | A |

TABLE 10

Evaluation results in NT/NH (23° C./60% RH)

| | Magnetic toner No. | Image density | Fog | Image quality | Fixing member soiling | Fixing temp. range | Cleaning perfor-mance |
|---|---|---|---|---|---|---|---|
| Ex. 1 | 1 | 1.42–1.43 | 0.6–0.6 | 20–19 | A | 135–235 | A |
| Ex. 2 | 2 | 1.43–1.43 | 0.5–0.6 | 19–20 | A | 135–235 | A |
| Ex. 3 | 3 | 1.43–1.43 | 0.6–0.5 | 19–19 | A | 130–230 | A |
| Ex. 4 | 4 | 1.39–1.41 | 0.6–0.7 | 18–19 | A | 135–235 | A |
| Ex. 5 | 5 | 1.40–1.41 | 0.8–0.6 | 19–18 | A | 140–240 | A |
| Ex. 6 | 6 | 1.36–1.40 | 0.6–0.9 | 19–18 | A | 140–240 | A |
| Ex. 7 | 7 | 1.41–1.41 | 0.8–0.5 | 18–18 | A | 135–235 | A |
| Ex. 8 | 8 | 1.33–1.39 | 0.9–0.8 | 18–17 | A | 135–235 | A |
| Ex. 9 | 9 | 1.36–1.39 | 0.8–0.7 | 17–18 | A | 130–230 | A |
| Ex. 10 | 10 | 1.37–1.36 | 0.8–0.9 | 18–17 | A | 135–235 | A |
| Ex. 11 | 11 | 1.43–1.43 | 0.5–0.5 | 20–19 | A | 130–230 | A |
| Ex. 12 | 12 | 1.42–1.42 | 0.4–0.6 | 20–19 | A | 135–235 | A |
| Ex. 13 | 13 | 1.43–1.43 | 0.5–0.5 | 19–20 | A | 140–240 | A |

TABLE 10-continued

Evaluation results in NT/NH (23° C./60% RH)

| | Magnetic toner No. | Image density | Fog | Image quality | Fixing member soiling | Fixing temp. range | Cleaning performance |
|---|---|---|---|---|---|---|---|
| Ex. 14 | 14 | 1.42–1.43 | 0.6–0.5 | 20–19 | A | 135–235 | A |
| Comp. Ex. 1 | 15 | 1.27–1.31 | 0.9–0.9 | 17–16 | C | 135–220 | A |
| Comp. Ex. 2 | 16 | 1.26–1.34 | 1.1–1.0 | 18–16 | B | 135–220 | A |
| Comp. Ex. 3 | 17 | 1.27–1.33 | 1.1–0.9 | 17–16 | A | 135–230 | A |
| Comp. Ex. 4 | 18 | 1.27–1.32 | 1.0–1.1 | 17–16 | D | 135–210 | A |

EXAMPLE 15

| | |
|---|---|
| Binder resin 2 | 100 wt. parts |
| Magnetic iron oxide (Dav. = 0.2 $\mu$m, Hc = 9.5 kA/m, $\sigma s$ = 65 $Am^2/kg$, $\sigma r$ = 7 $Am^2/kg$) | 90 wt. parts |
| Organic zirconium compound (42) | 2 wt. parts |
| Wax 2 | 5 wt. parts |

The above ingredients were preliminarily blended by a Henschel mixer and then melt-kneaded through a twin-screw kneading extruder ("PCM-30", mfd. by Ikegai Tekkosho K.K.) set at 140° C. During the melt-kneading, the viscosity of the kneaded mixture was increased, whereby the formation of fresh crosslinkage was confirmed.

The thus-kneaded product was cooled, coarsely crushed by a cutter mill and finely pulverized by a pulverizer using a jet air stream, followed by classification by a multi-division classifier utilizing the Coanda effect to form a magnetic toner (toner particles) having D4 of 7.6 $\mu$m. To 100 wt. parts of the magnetic toner, 1.0 wt. part of hydrophobic silica fine powder (hydrophobized with 20 wt. % based on starting silica fine powder of hexamethyldisilazane and having a methanol-wettability of 65% and a BET specific surface area of 260 $m^2/g$) and 4.0 wt. parts of strontium titanate fine powder were externally blended to prepare Magnetic toner No. 19.

Magnetic toner No. 19 exhibited D4=7.6 $\mu$m and a contact angle to water (θcA) of 123 deg. When a THF-soluble content of Magnetic toner No. 19 was subjected to molecular weight measurement based on a GPC, the THF-soluble content was found to provide a peak molecular weight (Mp) of 14,000 and a component having molecular weights of at least $5\times10^5$ ($\geqq10^5$%) of 5.2%. Further, Binder resin 2 used in Magnetic toner No. 19 exhibited an acid value (Av) of 7 mgKOH/g, a THF-insoluble content ($THF_{ins.}$) of 15 wt. % and a hydroxyl value (OHv) of 30 mgKOH/g.

These properties of Magnetic toner No. 19 and Binder resin 2 are shown in Table 12 appearing hereinafter.

Magnetic toner No. 19 was evaluated in the same manner as in Example 1 in the HT/HH (30° C./80% RH) environment and NT/NH (23° C./60% RH) environment, respectively.

As result, it was possible to obtain high-definition images having a high image density and free from fog in both environments.

When the fixing member soiling (due to the filler contained in the transfer paper) was observed, there was no soiling of the fixing film although a slight spot-like toner soiling was present at a portion of the pressure roller, thus resulting in no soiling of the fixed images.

The results are shown in Tables 13 and 14.

EXAMPLES 16–19 AND COMPARATIVE EXAMPLES 5 AND 6

Magnetic toners Nos. 20–25 were prepared according to prescriptions shown in Table 11 otherwise in a similar manner as in Example 1 and evaluated in the same manner as in Example 15. The properties of the respective magnetic toners are shown in Table 12, and the evaluation results are shown in Tables 13 and 14.

COMPARATIVE EXAMPLE 7

Magnetic toner No. 26 was prepared in the same manner as in Example 19 except for changing the setting temperature (140° C.) of the twist-screw kneading extruder to 130° C. and then evaluated in the same manner as in Example 15. As a result of measurement of a molecular weight distribution according to a GPC as to a THF-soluble content of Magnetic toner No. 26, the THF-soluble content exhibited an Mw of 64,000 and a component having molecular weights of at most $10^5$ of 90%. The prescriptions and other properties of Magnetic toner No. 26 are shown in Table 12, and the evaluation results are shown in Tables 13 and 14.

TABLE 11

Toner prescriptions

| | Magnetic toner Nos. | Organic metal compound (wt. parts) | Binder resin (wt. parts) | Magnetic ion oxide (wt. parts) | Wax (wt. parts) |
|---|---|---|---|---|---|
| Ex. 15 | 19 | 42(2) | 2(100) | (90) | 2(2) |
| Ex. 16 | 20 | 42(2) | 3(100) | (90) | 2(2) |
| Ex. 17 | 21 | 42(2) | 4(100) | (90) | 2(2) |
| Ex. 18 | 22 | 42(2) | 5(100) | (90) | 2(2) |
| Ex. 19 | 23 | 42(2) | 6(100) | (90) | 2(2) |
| Comp. Ex. 5 | 24 | 42(2) | 7(100) | (90) | 2(2) |
| Comp. Ex. 6 | 25 | 42(2) | 8(100) | (90) | 2(2) |
| Comp. Ex. 7 | 26 | 42(2) | 6(100) | (90) | 2(2) |

TABLE 12

| | Toner and binder properties | | | | | | | |
|---|---|---|---|---|---|---|---|---|
| | Magnetic toner No. | D4 (μm) | Av (mgKOH/g) | Molecular weight distribution Mp | Molecular weight distribution ≧$10^5$ % | $THF_{ins.}$ (wt. %) | ΘcA (deg.) | OHv (mgKOH/g) |
| Ex. 15 | 19 | 7.6 | 7 | 14000 | 5.2 | 15 | 123 | 30 |
| 16 | 20 | 7.7 | 37 | 5500 | 14.0 | 55 | 111 | 42 |
| 17 | 21 | 7.4 | 3 | 19000 | 4.0 | 7 | 120 | 43 |
| 18 | 22 | 7.6 | 45 | 3300 | 23.0 | 67 | 111 | 32 |
| 19 | 23 | 7.8 | 11 | 7500 | 3.0 | 4 | 124 | 19 |
| Comp. Ex. 5 | 24 | 7.3 | 1.5 | 21000 | 1.0 | 3 | 118 | 49 |
| 6 | 25 | 7.5 | 55 | 2700 | 27.0 | 75 | 107 | 35 |
| 7 | 26 | 7.6 | 12 | 7400 | 2.5 | 3 | 127 | 19 |

TABLE 13

| | Evaluation results in HT/HH (30° C./80% RH) | | | | | | |
|---|---|---|---|---|---|---|---|
| | Magnetic toner No. | Image density | Fog | Image quality | Fixing member soiling | Image density after-standing | Cleaning performance |
| Ex. 15 | 19 | 1.41–1.43 | 0.3–0.4 | 17–18 | B | 1.35 | A |
| Ex. 16 | 20 | 1.34–1.36 | 0.4–0.5 | 17–18 | A | 1.27 | A |
| Ex. 17 | 21 | 1.42–1.42 | 0.3–0.6 | 17–18 | C | 1.36 | A |
| Ex. 18 | 22 | 1.30–1.32 | 0.7–0.9 | 16–17 | A | 1.23 | A |
| Ex. 19 | 23 | 1.33–1.35 | 0.4–0.7 | 17–18 | C | 1.25 | B |
| Comp. Ex. 5 | 24 | 1.35–1.37 | 0.7–0.8 | 16–17 | D | 1.26 | A |
| Comp. Ex. 6 | 25 | 1.25–1.27 | 0.7–1.6 | 15–15 | A | 1.19 | A |
| Comp. Ex. 7 | 26 | 1.33–1.35 | 0.6–0.9 | 15–16 | D | 1.26 | B |

TABLE 14

| | Evaluation results in NT/NH (23° C./60% RH) | | | | | | |
|---|---|---|---|---|---|---|---|
| | Magnetic toner No. | Image density | Fog | Image quality | Fixing member soiling | Fixing temp. range | Cleaning performance |
| Ex. 15 | 19 | 1.42–1.42 | 0.5–0.6 | 19–20 | B | 135–230 | A |
| Ex. 16 | 20 | 1.39–1.41 | 0.6–0.7 | 18–19 | A | 140–235 | A |
| Ex. 17 | 21 | 1.43–1.43 | 0.8–0.6 | 19–18 | C | 135–225 | A |
| Ex. 18 | 22 | 1.38–1.40 | 0.6–0.9 | 19–18 | A | 145–235 | A |
| Ex. 19 | 23 | 1.40–1.41 | 0.8–0.5 | 18–18 | C | 135–220 | B |
| Comp. Ex. 5 | 24 | 1.36–1.39 | 0.9–0.8 | 18–17 | D | 140–220 | A |
| Comp. Ex. 6 | 25 | 1.32–1.35 | 0.6–0.9 | 18–17 | A | 150–230 | A |
| Comp. Ex. 7 | 26 | 1.41–1.43 | 0.9–1.1 | 18–18 | D | 135–225 | B |

EXAMPLE 20

| | |
|---|---|
| Binder resin 1 | 100 wt. parts |
| Magnetic iron oxide (Dav. = 0.2 μm, Hc = 9.5 kA/m, σs = 65 $Am^2/kg$, σr = 7 $Am^2/kg$) | 90 wt. parts |
| Organic zirconium compound (42) | 2 wt. parts |
| Wax 1 | 5 wt. parts |

The above ingredients were preliminarily blended by a Henschel mixer and then melt-kneaded through a twin-screw kneading extruder ("PCM-30", mfd. by Ikegai Tekkosho K.K.) set at 140° C. During the melt-kneading, the viscosity of the kneaded mixture was increased, whereby the formation of fresh crosslinkage was confirmed.

The thus-kneaded product was cooled, coarsely crushed by a cutter mill and finely pulverized by a pulverizer using a jet air stream, followed by classification by a multi-division classifier utilizing the Coanda effect to form a magnetic toner (toner particles) having D4 of 7.7 μm. To 100 wt. parts of the magnetic toner, 1.0 wt. part of hydrophobic silica fine powder (hydrophobized with 20 wt. % based on starting silica fine powder of hexamethyldisilazane and having a methanol-wettability of 65% and a BET specific surface area of 260 $m^2/g$) and 4.0 wt. parts of strontium titanate fine powder were externally blended to prepare Magnetic toner No. 27.

Magnetic toner No. 1 exhibited D4=7.7 μm and a contact angle to water (θcA) of 103 deg. When a THF-soluble content of Magnetic toner No. 27 was subjected to molecular weight measurement based on a GPC, the THF-soluble content was. found to provide a peak molecular weight (Mp) of 7,450 and a component having molecular weights of at least $5\times10^5$ ($\geqq10^5$%) of 7.3%. Further, Binder resin 27 used in Magnetic toner No. 1 exhibited an acid value (Av) of 26 mgKOH/g, a THF-insoluble content (THFins.) of 33 wt. % and a hydroxyl value (OHv) of 36 mgKOH/g.

These properties of Magnetic toner No. 27 and Binder resin 1 are shown in Table 16 appearing hereinafter.

Magnetic toner No. 27 was evaluated in the same manner as in Example 1 in the NT/NH (23° C./60% RH) environment.

As a result it was possible to obtain high-definition images having a high image density and free from fog.

When the fixing member soiling was observed, a slight spot-like toner soiling was present at a portion of the fixing film, thus resulting in no soiling of the fixed images.

The results are shown in Table 17.

TABLE 15

Toner prescriptions

| | Magnetic toner Nos. | Organic metal compound (wt. parts) | Binder resin (wt. parts) | Magnetic ion oxide (wt. parts) | Wax (wt. parts) |
|---|---|---|---|---|---|
| Ex. 20 | 27 | 42(2) | 1(100) | (90) | 1(2) |
| Ex. 21 | 28 | 42(2) | 1(100) | (90) | 3(2) |
| Ex. 22 | 29 | 42(2) | 1(100) | (90) | 4(2) |
| Ex. 23 | 30 | 42(2) | 1(100) | (90) | 5(2) |
| Ex. 24 | 31 | 42(2) | 1(100) | (90) | 7(2) |
| Ex. 25 | 32 | 42(2) | 1(100) | (90) | 8(2) |

TABLE 16

Toner and binder properties

| | Magnetic toner No. | D4 (μm) | Av (mgKOH/g) | Molecular weight distribution Mp | Molecular weight distribution $\geqq10^5$ % | $THF_{ins.}$ (wt. &) | ΘcA (deg.) | OHv (mgKOH/g) |
|---|---|---|---|---|---|---|---|---|
| Ex. 20 | 27 | 7.7 | 26 | 7450 | 7.3 | 33 | 103 | 36 |
| 21 | 28 | 7.8 | 26 | 7500 | 7.4 | 29 | 125 | 36 |
| 22 | 29 | 7.6 | 26 | 7550 | 7.5 | 28 | 96 | 36 |
| 23 | 30 | 7.8 | 27 | 7500 | 7.4 | 31 | 128 | 36 |
| 24 | 31 | 7.3 | 26 | 7500 | 7.2 | 30 | 92 | 36 |
| 25 | 32 | 7.6 | 26 | 7550 | 7.6 | 29 | 134 | 36 |

TABLE 17

Evaluation results in NT/NH (23° C./60% RH)

| | Magnetic toner No. | Image density | Fog | Image quality | Fixing member soiling | Fixing temp. range | Cleaning performance |
|---|---|---|---|---|---|---|---|
| Ex. 20 | 27 | 1.42–1.43 | 0.6–0.6 | 20–19 | B | 135–230 | A |
| Ex. 21 | 28 | 1.43–1.43 | 0.7–1.0 | 19–20 | A | 140–235 | B |
| Ex. 22 | 29 | 1.43–1.43 | 0.6–0.5 | 19–19 | C | 130–225 | A |
| Ex. 23 | 30 | 1.43–1.43 | 0.8–1.5 | 18–19 | A | 140–235 | C |
| Ex. 24 | 31 | 1.40–1.41 | 0.8–0.6 | 19–18 | C | 135–220 | A |
| Ex. 25 | 32 | 1.42–1.43 | 1.2–2.5 | 17–16 | A | 155–240 | C |

EXAMPLE 26

| | |
|---|---|
| Binder resin 2 | 100 wt. parts |
| Magnetic iron oxide (Dav. = 0.2 μm, Hc = 9.5 kA/m, σs = 65 $Am^2/kg$, σr = 7 $Am^2/kg$) | 90 wt. parts |
| Organic zirconium compound (43) | 2 wt. parts |
| Wax 2 | 5 wt. parts |

The above ingredients were preliminarily blended by a Henschel mixer and then melt-kneaded through a twin-screw kneading extruder ("PCM-30", mfd. by Ikegai Tekkosho K.K.) set at 140° C. During the melt-kneading, the viscosity of the kneaded mixture was increased, whereby the formation of fresh crosslinkage was confirmed.

The thus-kneaded product was cooled, coarsely crushed by a cutter mill and finely pulverized by a pulverizer using a jet air stream, followed by classification by a multi-division classifier utilizing the Coanda effect to form a magnetic toner (toner particles) having D4 of 8.5 μm. To 100 wt. parts of the magnetic toner, 1.0 wt. part of hydrophobic silica fine powder (hydrophobized with 20 wt. % based on starting silica fine powder of hexamethyldisilazane and having a methanol-wettability of 65% and a BET specific surface area of 260 $m^2/g$) and 4.0 wt. parts of strontium titanate fine powder were externally blended to prepare Magnetic toner No. 33.

Magnetic toner No. 33 exhibited D4=8.5 μm and a contact angle to water (θcA) of 119 deg. When a THF-soluble content of Magnetic toner No. 33 was subjected to molecular weight measurement based on a GPC, the THF-soluble content was found to provide a peak molecular weight (Mp) of 7,450 and a component having molecular weights of at least $5\times10^5$ ($\geqq10^5$%) of 7.4%. Further, Binder resin 2 used in Magnetic toner No. 33 exhibited an acid value (Av) of 25 mgKOH/g, a THF-insoluble content ($THF_{ins.}$) of 27 wt. % and a hydroxyl value (OHv) of 36 mgKOH/g.

These properties of Magnetic toner No. 33 and Binder resin 1 are shown in Table 19 appearing hereinafter.

Magnetic toner No. 33 was evaluated by using a commercially available electrophotographic copying machine having a corona charging means ("NP-6350", mfd. by Canon K.K.) after remodeling for equipping a developing sleeve prepared by coating a sleeve substrate with a resinous coating layer (phenolic resin:graphite=3:1 by weight) and a magnetic regulating blade disposed perpendicular to the developing sleeve with a gap therebetween of 240 μm for continuous copying on 50,000 sheets in three environments including a normal temperature/low humidity (NT/LH) environment (23° C./5% RH), a high temperature/high humidity (HT/HH) environment (30° C./80% RH), and a normal temperature/normal humidity (NT/NH) environment (23° C./60% RH), respectively. The test was performed while removing the cleaning web contacting the pressure roller of the fixing device. The transfer paper was A4-sized recycled paper (filler content=15% (as ash content), basis weight=66 $g/m^2$, used paper utilization=50%).

As a result, it was possible to obtain high-definition images having a high image density and free from fog in all the environments. When the surfaces of the fixing members (e.g., fixing film and pressure roller) were observed, toner deposition soiling due to the filler contained in the transfer paper and fixed image soiling were not found at all. Further, as a result of observation of the photosensitive member surface, no filming occurred. Evaluation of Magnetic toner No. 33 was performed in the same manner as in Example.

The results are shown in Tables 20, 21 and 22.

TABLE 18

| | Toner prescriptions | | | | |
|---|---|---|---|---|---|
| | Magnetic toner Nos. | Organic metal compound (wt. parts) | Binder resin (wt. parts) | Magnetic ion oxide (wt. parts) | Wax (wt. parts) |
| Ex. 26 | 33 | 43(2) | 1(100) | (90) | 2(2) |
| Ex. 27 | 34 | 68(2) | 1(100) | (90) | 2(2) |
| Ex. 28 | 35 | 93(2) | 1(100) | (90) | 2(2) |
| Ex. 29 | 36 | 53(2) | 1(100) | (90) | 2(2) |
| Ex. 30 | 37 | 102(2) | 1(100) | (90) | 2(2) |
| Ex. 31 | 38 | 125(2) | 1(100) | (90) | 2(2) |
| Ex. 32 | 39 | 145(2) | 1(100) | (90) | 2(2) |
| Ex. 33 | 40 | 55(2) | 1(100) | (90) | 2(2) |
| Ex. 34 | 41 | 78(2) | 1(100) | (90) | 2(2) |
| Ex. 35 | 42 | 61(2) | 1(100) | (90) | 2(2) |
| Ex. 36 | 43 | 104(2) | 1(100) | (90) | 2(2) |
| Comp. | | | | | |
| Ex. 8 | 44 | 176(2) | 1(100) | (90) | 2(2) |
| Ex. 9 | 45 | 177(2) | 1(100) | (90) | 2(2) |
| Ex. 10 | 46 | 178(2) | 1(100) | (90) | 2(2) |
| Ex. 11 | 47 | 179(2) | 1(100) | (90) | 2(2) |

TABLE 19

| | Toner and binder properties | | | | | | | |
|---|---|---|---|---|---|---|---|---|
| | Magnetic toner No. | D4 (μm) | Av (mgKOH/g) | Molecular weight distribution Mp | Molecular weight distribution $\geqq10^5$ % | $THF_{ins.}$ (wt. %) | ΘcA (deg.) | OHv (mgKOH/g) |
| Ex. 26 | 33 | 8.5 | 25 | 7450 | 7.4 | 27 | 119 | 36 |
| 27 | 34 | 8.3 | 26 | 7500 | 7.2 | 30 | 116 | 36 |
| 28 | 35 | 8.6 | 26 | 7550 | 7.6 | 29 | 118 | 36 |
| 29 | 36 | 8.8 | 26 | 7500 | 7.2 | 32 | 115 | 36 |
| 30 | 37 | 8.6 | 26 | 7550 | 7.5 | 28 | 118 | 36 |
| 31 | 38 | 8.8 | 26 | 7500 | 7.4 | 29 | 117 | 36 |
| 32 | 39 | 8.8 | 27 | 7500 | 7.4 | 31 | 115 | 36 |
| 33 | 40 | 8.5 | 27 | 7550 | 7.4 | 33 | 117 | 36 |
| 34 | 41 | 8.6 | 27 | 7500 | 7.1 | 28 | 116 | 36 |
| 35 | 42 | 8.5 | 25 | 7550 | 7.7 | 29 | 118 | 36 |
| 36 | 43 | 8.6 | 25 | 7450 | 7.5 | 31 | 116 | 36 |
| Comp Ex. 8 | 44 | 8.5 | 27 | 7500 | 2.4 | 7 | 97 | 35 |
| Comp Ex. 9 | 45 | 8.4 | 27 | 7450 | 2.6 | 8 | 99 | 35 |

TABLE 19-continued

| | Toner and binder properties | | | | | | | |
|---|---|---|---|---|---|---|---|---|
| | Magnetic toner No. | D4 (μm) | Av (mgKOH/g) | Molecular weight distribution Mp | Molecular weight distribution ≧$10^5$ % | $THF_{ins.}$ (wt. %) | ΘcA (deg.) | OHv (mgKOH/g) |
| Comp Ex. 10 | 46 | 8.5 | 27 | 7450 | 5.5 | 23 | 111 | 32 |
| Comp Ex. 11 | 47 | 8.6 | 28 | 7350 | 1.0 | 3 | 92 | 36 |

TABLE 20

Evaluation results in NT/LH (23° C./5 % RH)

| | Magnetic toner No. | Image density | Fog | Image quality | Fixing member soiling | Image defect | Cleaning performance |
|---|---|---|---|---|---|---|---|
| Ex. 26 | 33 | 1.37–1.40 | 0.5–0.9 | 16–19 | A | A | A |
| Ex. 27 | 34 | 1.34–1.35 | 0.7–0.9 | 16–18 | A | B | A |
| Ex. 28 | 35 | 1.41–1.46 | 0.5–0.9 | 17–19 | A | B | A |
| Ex. 29 | 36 | 1.36–1.40 | 0.6–0.8 | 17–18 | A | A | A |
| Ex. 30 | 37 | 1.38–1.43 | 0.6–0.7 | 17–18 | A | A | A |
| Ex. 31 | 38 | 1.39–1.42 | 0.6–0.9 | 17–19 | A | A | A |
| Ex. 32 | 39 | 1.38–1.41 | 0.6–0.7 | 17–18 | A | A | A |
| Ex. 33 | 40 | 1.39–1.42 | 0.6–0.8 | 17–18 | A | A | A |
| Ex. 34 | 41 | 1.43–1.45 | 0.5–0.6 | 17–19 | A | A | A |
| Ex. 35 | 42 | 1.43–1.46 | 0.4–0.6 | 17–19 | A | A | A |
| Ex. 36 | 43 | 1.37–1.39 | 0.6–0.9 | 17–18 | A | A | A |
| Comp. | | | | | | | |
| Ex. 8 | 44 | 1.30–1.32 | 0.7–1.2 | 15–17 | B | C | A |
| Ex. 9 | 45 | 1.28–1.31 | 0.6–1.3 | 15–17 | B | C | A |
| Ex. 10 | 46 | 1.30–1.32 | 0.7–1.4 | 16–17 | A | C | A |
| Ex. 11 | 47 | 1.31–1.32 | 0.6–1.2 | 16–17 | C | C | A |

TABLE 21

Evaluation results in HT/HH (30° C./80 % RH)

| | Magnetic toner No. | Image density | Fog | Image quality | Fixing member soiling | Image density after-standing | Cleaning performance |
|---|---|---|---|---|---|---|---|
| Ex. 26 | 33 | 1.35–1.38 | 0.4–0.8 | 16–17 | A | 1.26 | A |
| Ex. 27 | 34 | 1.40–1.41 | 0.7–0.8 | 17–18 | A | 1.34 | A |
| Ex. 28 | 35 | 1.39–1.40 | 0.6–0.8 | 17–18 | A | 1.34 | A |
| Ex. 29 | 36 | 1.37–1.38 | 0.5–0.6 | 17–18 | A | 1.29 | A |
| Ex. 30 | 37 | 1.36–1.38 | 0.5–0.7 | 17–18 | A | 1.27 | A |
| Ex. 31 | 38 | 1.37–1.39 | 0.3–0.5 | 17–18 | A | 1.30 | A |
| Ex. 32 | 39 | 1.36–1.40 | 0.4–0.5 | 17–18 | A | 1.30 | A |
| Ex. 33 | 40 | 1.33–1.37 | 0.3–0.6 | 17–18 | A | 1.28 | A |
| Ex. 34 | 41 | 1.39–1.41 | 0.4–0.8 | 17–18 | A | 1.34 | A |
| Ex. 35 | 42 | 1.33–1.35 | 0.4–0.7 | 17–18 | A | 1.25 | A |
| Ex. 36 | 43 | 1.34–1.37 | 0.7–0.8 | 16–17 | A | 1.29 | A |
| Comp. | | | | | | | |
| Ex. 8 | 44 | 1.26–1.31 | 0.6–1.3 | 15–16 | B | 1.11 | A |
| Ex. 9 | 45 | 1.27–1.31 | 0.6–1.3 | 15–16 | B | 1.12 | A |
| Ex. 10 | 46 | 1.27–1.30 | 0.6–1.5 | 15–15 | A | 1.13 | A |
| Ex. 11 | 47 | 1.27–1.30 | 0.6–1.7 | 15–15 | C | 1.10 | A |

TABLE 22

Evaluation results in NT/NH (23° C./60 % RH)

| | Magnetic toner No. | Image density | Fog | Image quality | Fixing member soiling | Fixing temp. range | Cleaning performance |
|---|---|---|---|---|---|---|---|
| Ex. 26 | 33 | 1.37–1.36 | 0.8–0.9 | 18–17 | A | 135–235 | A |
| Ex. 27 | 34 | 1.43–1.43 | 0.5–0.5 | 20–19 | A | 130–230 | A |
| Ex. 28 | 35 | 1.42–1.42 | 0.4–0.6 | 20–19 | A | 135–235 | A |
| Ex. 29 | 36 | 1.43–1.43 | 0.5–0.5 | 19–20 | A | 140–240 | A |
| Ex. 30 | 37 | 1.42–1.43 | 0.6–0.5 | 20–19 | A | 135–235 | A |
| Ex. 31 | 38 | 1.39–1.41 | 0.6–0.7 | 18–19 | A | 135–235 | A |
| Ex. 32 | 39 | 1.40–1.41 | 0.8–0.6 | 19–18 | A | 140–240 | A |
| Ex. 33 | 40 | 1.36–1.40 | 0.6–0.9 | 19–18 | A | 140–240 | A |
| Ex. 34 | 41 | 1.41–1.41 | 0.8–0.5 | 18–18 | A | 135–235 | A |
| Ex. 35 | 42 | 1.33–1.39 | 0.9–0.8 | 18–17 | A | 135–235 | A |
| Ex. 36 | 43 | 1.36–1.39 | 0.8–0.7 | 17–18 | A | 130–230 | A |
| Comp. | | | | | | | |
| Ex. 8 | 44 | 1.26–1.30 | 1.0–1.1 | 17–16 | B | 135–220 | A |
| Ex. 9 | 45 | 1.27–1.32 | 1.1–1.2 | 18–16 | B | 135–220 | A |
| Ex. 10 | 46 | 1.25–1.31 | 0.9–1.1 | 17–16 | A | 140–230 | A |
| Ex. 11 | 47 | 1.26–1.31 | 1.0–1.1 | 17–16 | C | 135–210 | A |

RESIN PRODUCTION EXAMPLE A

| (1) Production of Polyester Resin | |
|---|---|
| Terephthalic acid | 6.0 mol |
| Succinic acid derivative of Formula (f-3) | 4.0 mol |
| Trimellitic anhydride | 3.0 mol |
| PO-BPA | 7.2 mol |
| EO-BPA | 3.0 mol |

The above polyester monomers were charged together with an esterification catalyst in an autoclave equipped with a vacuum device, a water separator, a nitrogen gas introduction device, a temperature detector and a stirring device. Then, while the system pressure was gradually lowered under a nitrogen gas atmosphere in an ordinary manner, the monomers were heated to 210° C. to effect polycondensation, thereby providing a polyester resin.

(2) Production of Hybrid Resin Component 80 wt. parts of the above-prepared polyester resin was added in 100 wt. parts xylene for dissolution and swelling. To the mixture, 15 wt. parts of styrene, 5 wt. parts of 2-ethylhexyl acrylate and 0.1 wt. part of dibutyltin oxide (esterification catalyst) were added, followed by heating to refluxing temperature of xylene to initiate transesterification between a carboxylic acid portion of the polyester resin and acrylate. Into the system, a solution of 1 wt. part of t-butylhydroperoxide (radical polymerization initiator) in 30 wt. parts of xylene was added dropwise in ca. 1 hour. The system was held at the xylene refluxing temperature for further 6 hours to complete the radical polymerization. The system was further heated to 210° C. under reduced pressure for solvent removal to complete the transesterification, thus obtaining Resin composition (a) comprising a polyester resin, a vinyl polymer resin, and a hybrid resin component comprising a polyester unit and a vinyl polymer unit bonded to the polyester unit via ester linkage.

The thus-obtained Resin composition (a) exhibited an Av of 18.2 mgKOH/g, a Tg of 59.8° C., an Mp of 7,200, an Mw=38,000, an Mw/Mn=13.5, and a $THF_{ins.}$ of 15.1 wt. %.

Resin composition (a) and its THF-soluble content were subjected to measurement of $^{13}$C-NMR spectrum.

As a result, the hybrid resin component was detected from Resin composition (a) but was not detected from the THF-soluble content. Thus, it was confirmed that the hybrid resin component was contained in Resin composition (a) in a form of a THF-insoluble content.

RESIN PRODUCTION EXAMPLES B–N

Resin compositions (b) to (n) each containing a hybrid resin component were prepared in the same manner as in Resin Production Example A except that in the step of producing the hybrid resin component, waxes shown in Table 23 were added in proportions indicated in Table 24, respectively.

RESIN PRODUCTION EXAMPLE O

Resin composition (o) containing a hybrid resin component was prepared in the same manner as in Resin Production Example A except that the following polyester monomers were used in the indicated proportions and 7 wt. parts of Wax (c) shown in Table 23.

| | |
|---|---|
| Terephthalic acid | 6.0 mol |
| Succinic acid derivative of Formula (f-3) | 4.0 mol |
| Trimellitic anhydride | 5.0 mol |
| PO-BPA | 7.0 mol |
| EO-BPA | 3.0 mol |

The thus-obtained Resin composition (o) exhibited an Av of 43.6 mgKOH/g, a Tg of 58.9° C., an Mp of 3,600, an Mw=12,000, an Mw/Mn=10.5, and a $THF_{ins.}$ of 5.4 wt. %.

Resin composition (o) and its THF-soluble content were subjected to measurement of $^{13}$C-NMR spectrum.

As a result, the hybrid resin component was detected from Resin composition (o) but was not detected from the THF-soluble content. Thus, it was confirmed that the hybrid resin component was contained in Resin composition (o) in a form of a THF-insoluble content.

RESIN PRODUCTION EXAMPLES P–S

Resin compositions (p)–(s) each containing a hybrid resin component were prepared in the same manner as in Resin Production Example A except that the following polyester monomers were used in the indicated proportions and waxes shown in Table 23 were added in proportions indicated in Table 25, respectively.

| | |
|---|---|
| Terephthalic acid | 6.0 mol |
| Succinic acid derivative of Formula (f-3) | 4.0 mol |
| Trimellitic anhydride | 5.0 mol |
| PO-BPA | 7.0 mol |
| EO-BPA | 3.0 mol |

The thus-obtained Resin composition (p) exhibited an Av of 32.7 mgKOH/g, a Tg of 59.3° C., an Mp of 6,200, an Mw=29,000, an Mw/Mn=11.9, and a $THF_{ins.}$ of 13.7 wt. %.

Resin composition (p) and its THF-soluble content were subjected to measurement of $^{13}$C-NMR spectrum.

As a result, the hybrid resin component was detected from Resin composition (p) but was not detected from the THF-soluble content. Thus, it was confirmed that the hybrid resin component was contained in Resin composition (p) in a form of a THF-insoluble content.

COMPARATIVE RESIN PRODUCTION EXAMPLE T (1) Production of Polyester Resin

| | |
|---|---|
| Terephthalic acid | 8.0 mol |
| Trimellitic anhydride | 3.0 mol |
| PO-BPA | 5.0 mol |
| EO-BPA | 5.0 mol |

The above polyester monomers were charged together with an esterification catalyst in an autoclave equipped with a vacuum device, a water separator, a nitrogen gas introduction device, a temperature detector and a stirring device. Then, while the system pressure was gradually lowered under a nitrogen gas atmosphere in an ordinary manner the monomers were heated to 210° C. to effect polycondensation, thereby providing a polyester resin.

(2) Production of Mixture of Vinyl Polymer and Polyester Resin 15 wt. parts of styrene, 5 wt. parts of 2-ethylhexyl acrylate were added in 100 wt. parts xylene, followed by heating to refluxing temperature of xylene under a nitrogen gas atmosphere. Into the system, a solution of 1 wt. part of t-butylhydroperoxide (radical polymerization initiator) in 50 wt. parts of xylene was added dropwise in ca. 1 hour. The system was held at the xylene refluxing temperature for further 8 hours to complete the radical polymerization. To the system, 80 wt. parts of the above-prepared polyester resin was added for dissolution, followed by distilling-off of xylene under reduced pressure, thus obtaining Comparative resin composition (t) comprising a mixture of a polyester resin and a vinyl polymer.

The thus-obtained Comparative resin composition (t) exhibited an Av of 52.7 mgKOH/g, a Tg of 59.9° C., an Mp of 6,200, an Mw=28,000, an Mw/Mn=6.5, and a $THF_{ins.}$ of at most 1 wt. %.

Comparative resin composition (t) was subjected to measurement of $^{13}$C-NMR spectrum.

As a result, it was confirmed that the hybrid resin component was not contained in Comparative resin composition (t).

COMPARATIVE RESIN PRODUCTION EXAMPLE U AND V

Comparative resin compositions (u) and (v) were prepared in the same manner as in Comparative Resin Production Example T except thath in the step of mixing the polyester resin and the vinyl polymer, reference waxes shown in Table 23 were added in proportions indicated in Table 25, respectively.

COMPARATIVE RESIN PRODUCTION EXAMPLE W

Into an autoclave equipped with a vacuum device, a water separator, a nitrogen gas introduction device, a temperature detector and a stirring device, 200 wt. parts of styrene/2-ethylhexyl acrylate (84/16 by weight) copolymer (Mw=8,000, Mw/Mn=2.7), polyester monomers shown below and 2 wt. parts of dibutyltin oxide were added. Then, while the system pressure was lowered under a nitrogen gas atmosphere in an ordinary manner, the system was heated to 200° C. to effect polycondensation reaction, whereby Comparative resin composition (w) prepared.

| | |
|---|---|
| Terephthalic acid | 249 wt. parts |
| Trimellitic acid | 29 wt. parts |
| EO-BPA | 195 wt. parts |
| PO-BPA | 840 wt. parts |

The thus-obtained Comparative resin composition (w) exhibited an Av of 1.2 mgKOH/g, a Tg of 60.1° C., an Mp of 20,800, an Mw=45,000, an Mw/Mn=6.3, and a $THF_{ins.}$ of at most 1 wt. %.

Comparative resin composition (w) was subjected to measurement of $^{13}$C-NMR spectrum.

As a result, it was confirmed that the hybrid resin component was not contained in Comparative resin composition (w).

COMPARATIVE RESIN PRODUCTION EXAMPLES X AND Y

Comparative resin compositions (x) and (y) were prepared in the same manner as in Comparative Resin Production Example W except that reference waxes shown in Table 23 were added in the polycondensation step in proportions indicated in Table 25, respectively.

Properties and compositions of the abovementioned Resin compositions (and Comparative resin compositions) (a) to (y) prepared in Resin Production Examples A–S and Comparative Resin Production Examples T–Y are summarized in Tables 24 and 25.

The waxes and their properties used in respective production examples are shown in Table 23.

TABLE 23

Waxes

| Wax | Species | Mp | Mw/Mn | Main absorption peak temp. |
|---|---|---|---|---|
| (a) | Hydrocarbon wax | 520 | 1.3 | 85 (° C.) |
| (b) | Wax of formula (I) (A = hydroxyl) | 770 | 1.8 | 112 |
| (c) | Hydrocarbon wax | 940 | 1.7 | 107 |
| (d) | Maleic acid-modified polypropylene wax | 2800 | 6.6 | 121 |
| (e) | Polypropylene wax | 3000 | 8.9 | 133 |
| (reference) (f) | Polyethylene wax | — | — | 90 |
| (reference) (g) | Styrene-modified Polyethylene wax | — | — | 125 |
| (reference) (h) | Hydrocarbon wax | 283 | 1.03 | 36 |
| (reference) (i) | polypropylene wax | 5670 | 24 | 143 |

TABLE 24

Resin Compositions and Comparative Resin Compositions

| Resin production Ex. | Resin composition | Mp | ≧$10^5$ (%) | Tg (° C.) | Av (mgKOH/g) | Wax species | Wax addition amount (wt. parts) |
|---|---|---|---|---|---|---|---|
| A | (a) | 7200 | 7.1 | 58.9 | 18.2 | — | — |
| B | (b) | 7300 | 7.3 | 60.2 | 18.1 | (c) | 7 |
| C | (c) | 7300 | 7.1 | 60.4 | 17.9 | (d) | 7 |
| D | (d) | 7400 | 7.5 | 58.8 | 17.8 | (e) | 7 |
| E | (e) | 6900 | 7.0 | 59.3 | 18.6 | (a) | 3 |
| | | | | | | (b) | 4 |
| F | (f) | 7100 | 7.1 | 59.5 | 18.4 | (a) | 3 |
| | | | | | | (c) | 4 |
| G | (g) | 7200 | 7.1 | 59.6 | 18.3 | (a) | 3 |
| | | | | | | (d) | 4 |
| H | (h) | 7300 | 7.2 | 59.7 | 18.2 | (a) | 3 |
| | | | | | | (e) | 4 |
| I | (i) | 7200 | 7.1 | 59.7 | 17.7 | (b) | 3 |
| | | | | | | (c) | 4 |
| J | (j) | 7300 | 7.1 | 59.8 | 18.2 | (b) | 3 |
| | | | | | | (d) | 4 |
| K | (k) | 7300 | 7.1 | 59.8 | 18.2 | (b) | 3 |
| | | | | | | (e) | 4 |
| L | (l) | 7300 | 7.1 | 60.3 | 17.9 | (c) | 3 |
| | | | | | | (d) | 4 |
| M | (m) | 7400 | 7.5 | 60.4 | 17.9 | (c) | 3 |
| | | | | | | (e) | 4 |
| N | (n) | 7400 | 7.4 | 60.4 | 18.2 | (d) | 3 |
| | | | | | | (e) | 4 |

TABLE 25

Resin Compositions and Comparative Resin Compositions

| Resin production Ex. | Resin composition | Mp | ≧$10^5$ (%) | Tg (° C.) | Av (mgKOH/g) | Wax species | Wax addition amount (wt. parts) |
|---|---|---|---|---|---|---|---|
| O | (o) | 3600 | 3.3 | 58.9 | 43.6 | (c) | 7 |
| P | (p) | 6200 | 5.4 | 59.3 | 32.7 | (c) | 7 |
| Q | (q) | 6300 | 5.3 | 59.1 | 32.6 | (a) | 3 |
| | | | | | | (c) | 4 |
| R | (r) | 6300 | 5.2 | 59.2 | 33.0 | (b) | 3 |
| | | | | | | (c) | 4 |
| S | (s) | 17300 | 24.2 | 61.2 | 4.6 | (c) | 7 |

TABLE 25-continued

Resin Compositions and Comparative Resin Compositions

| Resin production Ex. | Resin composition | Mp | ≧$10^5$ (%) | Tg (° C.) | Av (mgKOH/g) | Wax species | Wax addition amount (wt. parts) |
|---|---|---|---|---|---|---|---|
| Comp. | Comp. | | | | | | |
| T | (t) | 2800 | 1.7 | 59.9 | 52.7 | — | — |
| U | (u) | 2700 | 1.5 | 59.4 | 53.3 | (f) | 7 |
| V | (v) | 2800 | 1.8 | 60.2 | 51.9 | (g) | 7 |
| W | (w) | 21300 | 28.6 | 60.1 | 1.2 | — | — |
| X | (x) | 21200 | 28.5 | 60.0 | 1.3 | (f) | 7 |
| Y | (y) | 21000 | 27.9 | 60.4 | 1.0 | (g) | 7 |

EXAMPLE 37

| | |
|---|---|
| Resin composition (a) | 100 wt. parts |
| Organic zirconium compound (164) | 1 wt. parts |
| Iron-containing charge control agent | 2 wt. parts |
| Wax (c) | 7 wt. parts |
| Magnetic iron oxide (Dav. = 0.18 $\mu$m, Hc = 10.7 kA/n, $\sigma_s$ = 11.2 $Am^2/kg$, $\sigma_r$ = 81.5 $Am^2/kg$) | 100 wt. parts |

The above mixture was melt-kneaded through a twin-screw extruder heated at 130° C., and after being cooled, was coarsely crushed by a hammer mill, followed by fine pulverization by a jet mill and classification by a pneumatic classifier, to obtain a magnetic toner (toner particles) having a D4 of 7.3 $\mu$m.

In the magnetic toner, a THF-insoluble content of the binder resin was 11 wt. % based on the resin composition (converted by excluding the influence of the co-present wax). Further, the binder resin (contained in the magnetic toner) exhibited an Av of 17.4 mgKOH/g which was a value converted by excluding the influence of the magnetic iron oxide and the wax.

The magnetic toner exhibits a θcA of 106 deg.

In the above-prepared magnetic toner, the presence of a hybrid resin component comprising a polyester unit and a vinyl polymer unit in Resin composition (a) (binder resin) can be confirmed by the presence of a newly found ester bond in its $^{13}$C-NMR spectrum as shown in FIG. 8 and $^{13}$C-NMR results shown in Table 26. As a result of the $^{13}$C-NMR measurement, it was determined that ca. 16 mol. % of 2-ethylhexyl acrylate contained in the vinyl polymer unit were transesterified with the polyester unit to form a hybrid resin component.

The $^{13}$C-NMR measurement results are summarized in the following Table 26, wherein "o" represents the presence and "–" represents the absence.

TABLE 26

$^{13}$C-NMR results

| | | Signals for | | | |
|---|---|---|---|---|---|
| | | Newly found | Carboxyl group in succinic acid derivative | | Carboxyl group in acrylate ester copolymer |
| Sample | FIG. | at ca. 168 ppm | ca. 172 ppm | ca. 174 ppm | ca. 176 ppm |
| Low-crosslinked polyester resin | FIG. 6 | — | ○ | ○ | — |
| Styrene-2-ethyl hexyl copolymer | FIG. 7 | — | — | — | ○ |
| Binder resin | FIG. 8 | ○ | ○ | ○ | ○ |

100 wt. parts of the magnetic toner was blended with 1.0 wt. part of externally added hydrophobic dry-process silica (SBET (BET specific surface area)=200 $m^2/g$) by a Henschel mixer to obtain Magnetic toner No. 48. The thus-obtained Magnetic toner No. 48 was subjected to a continuous image forming test on 50,000 sheets by using a digital copying machine ("GP-215", mfd. by Canon K.K.) and copying machines ("NP-6650"and "NP-6085", both mfd. by Canon K.K.) each remodeled so as to remove a cleaning member from the fixing device to evaluate image forming characteristic (image density) and cleaning performance for the toner on the photosensitive member in the same manner as in Example 1, whereby good image forming and cleaning performances as shown in Table 29 were obtained.

Further, a fixing test was performed at varying fixing temperatures by using test apparatus obtained by taking out the fixing devices of the copying apparatus ("GP-215", "NP-6650", and "NP-6085") and attaching thereto an external drive and a temperature controller, whereby good fixing performances as shown in Table 30 were obtained.

Toner fixability shown in Table 30 was evaluated with respect to image density lowering percentage (IDLP) and occurrence of hot offset (HO, i.e., high temperature-offset) and occurrence of toner soiling (TS) of the fixing member according to the following methods.

(Low-temperature fixability for "GP-215")

The low-temperature fixability was evaluated as an image density lowering percentage (IDLP) after rubbing a fixed solid black image having an image density of 1.3–1.4 with a paper ("Dasper", mfd. by Ozu Sangyo K.K.), relative to the image density before the rubbing. The fixing of the solid black image was performed by using a fixing device set at 150° C. A: IDLP of below 5%.

B: IDLP of at least 5% and below 10%.

C: IDLP of at least 10% and below 15%.

D: IDLP of at least 15% and below 20%.

E: IDLP of at least 20%.

(Low-temperature fixability for "GP-6650" and "GP-6085")

The low-temperature fixability was evaluated in the same manner as in the case of "GP-215" except for changing the fixing temperature (150° C.) to 180° C.

(Hot offset)

The hot offset (HO) was evaluated according to the following standard.

A: No hot offset occurred.

B: Slight hot offset occurred but at a practically acceptable level.

C: Hot offset readily recognized by eye observation occurred.

D: Remarkable hot offset occurred.

E: The transfer paper was wound about the fixing roller due to hot offset.

(Toner soiling)

The toner soiling (TS) of the fixing device was evaluated by a degree of soiling of heating members (e.g. heat-resistant film, heating roller and pressure roller) by toner particles according to the following standard.

A: No toner soiling was observed.

B: Slight toner soiling was observed but at a practically acceptable level.

C: Toner soiling was readily observed by eyes.

D: Remarkable toner soiling was observed.

E: Soiling toner particles was attached to the front and/or back surface of the transfer paper.

The above-prepared Magnetic toner No. 48 was also evaluated as to a wax dispersibility (WD) within toner particles in the following manner according to the present invention.

(Wax dispersibility)

A sample toner was observed through an optical microscope equipped with a polarizing plate at a relatively low magnification (e.g., 30–100) to count the number of bright spots indicating the presence of (free) wax particles liberated from toner in a region including ca. 500 toner particles.

A: No bright spots.

B: 1–10 bright spots (at a practically acceptable level).

C: 11–20 bright spots (at a level of increased fog density on fixed images).

D: 21–30 bright spots (at a level of wax-sticking onto the photosensitive member).

E: 31 or more bright spots (at a level of wax and toner-sticking onto the photosensitive member).

EXAMPLES 38–64

Magnetic toners Nos. 49–75 were prepared and evaluated in the same manner as in Example 37 except that combinations of resin compositions and waxes shown in Tables 24 and 25, respectively, were used.

The results are shown in Tables 27–30.

COMPARATIVE EXAMPLES 12–17

Magnetic toners Nos. 76–81 were prepared and evaluated in the same manner as in Example 37 except that Comparative resin compositions (t) to (y) shown in Table 25 were used, respectively.

The results are shown in Tables 28–30.

TABLE 27

| Toner prescriptions and properties | | | | | | | | | | | |
|---|---|---|---|---|---|---|---|---|---|---|---|
| Ex. | Magnetic toner | Resin compo- | Org. Zr comp. | | THF-soluble content | | $THF_{ins.}$ (binder) | Wax molecular weight | | ΘcA | Av |
| No. | No. | sition | No. | Wt. parts | Mp | $\geqq 10^5$ % | (wt. %) | Mp | Mw/Mn | (deg.) | (mgKOH/g) |
| 37 | 48 | (a) | 164 | 2 | 6900 | 6.4 | 28.2 | 940 | 1.7 | 106 | 17.4 |
| 38 | 49 | (b) | 164 | 2 | 6800 | 6.3 | 30.3 | 940 | 1.7 | 113 | 17.1 |
| 39 | 50 | (c) | 42 | 2 | 7100 | 6.6 | 19.2 | 940 | 1.7 | 107 | 17.6 |
| 40 | 51 | (d) | 166 | 2 | 6900 | 6.5 | 33.1 | 940 | 1.7 | 111 | 16.9 |
| 41 | 52 | (e) | 171 | 2 | 7000 | 6.5 | 27.6 | 940 | 1.7 | 110 | 17.4 |
| 42 | 53 | (f) | 164 | 2 | 7000 | 6.5 | 21.4 | 940 | 1.7 | 109 | 17.5 |
| 43 | 54 | (g) | 164 | 2 | 6900 | 6.4 | 28.2 | 770 | 1.8 | 118 | 14.2 |
| 44 | 55 | (h) | 164 | 2 | 6800 | 6.5 | 27.6 | 2800 | 6.6 | 118 | 16.0 |
| 45 | 56 | (i) | 164 | 2 | 7100 | 6.5 | 28.9 | 720 | 2.0 | 108 | 17.7 |
| 46 | 57 | (j) | 164 | 2 | 7000 | 6.6 | 31.4 | 460 | 1.8 | 111 | 17.0 |
| 47 | 58 | (k) | 164 | 2 | 7100 | 6.5 | 29.5 | 460 | 9.2 | 113 | 17.3 |
| 48 | 59 | (1) | 164 | 2 | 7100 | 6.4 | 29.3 | 450 | 12.8 | 114 | 17.1 |
| 49 | 60 | (m) | 164 | 2 | 6900 | 6.5 | 31.0 | 890 | 2.1 | 112 | 17.6 |
| 50 | 61 | (n) | 164 | 2 | 7100 | 6.5 | 28.7 | 730 | 6.2 | 114 | 17.7 |
| 51 | 62 | (o) | 164 | 2 | 7100 | 6.5 | 28.1 | 740 | 11.3 | 115 | 17.8 |
| 52 | 63 | (p) | 164 | 2 | 7100 | 6.5 | 28.6 | 910 | 7.8 | 121 | 17.3 |

TABLE 28

Toner prescriptions and properties

| Ex. No. | Magnetic toner No. | Resin composition | Org. Zr comp. No. | Org. Zr comp. Wt. parts | THF-soluble content Mp | THF-soluble content ≧$10^5$ % | $THF_{ins.}$ (binder) (wt. %) | Wax molecular weight Mp | Wax molecular weight Mw/Mn | ΘcA (deg.) | Av (mgKOH/g) |
|---|---|---|---|---|---|---|---|---|---|---|---|
| 53 | 64 | (m) | 164 | 2 | 7200 | 6.7 | 27.8 | 910 | 13.1 | 123 | 17.9 |
| 54 | 65 | (n) | 164 | 2 | 7100 | 6.6 | 27.4 | 2850 | 9.0 | 127 | 17.5 |
| 55 | 66 | (o) | 164 | 2 | 3500 | 3.5 | 9.2 | 940 | 1.7 | 111 | 41.7 |
| 56 | 67 | (p) | 42 | 2 | 6100 | 5.3 | 15.1 | 940 | 1.7 | 111 | 31.2 |
| 57 | 68 | (p) | 164 | 2 | 6000 | 5.5 | 22.6 | 940 | 1.7 | 113 | 30.3 |
| 58 | 69 | (p) | 166 | 2 | 6100 | 5.4 | 24.1 | 460 | 1.8 | 110 | 29.7 |
| 59 | 70 | (p) | 171 | 2 | 6200 | 5.5 | 16.3 | 890 | 2.1 | 110 | 31.9 |
| 60 | 71 | (p) | 173 | 2 | 5900 | 5.2 | 22.9 | 890 | 2.1 | 112 | 31.4 |
| 61 | 72 | (q) | 164 | 2 | 10800 | 5.4 | 14.6 | 2850 | 9.0 | 120 | 32.6 |
| 62 | 73 | (r) | 164 | 2 | 6100 | 5.1 | 21.3 | 930 | 2.0 | 118 | 31.7 |
| 63 | 74 | (s) | 42 | 2 | 16700 | 17.9 | 43.6 | 940 | 1.7 | 116 | 10.2 |
| 64 | 75 | (s) | 173 | 2 | 16800 | 26.3 | 51.2 | 940 | 1.7 | 117 | 3.4 |
| Comp. | | Comp. | | | | | | | | | |
| 12 | 76 | (t) | 176 | 2 | 2700 | 1.1 | 2.2 | 280 | 1.03 | 88 | 52.2 |
| 13 | 77 | (u) | 176 | 2 | 2700 | 1.0 | 3.3 | 280 | 1.03 | 91 | 52.9 |
| 14 | 78 | (v) | 176 | 2 | 2700 | 1.1 | 3.0 | 5670 | 24.0 | 93 | 51.1 |
| 15 | 79 | (w) | 176 | 2 | 20800 | 27.9 | 72.6 | 280 | 1.03 | 89 | 0.2 |
| 16 | 80 | (x) | 176 | 2 | 21000 | 28.2 | 75.2 | 280 | 1.03 | 92 | 0.3 |
| 17 | 81 | (y) | 176 | 2 | 20900 | 27.4 | 73.3 | 5670 | 24.0 | 133 | 0.3 |

TABLE 29

Evaluation results

| | Image forming performance and cleanability | | | | | | | | |
|---|---|---|---|---|---|---|---|---|---|
| | GP-215 | | | NP-6650 | | | NP-6085 | | |
| Ex. No. | Initial | After 50000 sheets | Cleanability | Initial | After 50000 sheets | Cleanability | Initial | After 5000 sheets | Cleanability |
| 37 | 1.37 | 1.38 | B | 1.36 | 1.36 | B | 1.37 | 1.38 | B |
| 38 | 1.38 | 1.39 | A | 1.40 | 1.41 | A | 1.40 | 1.40 | A |
| 39 | 1.36 | 1.39 | B | 1.38 | 1.38 | B | 1.38 | 1.38 | B |
| 40 | 1.38 | 1.40 | B | 1.39 | 1.40 | A | 1.40 | 1.40 | A |
| 41 | 1.37 | 1.39 | B | 1.39 | 1.39 | A | 1.40 | 1.40 | B |
| 42 | 1.39 | 1.40 | B | 1.40 | 1.39 | A | 1.41 | 1.42 | B |
| 43 | 1.38 | 1.38 | A | 1.38 | 1.38 | A | 1.39 | 1.40 | A |
| 44 | 1.40 | 1.40 | A | 1.41 | 1.40 | A | 1.39 | 1.40 | A |
| 45 | 1.38 | 1.39 | B | 1.41 | 1.40 | B | 1.41 | 1.41 | A |
| 46 | 1.40 | 1.41 | A | 1.41 | 1.41 | A | 1.42 | 1.41 | A |
| 47 | 1.37 | 1.39 | A | 1.38 | 1.41 | A | 1.37 | 1.41 | B |
| 48 | 1.38 | 1.41 | A | 1.39 | 1.42 | A | 1.41 | 1.42 | B |
| 49 | 1.40 | 1.42 | A | 1.41 | 1.42 | B | 1.41 | 1.40 | B |
| 50 | 1.42 | 1.42 | A | 1.39 | 1.40 | A | 1.37 | 1.39 | A |
| 51 | 1.38 | 1.40 | A | 1.42 | 1.42 | A | 1.39 | 1.41 | A |
| 52 | 1.39 | 1.40 | B | 1.38 | 1.40 | A | 1.37 | 1.41 | B |
| 53 | 1.38 | 1.39 | A | 1.40 | 1.41 | A | 1.38 | 1.40 | B |
| 54 | 1.37 | 1.41 | A | 1.41 | 1.40 | A | 1.39 | 1.40 | A |
| 55 | 1.43 | 1.41 | B | 1.42 | 1.38 | B | 1.41 | 1.37 | B |
| 56 | 1.38 | 1.39 | A | 1.39 | 1.40 | A | 1.39 | 1.40 | B |
| 57 | 1.40 | 1.40 | A | 1.40 | 1.41 | A | 1.42 | 1.43 | B |
| 58 | 1.37 | 1.39 | A | 1.39 | 1.40 | A | 1.38 | 1.39 | A |
| 59 | 1.41 | 1.42 | A | 1.40 | 1.41 | A | 1.41 | 1.42 | B |
| 60 | 1.38 | 1.38 | A | 1.41 | 1.42 | A | 1.40 | 1.40 | B |
| 61 | 1.40 | 1.41 | A | 1.40 | 1.40 | A | 1.41 | 1.41 | A |
| 62 | 1.41 | 1.39 | A | 1.39 | 1.40 | B | 1.38 | 1.41 | B |
| 63 | 1.39 | 1.40 | B | 1.41 | 1.40 | B | 1.39 | 1.39 | B |
| 64 | 1.38 | 1.38 | A | 1.38 | 1.39 | A | 1.42 | 1.39 | A |
| Comp. | | | | | | | | | |
| 12 | 0.63 | 0.66 | E | 0.72 | 0.51 | E | 0.62 | 0.43 | E |
| 13 | 0.71 | 0.68 | D | 0.75 | 0.64 | D | 0.71 | 0.57 | D |
| 14 | 0.68 | 0.72 | D | 0.72 | 0.74 | D | 0.65 | 0.71 | D |

TABLE 29-continued

| Ex. No. | Evaluation results: Image forming performance and cleanability — GP-215 Initial | GP-215 After 50000 sheets | GP-215 Clean-ability | NP-6650 Initial | NP-6650 After 50000 sheets | NP-6650 Clean-ability | NP-6085 Initial | NP-6085 After 5000 sheets | NP-6085 Clean-ability |
|---|---|---|---|---|---|---|---|---|---|
| 15 | 0.88 | 0.81 | D | 0.77 | 0.75 | D | 0.72 | 0.73 | D |
| 16 | 0.91 | 0.93 | D | 0.86 | 0.88 | E | 0.78 | 0.73 | E |
| 17 | 0.89 | 0.94 | D | 0.92 | 0.99 | D | 0.87 | 0.93 | D |

TABLE 30

| Ex. No. | Evaluation results: Toner fixability — GP-215 IDLP | GP-215 HO | GP-215 TS | NP-6650 IDLP | NP-6650 HO | NP-6650 TS | NP-6085 IDLP | NP-6085 HO | NP-6085 TS | WD |
|---|---|---|---|---|---|---|---|---|---|---|
| 37 | B | A | B | B | A | B | B | A | B | C |
| 38 | A | A | B | B | A | B | B | A | B | A |
| 39 | A | B | B | A | B | B | A | B | B | B |
| 40 | B | A | B | A | A | B | B | A | B | A |
| 41 | B | A | B | B | A | B | B | B | B | A |
| 42 | A | A | A | B | B | B | B | B | B | A |
| 43 | B | A | A | B | A | A | B | A | A | A |
| 44 | B | A | A | B | A | A | B | A | A | B |
| 45 | B | A | A | B | A | B | B | A | B | B |
| 46 | A | A | A | A | A | A | A | A | B | A |
| 47 | B | A | A | B | A | B | B | A | B | A |
| 48 | B | A | A | B | A | A | B | A | B | A |
| 49 | B | B | A | B | B | B | B | B | B | A |
| 50 | B | B | B | B | B | B | B | B | B | A |
| 51 | B | A | A | B | A | B | B | A | B | A |
| 52 | A | A | A | A | B | B | B | B | B | A |
| 53 | B | A | A | B | A | A | B | A | A | A |
| 54 | B | A | A | B | A | A | B | A | A | A |
| 55 | A | A | A | A | B | A | A | B | A | A |
| 56 | A | B | A | A | B | A | A | B | B | A |
| 57 | A | A | A | A | A | A | A | B | B | A |
| 58 | A | A | A | A | A | A | B | A | A | A |
| 59 | A | A | A | A | A | B | B | A | B | A |
| 60 | B | A | A | B | A | A | B | A | B | B |
| 61 | B | A | A | B | A | A | B | A | A | A |
| 62 | B | A | A | B | A | A | B | A | A | B |
| 63 | B | A | B | B | A | A | B | A | A | A |
| 64 | B | A | A | C | A | A | C | A | A | A |
| Comp. | | | | | | | | | | |
| 12 | D | E | E | D | E | E | D | E | E | E |
| 13 | E | D | D | E | E | D | E | D | D | E |
| 14 | D | E | D | D | E | D | D | E | E | E |
| 15 | D | D | D | D | E | D | E | D | D | D |
| 16 | E | D | D | D | D | E | D | D | D | D |
| 17 | D | D | D | D | D | D | E | D | D | D |

What is claimed is:

1. A toner having a negative triboelectric chargeability, comprising at least a binder resin, a colorant and an organic metal compound; wherein (a) the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids, (b) the binder resin comprises a hybrid resin component comprising a polyester unit and a vinyl polymer unit, (c) the binder resin has an acid value of 2–50 mgKOH/g, and (d) the toner contains a THF (tetrahydrofuran)-soluble content providing a GPC (gel permeation chromatography) chromatogram exhibiting a main peak in a molecular weight range of 3,000–20,000 and including 3–25% of a component having molecular weights of at least $5\times10^5$.

2. The toner according to claim 1, wherein said organic zirconium compound is a zirconium complex comprising a coordination with an aromatic diol, an aromatic hydroxycarboxylic acid or an aromatic polycarboxylic acid.

3. The toner according to claim 1, wherein said organic zirconium compound is a zirconium complex salt comprising a coordination with an aromatic diol, an aromatic hydroxycarboxylic acid or an aromatic polycarboxylic acid.

4. The toner according to claim 1, wherein said organic zirconium compound is a zirconium salt comprising an ionic bonding with an aromatic carboxylic acid, an aromatic hydroxycarboxylic acid or an aromatic polycarboxylic acid.

5. The toner according to claim 1, wherein said organic zirconium compound comprises a structure represented by the following formula (1):

(1)

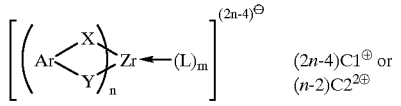

wherein Ar denotes an aromatic residual group optionally substituted with alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; C1 denotes a monovalent cation of hydrogen ion, monovalent metal ion, ammonium ion or alkylammonium ion; C2 denotes a divalent cation of a metal ion; n is 2, 3 or 4; m is 0, 2 or 4; a plurality (n) of ligands of aromatic carboxylic acids and diols can be identical to or different from each other, and a plurality when (m=2 or 4) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2.

6. The toner according to claim 1, wherein said organic zirconium compound comprises a structure represented by the following formula (2):

(2)

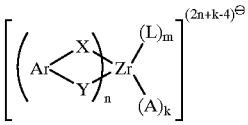

$(2n+k-4)C1^{\oplus}$ or $(n+k/2-2)C2^{2\oplus}$ wherein Ar denotes an aromatic residue group optionally substituted with alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; A denotes an anion of halogen, hydroxyl, carboxylate, carbonate, nitrate, sulfate, cyano or thiocyano, a plurality of A can be identical or different when k≧2; C1 denotes a monovalent cation of hydrogen ion, monovalent metal ion, ammonium ion or alkylammonium ion; C2 denotes a divalent cation of a metal ion; n is 1, 2, 3 or 4; m is 0, 1, 2, 3 or 4; k is 1, 2, 3, 4, 5 or 6; a number (when n≧2) of ligands (of aromatic carboxylic acids and diols) can be identical to or different from each other, and a number (when m≧2) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2, and k is doubled when A is a divalent anion.

7. The toner according to claim 1, wherein said organic zirconium compound comprises a structure represented by the following formula (3), (4) or (5):

(3)

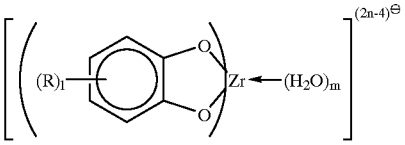

$(2n-4)Cl^{\oplus}$ (4)

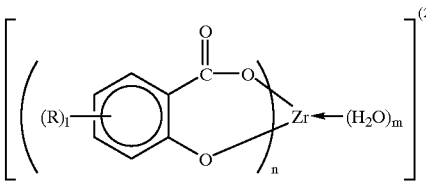

$(2n-4)Cl^{\oplus}$

-continued (5)

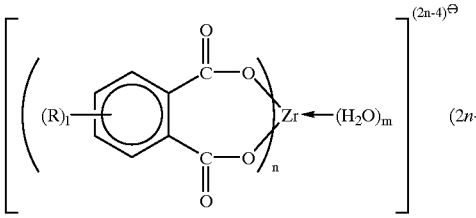

$(2n-4)Cl^{\oplus}$ wherein R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring optionally substituted with 1–8 R groups; a plurality of R can be identical or different; C1 denotes a monovalent cation of hydrogen, alkaline metal, ammonium or alkylammonium; l is an integer of 1–8; n is 2, 3 or 4; m is 0, 2 or 4; a plurity (n) of ligands can be identical or different in each complex or complex salt of a formula; with the proviso that each complex or complex salt of a formula can be a mixture of complex compounds having mutually different n or/and m, or a mixture of complex salts having mutually different counter ions C1.

8. The toner according to claim 1, wherein the organic zirconium compound comprises a structure represented by the following formula (6), (7) or (8):

(6)

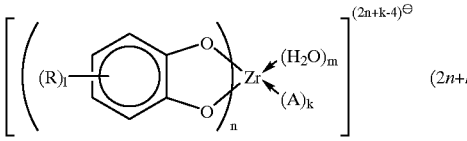

$(2n+k-4)Cl^{\oplus}$ (7)

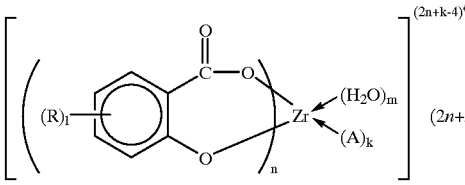

$(2n+k-4)Cl^{\oplus}$ (8)

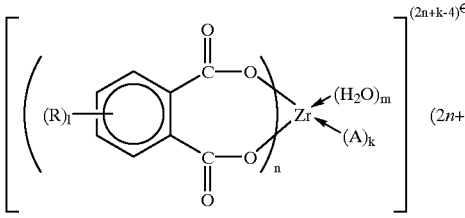

$(2n+k-4)Cl^{\oplus}$ wherein R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino, or carbamoyl, a plurality (when l≧2) of R can be mutually linked to form an alicyclic, aromatic or heterocyclic ring optionally substituted with 1–8 R groups; a plurality of R can be identical or different; A denotes an anion of halogen, hydroxyl, carboxylate, carbonate, nitrate, sulfate, cyano or thiocyano, a plurality of A can be identical or different; C1 denotes a monovalent cation of hydrogen, alkaline metal, ammonium or alkylammonium; l is an integer of 1–8; n is 1, 2, 3 or 4; m is 0, 1, 2, 3 or 4; k is 1, 2, 3, 4, 5 or 6; a plurality (when n≧2) of ligands can be identical or different in each complex or complex salt of a formula; with the proviso that each complex or complex salt of a formula can be a mixture of complex compounds having mutually different n or/and m, or a mixture of complex salts having mutually different counter ions C1 or/and anions A, and k is doubled when A is a divalent anion.

9. The toner according to claim 1, wherein the organic zirconium compound comprises a structure represented by the following formula (36), (36-1) or (37):

$$(Ar—COO^-)_n Zr^{4\oplus}(4-n)A_1^{\ominus} \quad (36)$$

$$(Ar—COO^-)_n Zr^{4\oplus}(2-n/2)A_2^{2\ominus} \quad (36\text{-}1)$$

$$(Ar—COO^-)_n Zr^{4\oplus}(O)(2-n)A_1^{\oplus}, \quad (37)$$

wherein Ar denotes an aromatic residue group optionally substituted with alkyl, aryl, aralkyl, cycloalkyl, alkenyl, alkoxy, aryloxy, hydroxyl, acylocy, alkoxycarbonyl, aryloxycarbonyl, acyl, carboxyl, halogen, nitro, cyano, amino, amido or carbamoyl; $A_1$ denotes a monovalent anion of halogen, hydroxyl, nitrate or carboxylate; $A_2$ denotes a divalent anion, such as sulfate, hydrogenphosphate or carbonate; and n is 1, 2, 3 or 4 with the proviso that in case of n≧2 for each metal salt, $A_1$, $A_2$ and a plurality of aromatic carboxylates and aromatic hydroxycarboxylates as acid ions may be identical to or different from each other, and that each metal salt of a formula can be a mixture of different salts having different numbers of n.

10. The toner according to claim 1, wherein the organic zirconium compound comprises a structure represented by the following formula (38), (38-1) or (39):

(38)

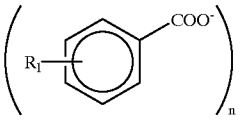

$Zr^{4\oplus}(4-n)A_1^{\ominus}$ (38-1)

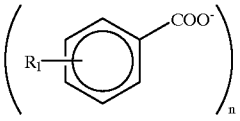

$Zr^{4\oplus}(2-n/2)A_2^{\ominus}$ (39)

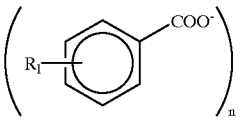

$Zr^{4\oplus}(O)(2-n)A_1^{\ominus}$, wherein R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when l≧2) of R can be mutually linked to form an alicyclic, aromatic or heterocyclic ring optionally substituted with 1–8 R groups; a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–8; and n is 1, 2, 3 or 4 with the proviso that in case of n≧2 for each metal salt, the anions $A_1$ and $A_2$ and a plurality of acid ions, may be identical to or different from each other; and that each metal salt of a formula can be a mixture of different salts having different numbers of n.

11. The toner according to claim 1, wherein the organic zirconium compound comprises a structure represented by the following formula (40) (40-1) or (41):

(40)

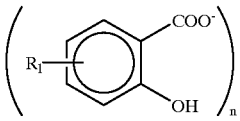

$Zr^{4\oplus}(4-n)A_1^-$ (40-1)

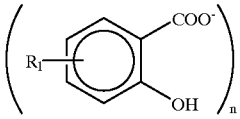

$Zr^{4\oplus}(2-n/2)A_2^{2-}$ (41)

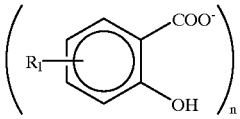

$Zr^{4\oplus}(O)(2-n)A_1^-$, wherein R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when l≧2) of R can be mutually linked to form an alicyclic, aromatic or heterocyclic ring optionally substituted with 1–8 R groups; a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–8; and n is 1, 2, 3 or 4 with the proviso that in case of n≧2 for each metal salt, the anions $A_1$ and $A_2$ and a plurality of acid ions, may be identical to or different from each other, and that each metal salt of a formula can be a mixture of different salts having different numbers of n.

12. The toner according to claim 1, wherein the binder resin has an acid value of 5–45 mgKOH/g.

13. The toner according to claim 1, wherein the binder resin has an acid value of 10–40 mgKOH/g.

14. The toner according to claim 1, wherein the toner contains a THF-soluble content having a GPC molecular weight distribution showing a main peak in a molecular weight range of 4,000–15,000.

15. The toner according to claim 14, wherein the molecular weight range is 5,000–12,000.

16. The toner according to claim 1, wherein the toner contains a THF-soluble content including a component having molecular weights of at least $5\times10^5$ at a content of 5–22% in its GPC molecular weight distribution.

17. The toner according to claim 16, wherein the content of the component having molecular weights of at least $5\times10^5$ is 7–20%.

18. The toner according to claim 1, wherein the binder resin contained in the toner contains 5–70 wt. % of a THF-insoluble content based on an entire resinous component in the toner.

19. The toner according to claim 18, wherein the content of the THF-insoluble content is 10–60 wt. %.

20. The toner according to claim 18, wherein the content of the THF-insoluble content is 15–50 wt. %.

21. The toner according to claim 1, wherein the toner has a contact angle to water of 95–130 deg.

22. The toner according to claim 21, wherein the toner has a contact angle to water of 100–127 deg.

23. The toner according to claim 21, wherein the toner has a contact angle to water of 105–125 deg.

24. The toner according to claim 1, wherein the hybrid resin component comprises the vinyl polymer unit and the polyester unit bonded to each other via a —CO·O— bond or a —CO·O·CO— bond.

25. The toner according to claim 1, wherein the hybrid resin component is a copolymer formed through transesterification between a polyester resin and a vinyl polymer comprising polymerized units having a carboxylate ester group.

26. The toner according to claim 1, wherein the hybrid resin component comprises a graft polymer comprising the vinyl polymer unit as a trunk polymer and the polyester unit as a graft polymer unit.

27. The toner according to claim 1, wherein the hybrid resin component contains a vinyl polymer unit comprising a constituent (meth)acrylate 10–60 mol. % of which is esterified with the polyester unit.

28. The toner according to claim 27, wherein the vinyl polymer unit comprises a constituent (meth)acrylate 15–50 mol. % of which is esterified with the polyester unit.

29. The toner according to claim 1, wherein the polyester unit has a crosslinking structure crosslinked with a polybasic carboxylic acid, a polybasic carboxylic anhydride or a polyhydric alcohol each having at least three functional groups.

30. The toner according to claim 1, wherein the vinyl polymer unit has a crosslinking structure crosslinked with a crosslinking agent having two or more vinyl groups.

31. The toner according to claim 1, wherein the hybrid binder resin comprises the polyester unit and the vinyl polymer unit in a weight proportion of 30:70 to 90:10.

32. The toner according to claim 31, wherein the weight proportion is 40:60 to 80:20.

33. The toner according to claim 1, wherein the binder resin contained in the toner contains a chloroform-insoluble content in an amount of 2–60 wt. % based on an entire resinous component in the toner.

34. The toner according to claim 33, wherein the amount of chloroform-insoluble content is from 5–55 wt. %.

35. The toner according to claim 1, wherein the binder resin contains a chloroform-soluble content having an acid value (Av.S) and a chloroform-insoluble content having an acid value (Av.G) providing a difference therebetween (Av.G–Av.S) of 10–150 mgKOH/g.

36. The toner according to claim 35, wherein the difference is 20–130 mgKOH/g.

37. The toner according to claim 1, wherein the toner contains the organic zirconium compound in an amount of 0.1–10 wt. parts per 100 wt. parts of the binder resin.

38. The toner according to claim 37, wherein the toner contains the organic zirconium compound in an amount of 0.5–10 wt. parts per 100 wt. parts of the binder resin.

39. The toner according to claim 37, wherein the toner contains the organic zirconium compound in an amount of 0.5–5 wt. parts per 100 wt. parts of the binder resin.

40. The toner according to claim 1, wherein the toner contains a wax having a GPC molecular weight distribution showing a main peak in a molecular weight range of 300–5,000 and a ratio Mw/Mn of 1.1–15.

41. The toner according to claim 40, wherein the molecular weight range of the main peak is 500–4,500 and the ratio Mw/Mn is 1.2–10.

42. The toner according to claim 40, wherein the molecular weight range of the main peak is 700–4,000 and the ratio Mw/Mn is 1.5–8.

43. The toner according to claim 40, wherein the wax has a melting point of 70–140° C. in terms of a heat-absorption peak temperature on temperature increase by differential scanning calorimetry (DSC).

44. The toner according to claim 43, wherein the wax has a melting point of 80–135° C.

45. The toner according to claim 43, wherein the wax has a melting point of 85–130° C.

46. The toner according to claim 40, wherein the wax comprises a hydrocarbon wax, a polyethylene wax or a polypropylene wax.

47. The toner according to claim 40, wherein the wax is represented by the formula (I):

$$CH_3—(CH_2—CH_2)_a—CH_2—CH_2—A, \quad (I)$$

wherein A denotes hydroxyl group or carboxyl group and a is an integer of 20–60.

48. The toner according to claim 47, wherein the wax comprises an acid-modified polypropylene wax having an acid value of 1–20 mgKOH/g.

49. The toner according to claim 47, wherein the wax comprises an acid-modified polyethylene wax having an acid value of 1–20 mgKOH/g.

50. The toner according to claim 1, wherein the toner contains two species of waxes, the waxes contained in the toner having a GPC molecular weight distribution showing a main peak in a molecular weight range of 500–5,000 and a ratio Mw/Mn of 1.2–15.

51. The toner according to claim 50, wherein the molecular weight range of the main peak is 700–4,500 and the ratio Mw/Mn is 1.5–12.

52. The toner according to claim 50, wherein the molecular weight range of the main peak is 1,000–4,000 and the ratio Mw/Mn is 2–10.

53. The toner according to claim 52, wherein at least one species of the waxes comprises a hydrocarbon wax, a polyethylene wax or a polypropylene wax.

54. The toner according to claim 52, wherein at least one species of the waxes is represented by the formula (I):

$$CH_3-(CH_2-CH_2)_a-CH_2-CH_2-A, \quad (I)$$

wherein A denotes hydroxyl group and a is an integer of 20–60.

55. The toner according to claim 52, wherein at least one species of the waxes comprises an acid-modified polypropylene wax having an acid value of 1–20 mgKOH/g.

56. The toner according to claim 52, wherein at least one species of the waxes comprises an acid-modified polyethylene wax having an acid value of 1–20 mgKOH/g.

57. The toner according to claim 1, wherein the binder resin comprises a resin composition comprising the hybrid resin component, a vinyl polymer and a polyester resin.

58. The toner according to claim 1, wherein the colorant comprises an magnetic iron oxide which is contained in the toner in an amount of 20–200 wt. parts per 100 wt. parts of the binder resin.

59. The toner according to claim 1, wherein the colorant comprises a pigment or a dye, which is contained in the toner in an amount of 0.1–20 wt. parts per 100 wt. parts of the binder resin.

60. The toner according to claim 1, wherein the toner has a weight-average particle size (D4) of 2.5–10 $\mu$m.

61. The toner according to claim 1, wherein the toner comprises toner particles to which inorganic fine powder is externally added.

62. The toner according to claim 1, wherein the toner is a component of a mono-component developer.

63. A two-component developer comprising the toner according to claim 1 in admixture with a carrier.

64. An image forming method, comprising:

a developing step of developing an electrostatic latent image held on an image-bearing member with a toner having a negative triboelectric chargeability to form a toner image on the image-bearing member, a transfer step of transferring the toner image formed on the image-bearing member onto a recording material via or without via an intermediate transfer member, and a fixing step of fixing the toner image onto the recording material by a heat-fixing means, wherein the toner comprises at least a binder resin, a colorant and an organic metal component, and (a) the organic metal compound is an organic zirconium compound comprising a coordination or/and a bonding of zirconium and an aromatic compound as a ligand or/and an acid source selected from the group consisting of aromatic diols, aromatic hydroxycarboxylic acids, aromatic monocarboxylic acids, and aromatic polycarboxylic acids, (b) the binder resin comprises a hybrid resin component comprising a polyester unit and a vinyl polymer unit, (c) the binder resin has an acid value of 2–50 mgKOH/g, and (d) the toner contains a THF (tetrahydrofuran)-soluble content providing a GPC (gel permeation chromatography) chromatogram exhibiting a main peak in a molecular weight range of 3,000–20,000 and including 3–25% of a component having molecular weights of at least $5\times10^5$.

65. The method according to claim 64, wherein said organic zirconium compound is a zirconium complex comprising a coordination with an aromatic diol, an aromatic hydroxycarboxylic acid or an aromatic polycarboxylic acid.

66. The method according to claim 64, wherein said organic zirconium compound is a zirconium complex salt comprising a coordination with an aromatic diol, an aromatic hydroxycarboxylic acid or an aromatic polycarboxylic acid.

67. The method according to claim 64, wherein said organic zirconium compound is a zirconium salt comprising an ionic bonding with an aromatic carboxylic acid, an aromatic hydroxycarboxylic acid or an aromatic polycarboxylic acid.

68. The method according to claim 64, wherein said organic zirconium compound comprises a structure represented by the following formula (1):

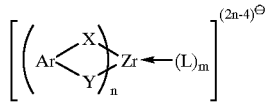

(1)

$(2n-4)C1^{\oplus}$ or $(n-2)C2^{2\oplus}$ wherein Ar denotes an aromatic residual group optionally substituted with alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; C1 denotes a monovalent cation of hydrogen ion, monovalent metal ion, ammonium ion or alkylammonium ion; C2 denotes a divalent cation of a metal ion; n is 2, 3 or 4; m is 0, 2 or 4; a plurality (n) of ligands of aromatic carboxylic acids and diols can be identical to or different from each other, and a plurality (when m=2 or 4) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2.

69. The method according to claim 64, wherein said organic zirconium compound comprises a structure represented by the following formula (2):

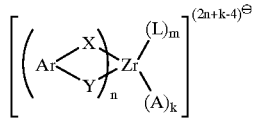

(2)

$(2n-k+4)C1^{\oplus}$ or $(n+k/2-2)C2^{2\oplus}$ wherein Ar denotes an aromatic residue group optionally substituted with alkyl, aryl, aralkyl, cycloalkyl, alkenyl, alkoxy, aryloxy, hydroxyl, alkoxycarbonyl, aryloxycarbonyl, acyl, acyloxy, carboxyl, halogen, nitro, cyano, amino, amide, or carbamoyl; X and Y independently denotes O or —CO—O—; L denotes a neutral ligand of water, alcohol, ammonia, alkylamine or pyridine; A denotes an anion of halogen, hydroxyl, carboxylate, carbonate, nitrate, sulfate, cyano or thiocyano, a plurality of A can be identical or different when $k\geqq2$; C1 denotes a monovalent cation of hydrogen ion, monovalent metal ion, ammonium ion or alkylammonium ion; C2 denotes a divalent cation of a metal ion; n is 1, 2, 3 or 4; m is 0, 1, 2, 3 or 4; k is 1, 2, 3, 4, 5 or 6; a number (when n≧2) of ligands (of aromatic carboxylic acids and diols) can be identical to or different from each other, and a number (when m≧2) of neutral ligands can be identical to or different from each other in each complex or complex salt of a formula; with the proviso that each complex or complex salt of a formula can also be a mixture of complex compounds having mutually different n or/and m, or a mixture of complex salts having mutually different counter ions C1 or/and C2, and k is doubled when A is a divalent anion.

70. The method according to claim 64, wherein said organic zirconium compound comprises a structure represented by the following formula (3), (4) or (5):

(3)

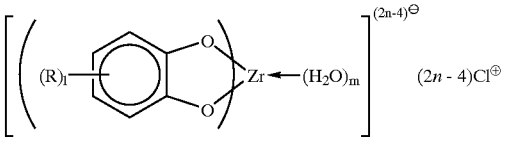

(4)

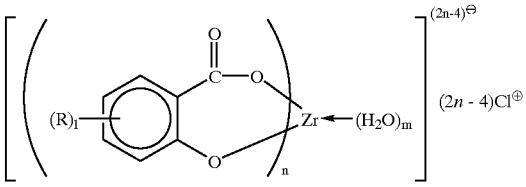

(5)

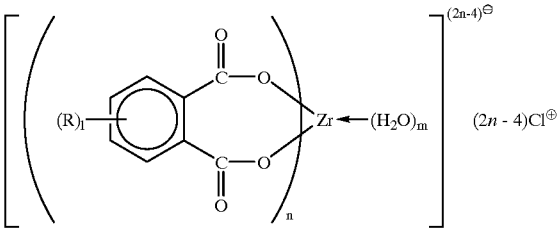

wherein R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring optionally substituted with 1–8 R groups; a plurality of R can be identical or different; C1 denotes a monovalent cation of hydrogen, alkaline metal, ammonium or alkylammonium; l is an integer of 1–8; n is 2, 3 or 4; m is 0, 2 or 4; a plurality (n) of ligands can be identical or different in each complex or complex salt of a formula; with the proviso that each complex or complex salt of a formula can be a mixture of complex compounds having mutually different n or/and m, or a mixture of complex salts having mutually different counter ions C1.

71. The method according to claim 64, wherein the organic zirconium compound comprises a structure represented by the following formula (6), (7) or (8):

(6)

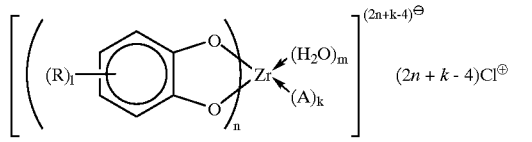

(7)

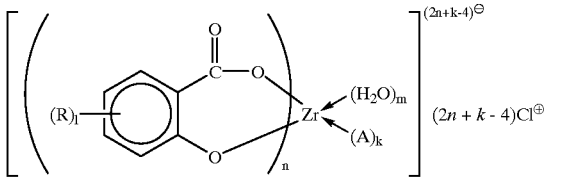

(8)

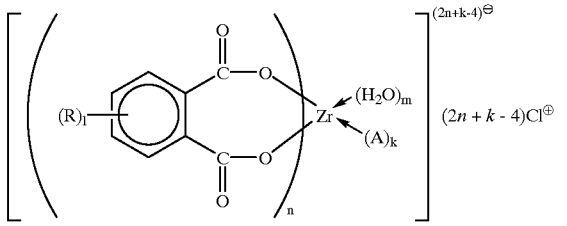

wherein R denotes a substituent of hydrogen, alkyl, aryl, aralkyl, cycloalkyl, alkenyl, alkoxy, aryloxy, hydroxyl, acyloxy, alkoxycarbonyl, aryloxycarbonyl, acyl, carboxyl, halogen, nitro, amino or carbamoyl, a plurality (when l≧2) of R can be mutually linked to form an alicyclic, aromatic or heterocyclic ring optionally substituted with 1–8 R groups; a plurality of R can be identical or different; A denotes an anion of halogen, hydroxyl, carboxylate, carbonate, nitrate, sulfate, cyano or thiocyano, a plurality of A can be identical or different; C1 denotes a monovalent cation of hydrogen, alkaline metal, ammonium or alkylammonium; l is an integer of 1–8; n is 1, 2, 3 or 4; m is 0, 1, 2, 3 or 4; k is 1, 2, 3, 4, 5 or 6; a plurality (when n≧2) of ligands can be identical or different in each complex or complex salt of a formula; with the proviso that each complex or complex salt of a formula can be a mixture of complex compounds having mutually different n or/and m, or a mixture of complex salts having mutually different counter ions C1 or/and anions A, and k is doubled when A is a divalent anion.

72. The method according to claim 64, wherein the organic zirconium compound comprises a structure represented by the following formula (36), (36-1) or (37):

(36)

$$(Ar—COO^-)_nZr^{4\oplus}(4-n)A_1^{\ominus}$$

(36-1)

$$(Ar—COO^-)_nZr^{4\oplus}(2-n/2)A_2^{2\ominus}$$

(37)

$$(Ar—COO^-)_nZr^{4\oplus}(O)(2-n)A_1^{\oplus},$$

wherein Ar denotes an aromatic residue group optionally substituted with alkyl, aryl, aralkyl, cycloalkyl, alkenyl, alkoxy; aryloxy, hydroxyl, acyloxy, alkoxycarbonyl, aryloxycarbonyl, acyl, carboxyl, halogen, nitro, cyano, amino, amido or carbamoyl; $A_1$ denotes a monovalent anion of halogen, hydroxyl, nitrate or carboxylate; $A_2$ denotes a divalent anion, such as sulfate, hydrogenphosphate or carbonate; and n is 1, 2, 3 or 4 with the proviso that in case of n≧2 for each metal salt, $A_1$, $A_2$ and a plurality of aromatic carboxylates and aromatic hydroxycarboxylates as acid ions may be identical to or different from each other, and that each metal salt of a formula can be a mixture of different salts having different numbers of n.

73. The method according to claim 64, wherein the organic zirconium compound comprises a structure represented by the following formula (38), (38-1) or (39):

(38-1)

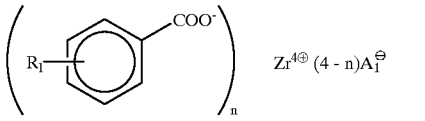

$Zr^{4\oplus}$ (4 - n)$A_1^{\ominus}$ (38-1)

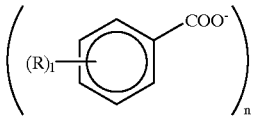

$Zr^{4\oplus}$ (2 - $n$/2)$A_2^{\ominus}$ (39)

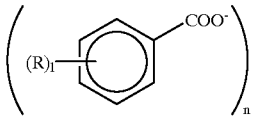

$Zr^{4\oplus}$ (O)(2 - $n$)$A_1^{\ominus}$, wherein R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when l≧2) of R can be mutually linked to form an alicyclic, aromatic or heterocyclic ring optionally substituted with 1–8 R groups; a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–8; and n is 1, 2, 3 or 4 with the proviso that in case of n≧2 for each metal salt, the anions $A_1$ and $A_2$ and a plurality of acid ions may be identical to or different from each other; and that each metal salt of a formula can be a mixture of different salts having different numbers of n.

74. The method according to claim 64, wherein the organic zirconium compound comprises a structure represented by the following formula (40), (40-1) or (41):

(40)

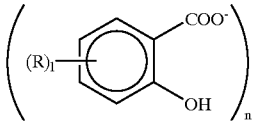

$^{\oplus}$(4 - $n$)$A_1^-$ (40-1)

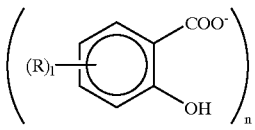

$Zr^{4\oplus}$ (2 - $n$/2)$A_2^{2-}$

-continued (41)

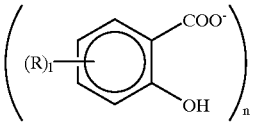

$Zr^{4\oplus}$ (O)(2 - $n$)$A_1^-$, wherein R denotes a substituent of hydrogen, alkyl, aryl, aralkyl, cycloalkyl, alkenyl, alkoxy, aryloxy, hydroxyl, alkoxycarbonyl, aryloxycarbonyl, acyloxy, acyl, carboxyl, halogen, nitro, amino, amido or carbamoyl, a plurality (when l≧2) of R can be mutually linked to form an alicyclic, aromatic or heterocyclic ring optionally substituted with 1–8 R groups; a plurality of R can be identical or different; $A_1$ denotes a monovalent anion of halogen, hydroxyl, nitrate or carboxylate; $A_2$ denotes a divalent anion of sulfate, hydrogenphosphate or carbonate; l is an integer of 1–8; and n is 1, 2, 3 or 4 with the proviso that in case of n≧2 for each metal salt, the anions $A_1$ and $A_2$ and a plurality of acid ions, may be identical to or different from each other, and that each metal salt of a formula can be a mixture of different salts having different numbers of n.

75. The method according to claim 64, wherein the binder resin has an acid value of 5–45 mgKOH/g.

76. The method according to claim 64, wherein the binder resin has an acid value of 10–40 mgKOH/g.

77. The method according to claim 64, wherein the toner contains a THF-soluble content having a GPC molecular weight distribution showing a main peak in a molecular weight range of 4,000–15,000.

78. The method according to claim 77, wherein the molecular weight range is 5,000–12,000.

79. The method according to claim 64, wherein the toner contains a THF-soluble content including a component having molecular weights of at least $5\times10^5$ at a content of 5–22% in its GPC molecular weight distribution.

80. The method according to claim 79, wherein the content of the component having molecular weights of at least $5\times10^5$ is 7–20%.

81. The method according to claim 64, wherein the binder resin contained in the toner contains 5–70 wt. % of a THF-insoluble content based on an entire resinous component in the toner.

82. The method according to claim 81, wherein the content of the THF-insoluble content is 10–60 wt. %.

83. The method according to claim 81, wherein the content of the THF-insoluble content is 15–50 wt. %.

84. The method according to claim 64, wherein the toner has a contact angle to water of 95–130 deg.

85. The method according to claim 84, wherein the toner has a contact angle to water of 100–127 deg.

86. The method according to claim 84, wherein the toner has a contact angle to water of 105–125 deg.

87. The method according to claim 64, wherein the hybrid resin component comprises the vinyl polymer unit and the polyester unit bonded to each other via a —CO·O— bond or a —CO·O·CO— bond.

88. The method according to claim 64, wherein the hybrid resin component is a copolymer formed through transesterification between a polyester resin and a vinyl polymer comprising polymerized units having a carboxylate ester group.

89. The method according to claim 64, wherein the hybrid resin component comprises a graft polymer comprising the vinyl polymer unit as a trunk polymer and the polyester unit as a graft polymer unit.

90. The method according to claim 64, wherein the hybrid resin component contains a vinyl polymer unit comprising a constituent (meth)acrylate 10–60 mol. % of which is esterified with the polyester unit.

91. The method according to claim 90, wherein the vinyl polymer unit comprises a constituent (meth)acrylate 15–50 mol. % of which is esterified with the polyester unit.

92. The method according to claim 64, wherein the polyester unit has a crosslinking structure crosslinked with a polybasic carboxylic acid, a polybasic carboxylic anhydride or a polyhydric alcohol each having at least three functional groups.

93. The method according to claim 64, wherein the vinyl polymer unit has a crosslinking structure crosslinked with a crosslinking agent having two or more vinyl groups.

94. The method according to claim 64, wherein the hybrid binder resin comprises the polyester unit and the vinyl polymer unit in a weight proportion of 30:70 to 90:10.

95. The method according to claim 94, wherein the weight proportion is 40:60 to 80:20.

96. The method according to claim 64, wherein the binder resin contained in the toner contains a chloroform-insoluble content in an amount of 2–60 wt. % based on an entire resinous component in the toner.

97. The method according to claim 96, wherein the amount of chloroform-insoluble content is from 5–55 wt. %.

98. The method according to claim 64, wherein the binder resin contains a chloroform-soluble content having an acid value (Av.S) and a chloroform-insoluble content having an acid value (Av.G) providing a difference therebetween (Av.G–Av.S) of 10–150 mgKOH/g.

99. The method according to claim 98, wherein the difference is 20–130 mgKOH/g.

100. The method according to claim 64, wherein the toner contains the organic zirconium compound in an amount of 0.1–10 wt. parts per 100 wt. parts of the binder resin.

101. The method according to claim 100, wherein the toner contains the organic zirconium compound in an amount of 0.5–10 wt. parts per 100 wt. parts of the binder resin.

102. The method according to claim 100, wherein the toner contains the organic zirconium compound in an amount of 0.5–5 wt. parts per 100 wt. parts of the binder resin.

103. The method according to claim 64, wherein the toner contains a wax having a GPC molecular weight distribution showing a main peak in a molecular weight range of 300–5,000 and a ratio Mw/Mn of 1.1–15.

104. The method according to claim 103, wherein the molecular weight range of the main peak is 500–4,500 and the ratio Mw/Mn is 1.2–10.

105. The method according to claim 103, wherein the molecular weight range of the main peak is 700–4,000 and the ratio Mw/Mn is 1.5–8.

106. The method according to claim 103, wherein the wax has a melting point of 70–140° C. in terms of a heat-absorption peak temperature on temperature increase by differential scanning calorimetry (DSC).

107. The method according to claim 106, wherein the wax has a melting point of 80–135° C.

108. The method according to claim 106, wherein the wax has a melting point of 85–130° C.

109. The method according to claim 103, wherein the wax comprises a hydrocarbon wax, a polyethylene wax or a polypropylene wax.

110. The method according to claim 103, wherein the wax is represented by the formula (I):

$$CH_3-(CH_2-CH_2)_a-CH_2-CH_2-A, \quad (I)$$

wherein A denotes hydroxyl group or carboxyl group and a is an integer of 20–60.

111. The method according to claim 110, wherein the wax comprises an acid-modified polypropylene wax having an acid value of 1–20 mgKOH/g.

112. The method according to claim 110, wherein the wax comprises an acid-modified polyethylene wax having an acid value of 1–20 mgKOH/g.

113. The method according to claim 64, wherein the toner contains two species of waxes, the waxes contained in the toner having a GPC molecular weight distribution showing a main peak in a molecular weight range of 500–5,000 and a ratio Mw/Mn of 1.2–15.

114. The method according to claim 113, wherein the molecular weight range of the main peak is 700–4,500 and the ratio Mw/Mn is 1.5–12.

115. The method according to claim 113, wherein the molecular weight range of the main peak is 1,000–4,000 and the ratio Mw/Mn is 2–10.

116. The method according to claim 115, wherein at least one species of the waxes comprises a hydrocarbon wax, a polyethylene wax or a polypropylene wax.

117. The method according to claim 115, wherein at least one species of the waxes is represented by the formula (I):

$$CH_3-(CH_2-CH_2)_a-CH_2-CH_2-A, \quad (I)$$

wherein A denotes hydroxyl group and a is an integer of 20–60.

118. The method according to claim 115, wherein at least one species of the waxes comprises an acid-modified polypropylene wax having an acid value of 1–20 mgKOH/g.

119. The method according to claim 115, wherein at least one species of the waxes comprises an acid-modified polyethylene wax having an acid value of 1–20 mgKOH/g.

120. The method according to claim 64, wherein the binder resin comprises a resin composition comprising the hybrid resin component, a vinyl polymer and a polyester resin.

121. The method according to claim 64, wherein the colorant comprises a magnetic iron oxide which is contained in the toner in an amount of 20–200 wt. parts per 100 wt. parts of the binder resin.

122. The method according to claim 64, wherein the colorant comprises a pigment or a dye, which is contained in the toner in an amount of 0.1–20 wt. parts per 100 wt. parts of the binder resin.

123. The method according to claim 64, wherein the toner has a weight-average particle size (D4) of 2.5–10 $\mu$m.

124. The method according to claim 64, wherein the toner comprises toner particles to which inorganic fine powder is externally added.

125. The method according to claim 64, wherein in the developing step, a layer thickness of a mono-component developer comprising the toner having a negative triboelectric charge on a developer-carrying member is regulated by a developer thickness-regulation means, and an electrostatic image held on an electrostatic image-bearing member disposed opposite to the developer-carrying member is developed with the mono-component developer carried on the developer-carrying member.

126. The method according to claim 125, wherein the developer-carrying member comprises a substrate, and a resin layer containing an electroconductive substance formed on the substrate.

127. The method according to claim 125, wherein the mono-component developer comprises a magnetic toner having a negative triboelectric charge.

128. The method according to claim 125, wherein the mono-component developer comprises a non-magnetic toner having a negative triboelectric charge.

129. The method according to claim 64, wherein the electrostatic latent image is developed with a two-component developer comprising the toner and a carrier.

* * * * *

UNITED STATES PATENT AND TRADEMARK OFFICE

CERTIFICATE OF CORRECTION

PATENT NO. : 6,232,027 B1
DATED : May 15, 2001
INVENTOR(S) : Satoshi Matsunaga et al.

It is certified that error appears in the above-identified patent and that said Letters Patent is hereby corrected as shown below:

Title page,
Item [57] ABSTRACT,
Line 14, "TFT" should read -- THF --.

Drawings,
Sheet 6 of 11,
FIG. 7, COPOLYHER" should read -- COPOLYMER --.

Column 6,
Lines 1 and 33, "TFT" should read -- THF --.

Column 9,
Line 2, "carboxyl" should read -- carboxylic --.

Column 14,
Formula 11, " 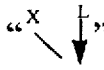 " should read -- 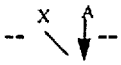 --

Column 18,
Line 30, "(0)" should read -- (O) --.

Column 19,
Line 5, "(0)" should read -- (O) --.

Column 46,
Line 20, "ia" should read -- a --.

Column 48,
Line 8, "components, the organic zir-" should be deleted; and
Line 9, "conium compound is well" should be deleted.

Column 51,
Line 17, "tripentaerithritol," should read -- tripentaerythritol, --.

Column 52,
Line 18, "a least" should read -- at least --.

UNITED STATES PATENT AND TRADEMARK OFFICE

CERTIFICATE OF CORRECTION

PATENT NO. : 6,232,027 B1
DATED : May 15, 2001
INVENTOR(S) : Satoshi Matsunaga et al.

It is certified that error appears in the above-identified patent and that said Letters Patent is hereby corrected as shown below:

Column 56,
Line 27, "the" should read -- an --.

Column 57,
Line 34, "$C_{14}H_{2(n)}$" should read --- $C_{14}H_{27(n)}$ --.

Column 58,
Line 66, "rein" should read -- resin --.

Column 60,
Line 4, "methacryonitrile," should read -- methacrylonitrile, --.

Column 75,
Line 41, "Counter" should read -- Coulter --.

Column 76,
Line 58, "'H-HMR" should read -- 'H-NMR --.

Column 77,
Line 1, "1c)," should read -- 1c), --;
Line 20, "'N-NMR" should read -- 'H-NMR– and "FIGS. 4 and 5)" should read -- FIGS. 8 and 9) --.

Column 78,
Line 39, "200 ml-Erlenmeter" should read -- 200 ml- Erlenmeyer --;
Line 42, "Erlenmeter" should read -- Erlenmeyer --; and
Line 48, "meter" should read -- meyer --.

Column 79,
Line 38, "contrued" should read -- construed --.

Column 81,
Line 51, "resin A-G" should read -- resins A-G --; and
Line 52, "along" should read -- alone --.

UNITED STATES PATENT AND TRADEMARK OFFICE

CERTIFICATE OF CORRECTION

PATENT NO. : 6,232,027 B1
DATED : May 15, 2001
INVENTOR(S) : Satoshi Matsunaga et al.

It is certified that error appears in the above-identified patent and that said Letters Patent is hereby corrected as shown below:

Column 92,
Line 55, "ions" should read -- iron --.

Column 95,
Line 9, "Magnetic toner No. 1" should read -- Magnetic toner No. 27 --; and
Line 13, "was." should read -- was --.

Column 96,
Line 14, "ion" should read -- iron --.

Column 98,
Line 21, "Example". Should read -- Example 1. --;
Line 29, "ion" should read -- iron --.

Column 103,
Line 6, "EXAMPLE U" should read -- EXAMPLES U --;
Line 10, "thath" should read -- that --.

Column 106,
Line 38, "(SBET" should read -- ($S_{BET}$ --.

Column 107,
Line 4, "A:" should read -- ¶A: --.

Column 112,
Line 63, "when (m=2" should read -- (when m=2 --.

Column 114,
Line 21, "purity (n)" should read -- plurality (n) --.

Column 115,
Line 28, "acylocy," should read -- acyloxy, --.

Column 116,
Line 11, "(40)" should read -- (40), --.

UNITED STATES PATENT AND TRADEMARK OFFICE

CERTIFICATE OF CORRECTION

PATENT NO. : 6,232,027 B1
DATED : May 15, 2001
INVENTOR(S) : Satoshi Matsunaga et al.

It is certified that error appears in the above-identified patent and that said Letters Patent is hereby corrected as shown below:

Column 119,
Line 20, "an" should read -- a --; and
Line 50, "component," should read -- compound, --.

Column 122,
Line 63, "alkoxy;" should read -- alkoxy, --.

Signed and Sealed this

Twenty-sixth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,232,027 B1
DATED : May 15, 2001
INVENTOR(S) : Satoshi Matsunaga et al.

It is certified that error appears in the above-identified patent and that said Letters Patent is hereby corrected as shown below:

Column 73,
Line 46, "at least $10^5$" should read -- at least $5x10^5$ --;
Line 48, "($\geqq 10^5$%)" should read -- ($\geqq 5x10^5$%) --.

Column 83,
Line 38, "($\geqq 10^5$%)" should read -- ($\geqq 5x10^5$%) --.

Column 88,
Table 7, "$\geqq 10^5$%" should read -- $\geqq 5x10^5$% --.

Column 91,
Line 50, "($\geqq 10^5$%)" should read -- ($\geqq 5x10^5$%) --.

Column 93,
Table 12, "$\geqq 10^5$%" should read -- $\geqq 5x10^5$% --.

Column 95,
Line 15, "($\geqq 10^5$%)" should read -- ($\geqq 5x10^5$%) --.

Column 96,
Table 16, "$\geqq 10^5$%" should read -- $\geqq 5x10^5$% --.

Column 97,
Line 36, "($\geqq 10^5$%)" should read -- ($\geqq 5x10^5$%) --.

Column 98,
Table 19, "$\geqq 10^5$%" should read -- $\geqq 5x10^5$% --.

Column 104,
Table 24, "$\geqq 10^5$%" should read -- $\geqq 5x10^5$% --;
Table 25, "$\geqq 10^5$%" should read -- $\geqq 5x10^5$% --.

UNITED STATES PATENT AND TRADEMARK OFFICE

CERTIFICATE OF CORRECTION

PATENT NO. : 6,232,027 B1
DATED : May 15, 2001
INVENTOR(S) : Satoshi Matsunaga et al.

It is certified that error appears in the above-identified patent and that said Letters Patent is hereby corrected as shown below:

Column 108,
Table 27, "$\geqq 10^5$%" should read -- $5x10^5$% --.

Columns 109-110,
Table 28, "$\geqq 10^5$%" should read -- $5x10^5$% --.

Signed and Sealed this

Nineteenth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,232,027 B1
DATED : May 15, 2001
INVENTOR(S) : Satoshi Matsunaga et al.

It is certified that error appears in the above-identified patent and that said Letters Patent is hereby corrected as shown below:

Column 73,
Line 46, "at least $10^5$" should read -- at least $5x10^5$ --;

This certificate supersedes Certificate of Correction issued November 19, 2002.

Signed and Sealed this

Twenty-ninth Day of April, 2003

JAMES E. ROGAN
*Director of the United States Patent and Trademark Office*